US007205868B2

(12) United States Patent
Park et al.

(10) Patent No.: US 7,205,868 B2
(45) Date of Patent: Apr. 17, 2007

(54) VARIABLE RADIO FREQUENCY BAND FILTER

(75) Inventors: Jong-Kyu Park, Osan-si (KR); Duk-Yong Kim, Yongin-si (KR); Gil-Ho Lee, Yongin-si (KR); Kwang-Yeob Kim, Osan-si (KR); Jae-Hong Kim, Seoul (KR); Yon-Tae Kim, Yongin-si (KR); Byung-Chul Kim, Osan-si (KR)

(73) Assignee: KMW, Inc., Hwaseong-si (KR)

( * ) Notice: Subject to any disclaimer, the term of this patent is extended or adjusted under 35 U.S.C. 154(b) by 59 days.

(21) Appl. No.: 10/924,379

(22) Filed: Aug. 23, 2004

(65) Prior Publication Data

US 2005/0040916 A1 Feb. 24, 2005

(30) Foreign Application Priority Data

Aug. 23, 2003 (KR) ..... 10-2003-0058556
May 22, 2004 (KR) ..... 10-2004-0036623
Jun. 21, 2004 (KR) ..... 10-2004-0046103

(51) Int. Cl.
*H01P 1/20* (2006.01)

(52) U.S. Cl. ..... 333/203; 333/224; 333/232

(58) Field of Classification Search ..... 333/203, 333/206, 208, 209, 219.1, 222, 231, 232, 333/224, 235
See application file for complete search history.

(56) References Cited

U.S. PATENT DOCUMENTS 5,184,096 A * 2/1993 Wakino et al. ..... 333/175
6,147,577 A 11/2000 Cavey
6,262,639 B1 7/2001 Shu et al.
6,353,373 B1 3/2002 Liang

FOREIGN PATENT DOCUMENTS

JP 2000-295010 A 10/2000
JP 2001-127502 A 5/2001

* cited by examiner

*Primary Examiner*—Robert Pascal
*Assistant Examiner*—Kimberly E Glenn
(74) *Attorney, Agent, or Firm*—Drinker Biddle & Reath LLP; Joseph J. Buczynski

(57) ABSTRACT

A variable radio frequency band filter capable of varying the resonance frequency band comprises a housing having a support; a number of resonator rods arranged along the longitudinal direction of the housing; at least one tuning rod positioned on top of the resonator rods; a tuning support extending through the respective tuning rods along the longitudinal direction of the housing and adapted to slide on top of the respective resonator rods to vary the position of the tuning rods; and a frequency variation unit positioned on a lateral surface of the housing. The frequency variation unit being coupled to an end of the tuning support and adapted to vary the position of the tuning rods, as the tuning support is slid, according to the frequency band.

32 Claims, 67 Drawing Sheets

VARIABLE RADIO FREQUENCY BAND FILTER

PRIORITY

This application claims priority to an application entitled "Variable Radio Frequency Filter" filed with the Korean Intellectual Property Office on Aug. 23, 2003 and assigned Serial No. 2003-58556, to an application entitled "Variable Radio Frequency Filter" filed with the Korean Intellectual Property Office on May 22, 2004 and assigned Serial No. 2004-36623, and to an application entitled "Variable Radio Frequency Band Filter" filed with the Korean Intellectual Property Office on Jun. 21, 2004 and assigned Serial No. 2004-46103, the contents of each of these applications are hereby incorporated by reference, and this application claims the benefit of U.S. Provisional Application No. 60/520,276, filed Nov. 17, 2003.

BACKGROUND OF THE INVENTION

1. Field of the Invention

The present invention relates to a variable radio frequency filter, and more particularly, to a variable frequency band filter capable of varying the resonance frequency band.

2. Description of the Related Art

In general, a business provider of a wireless communication service is allocated a frequency band from, for example, a regulatory body of the country in which the provider resides, and thus can provide general subscribers with service on this frequency band. In the case of a commercial wireless communication service, each service provider is allocated a different frequency band. The service provider may divide the allocated frequency band into a number of channels having predetermined bandwidths, when needed by a communication system, or in order to improve the efficiency of using the frequency.

For example, in the current code-division multiple access (CDMA) mode, this is referred to as FA (frequency allocation), where each channel can have a bandwidth of 1.23 MHz, and a service provider having a bandwidth of 10 MHz allocated to it generally uses seven FAs. In the W-CDMA mode, the bandwidth of one FA is 3.84 MHz. Accordingly, a service provider of a wireless communication service can divide the allocated frequency band into a number of channels and choose one of them as desired. As known in the art, different radio frequency filters are separately manufactured and supplied according to the frequency band of respective service providers of wireless communication services.

A conventional radio frequency filter 100 will now be described with reference to FIGS. 1 to 6.

FIG. 1 is a perspective view showing a conventional cavity filter. As shown, the cavity filter includes a housing 110, disk-shaped resonator rods 120 (see FIG. 4), a cover 160, and tuning/coupling screws 170 and 175. The housing 110 has an input connector 111 and an output connector 113. The interior of the housing 110 is divided into a number of containing spaces by diaphragms 130. The disk-shaped resonator rods 120 are contained in the respective containing spaces.

The input connector 111 and the output connector 113 are positioned on the same side of the housing 110 and each of them is connected to a chosen containing space. The diaphragms 130 have coupling windows 131, 132, 133, 134, and 135 formed therein for serial connection from a containing space, to which the input connector 111 is connected, to another containing space, to which the output connector 113 is connected. The housing 110 has an open upper surface, and after the disk-shaped resonator rods 120 are positioned in the respective containing spaces, the upper end of the housing 100 is sealed using the cover 160.

The disk-shaped resonator rods 120 are composed of resonator rods 121, which extend from the bottom surface of the housing 110, and disks 122, which extend along the upper outer peripheral surfaces of the resonator rods 121 in the diametric direction thereof. The radio frequency filter 100, having disks 122 that are positioned on the resonator rods 120 which are assembled in the housing 110, is characterized in that it is operated for a low resonance frequency.

The interrelationship between the resonance frequency and the housing 110, the disk-shaped resonator rods 120, the diaphragms 130, as well as the cover 160, will now be further explained with reference to FIGS. 1 to 6.

In general, the resonance frequency is determined by values of capacitance and inductance, which are formed among capacitive components 17 and inductive components 19 constituting a resonance circuit formed by housing 110, disk-shaped resonator rods 120, diaphragms 130, and a cover 160, as is clear from the circuit diagram shown in FIG. 6. Referring to FIGS. 4 and 5, the input and output connectors 111 and 113 are connected the disk-shaped resonator rods 120 via an input terminal coupling copper wire 115 and an output terminal coupling copper wire 117, respectively. The resonance frequency of the radio frequency filter 100, configured as above, is affected by the length, outer diameter, and the like of the disk-shaped resonator rods 120 and is tuned more precisely with separate tuning/coupling screws 170 and 175.

Referring to FIG. 1, the tuning/coupling screws 170 are 175 are fastened on the cover 160 at locations corresponding to those of the disk-shaped resonator rods 120, which are contained in the housing 110, as well as at locations corresponding to those of the coupling windows 131 to 135, which are formed in the diaphragms 130. The tuning/coupling screws 170 and 175 are used to tune the resonance and coupling characteristics of the radio frequency filter 100 and are fixed using nuts 171, after the tuning, to prevent them from rotating.

The cover 160 is provided with fastening holes 169 for screws 179, and the housing 110 is provided with fastening tabs 180 on its upper end to fix the cover 160 on the upper end of the housing 110. The tuning/coupling screws 170 and 175 are fastened into screw holes (not shown), which are formed on the cover 160, and are used to tune the resonance frequency, inductance, or capacitance. In other words, the radio frequency filter 100 is tuned by tightening or loosening the tuning/coupling screws 170 and 175 to obtain desired resonance and coupling characteristics.

After the tuning of the radio frequency filter 100 is completed, the tuning/coupling screws 170 and 175 are fixed on the cover 160, for example, using nuts 171, so that the resonance frequency, as well as the resonance and coupling characteristics, will not change due to undesired rotation of the tuning/coupling screws 170 and 175. The tuning/coupling screws 170 and 175 can thus be classified as tuning screws 170, which are fixed at locations corresponding to those of the disk-shaped resonator rods 120 and are used to tune the resonance characteristics, and coupling screws 175, which are fixed at locations corresponding to those of the coupling windows 131 to 135 and are used to tune the coupling characteristics. Accordingly, the tuning/coupling screws 170 and 175 have different roles according to their respective locations.

A dielectric filter is another kind of filter and has the same construction as the cavity filter except that the disks are made of dielectric substance, such as ceramic, having a high dielectric constant and a high Q value, and are positioned in the center of containing spaces. The dielectric filter can have the same resonance frequency and at least the same Q value as in the case of the cavity filter, which is at least twice as large as the dielectric filter, by using disks made of dielectric substance of a high dielectric constant and a high Q value.

In the case of the cavity filter, the diameter and length of the resonator rods and the disks, as well as the distance to the upper side of the housing, are the main factors determining the resonance frequency. In the case of the dielectric filter, the dielectric constant of the disks is the main factor determining the resonance frequency.

However, conventional radio frequency filters, configured as above, are adapted for specific frequency bands or channels. Therefore, they cannot be used for different frequency bands or channels of different service providers. As a result, new radio frequency filters must be manufactured separately for different frequency bands, thus making it very difficult to mass-produce the filters, and also increases the manufacturing cost of the filters.

SUMMARY OF THE INVENTION

Accordingly, the present invention endeavors to solve the above-mentioned problems occurring in the conventional filters. Thus, an object of the present invention is to provide a variable frequency band filter capable of varying the resonance frequency band so that a single product can be used for different frequency bands.

Another object of the present invention is to provide a variable frequency band filter wherein a single product can be used for different frequency bands, instead of manufacturing separate filters for different frequency bands, so that the manufacturing cost can be decreased.

Still another object of the present invention is to provide a variable frequency band filter capable of simultaneously varying the resonance frequency, which depends on respective resonator rods, into a predetermined value with a single operation.

In order to accomplish these and other objects, the present invention provides a variable frequency band filter comprising: a housing having a number of containing spaces; a number of resonator rods extending upward from the bottom surface of the containing spaces; a number of tuning rods positioned on the upper or lateral surface of the respective resonator rods; and a tuning support extending through the opposite lateral surfaces of the housing and supported by them, with the tuning support being coupled to the respective tuning rods and being adapted to be moved by an external force to vary the position of the tuning rods.

Another aspect of the present invention provides a variable frequency band filter comprising: a housing; a number of resonator rods extending upward from the internal bottom surface of the housing; tuning plates positioned on the internal top surface of the housing and facing the upper end surface of the respective resonator rods; a tuning support rotatably coupled on the housing and positioned on top of the tuning plates; and tuning bars coupled to the tuning support and adapted to cause the tuning plates to approach or move away from the resonator rods as the tuning support is rotated.

Another aspect of the present invention provides a variable frequency band filter comprising: a housing; at least one resonator rod extending from the bottom surface of the housing; a tuning screw bar fastened to the outer peripheral surface of the housing and having an end disposed adjacently to the resonator rod; and a tuning support rotatably coupled to the outer peripheral surface of the housing to move the tuning screw bar, wherein as the tuning support is rotated, the tuning screw bar is moved and the resonance frequency band is varied.

Another aspect of the present invention provides a variable frequency band filter comprising: a housing; at least one resonator rod extending from the bottom surface of the housing; a first resonance tuning screw coupled to the outer peripheral surface of the housing in such a manner that it can be moved linearly, with an end of the first resonance tuning screw being disposed adjacently to the resonator rod; and a tuning support rotatably coupled to the outer peripheral surface of the housing. The variable frequency band filter further comprises a support plate extending from the outer peripheral surface of the tuning support, with the support plate having a surface facing the other end of the first resonance tuning screw and being adapted to be rotated about the tuning support as the tuning support is rotated; and a support spring having an end supported on the outer peripheral surface of the housing and the other end supported on the other end of the first resonance tuning screw, so that the supporting spring provides an elastic force in such a direction that an end of the first resonance tuning screw is moved away from the resonator rod. Hence, as the tuning support is rotated in one direction, an end of the first resonance tuning screw is moved by the support plate in a direction approaching the resonator rod, and as the tuning support is rotated in the other direction, an end of the first resonance tuning screw is moved away from the resonator rod, thereby varying the resonance frequency band.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. In the following description of the present invention, a detailed description of known functions and configurations may be omitted for conciseness.

The operation of a variable frequency band filter according to a first embodiment of the present invention will now be described in detail with reference to FIGS. 7 to 10.

Figure 7:
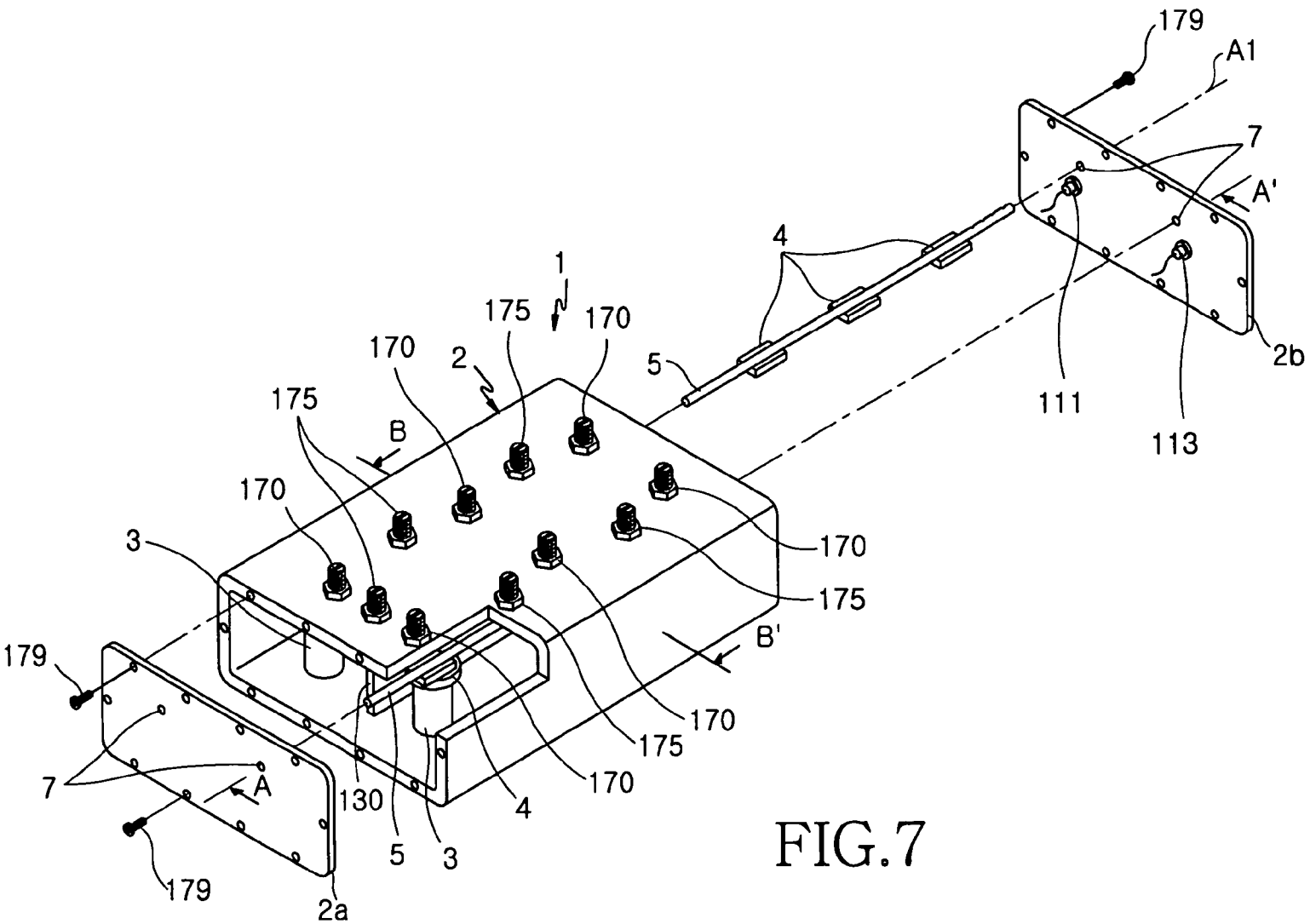
FIG. 7 is an exploded perspective view showing the construction of a variable frequency band filter according to a first preferred embodiment of the present invention.
Figure 8:
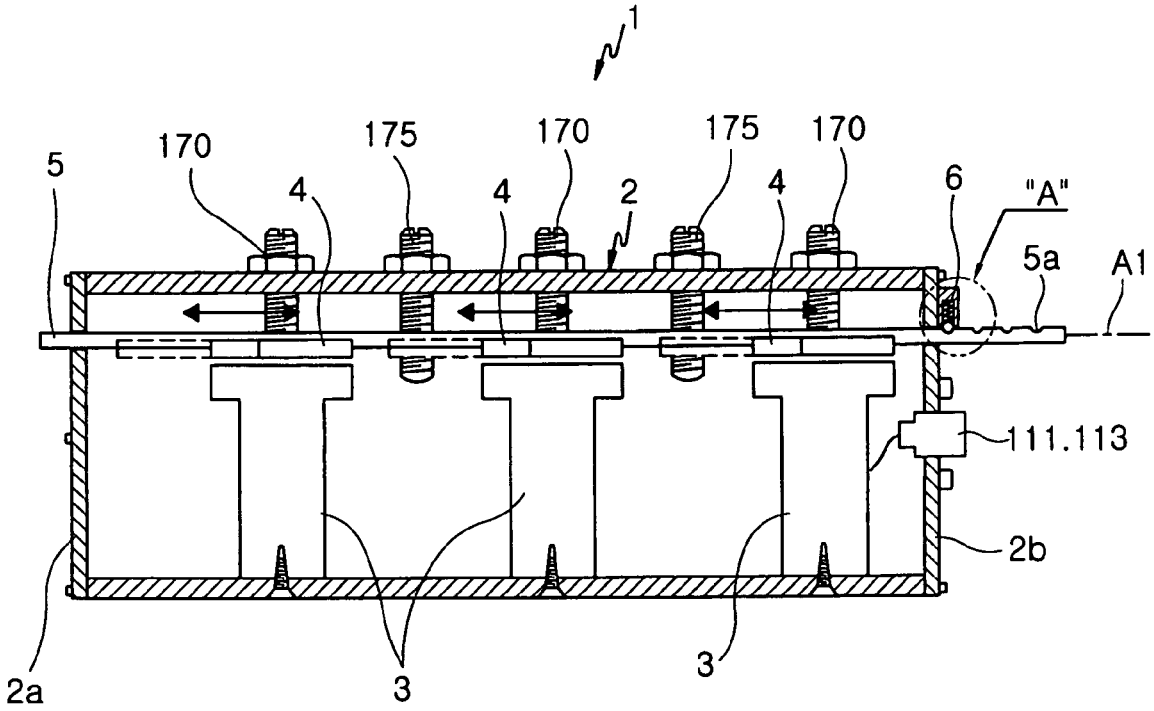
FIG. 8 is a sectional view taken along line A–A' of FIG. 7.
Figure 9:
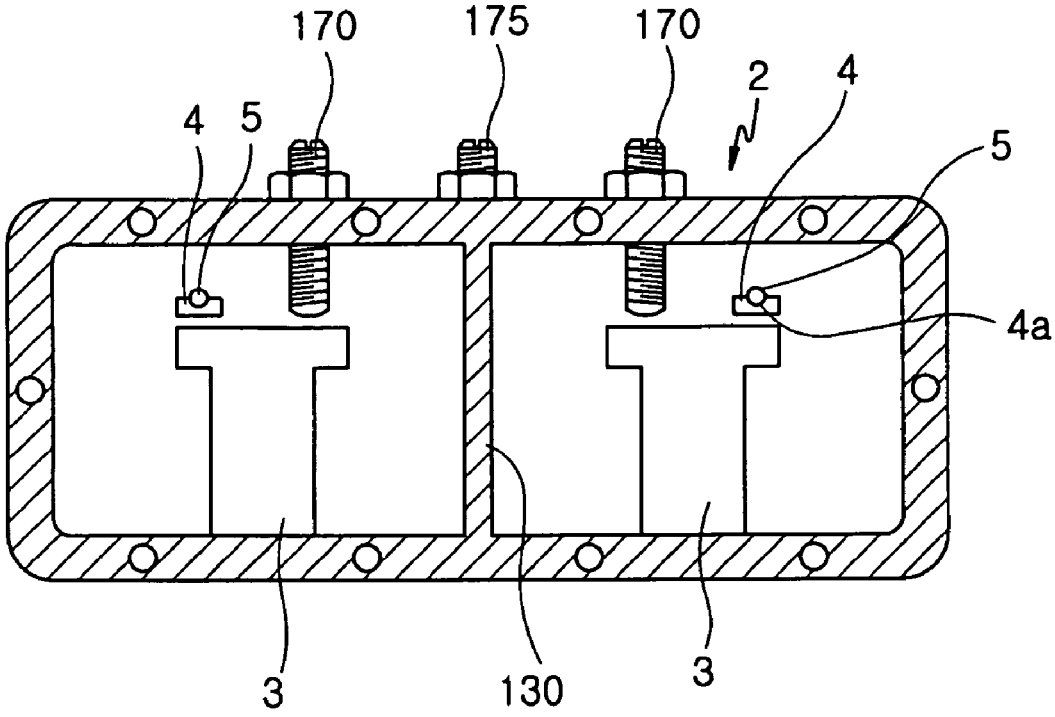
FIG. 9 is a sectional view taken along line B–B' of FIG. 7.

As shown in FIGS. 7 to 9, a variable frequency band filter 1 according to a first embodiment of the present invention includes a housing 2, resonator rods 3, tuning/coupling screws 170 and 175, input and output connectors 111 and 113, tuning rods 4, a tuning support 5, and a manual frequency variation unit 6. The housing 2 has a containing space extending along the longitudinal direction thereof.

Both ends of the housing 2 are configured as open ends and are provided with support means, which are also configured as the front and rear covers 2*a* and 2*b* of the housing 2 that are secured to the housing 2 by screws 179 as shown. The front and rear covers 2*a* and 2*b* have fastening holes 7 formed thereon at predetermined locations for supporting the tuning support 5 in such a manner that it can slide. The resonator rods 3 extend upward from the bottom surface of the containing space and are arranged in two rows within the housing 2 along the longitudinal direction thereof.

The containing space may be subdivided into a number of containing spaces by diaphragms 130, according to requirements on products, and the number of the resonator rods 3 is also determined by the requirements. The tuning rods 4, the area of which corresponds to that of the resonator rods 3, are positioned on top of the respective resonator rods 3. The tuning rods 4 have the shape of a rectangle and have a retaining groove 4*a* of a semi-circular shape formed in the center of the upper portion of the tuning rods 4 along the longitudinal direction thereof.

The tuning support 5 extends through the fastening holes 7 and has coupling grooves 5*a* of a semi-circular shape formed on an end thereof with a predetermined spacing. The tuning support 5 is adapted to be manually slid by an external force. The tuning support 5 is inserted and retained in the retaining grooves 4*a* of a semi-circular shape of the tuning rods 4, which maintain a predetermined spacing between themselves.

Figure 10:
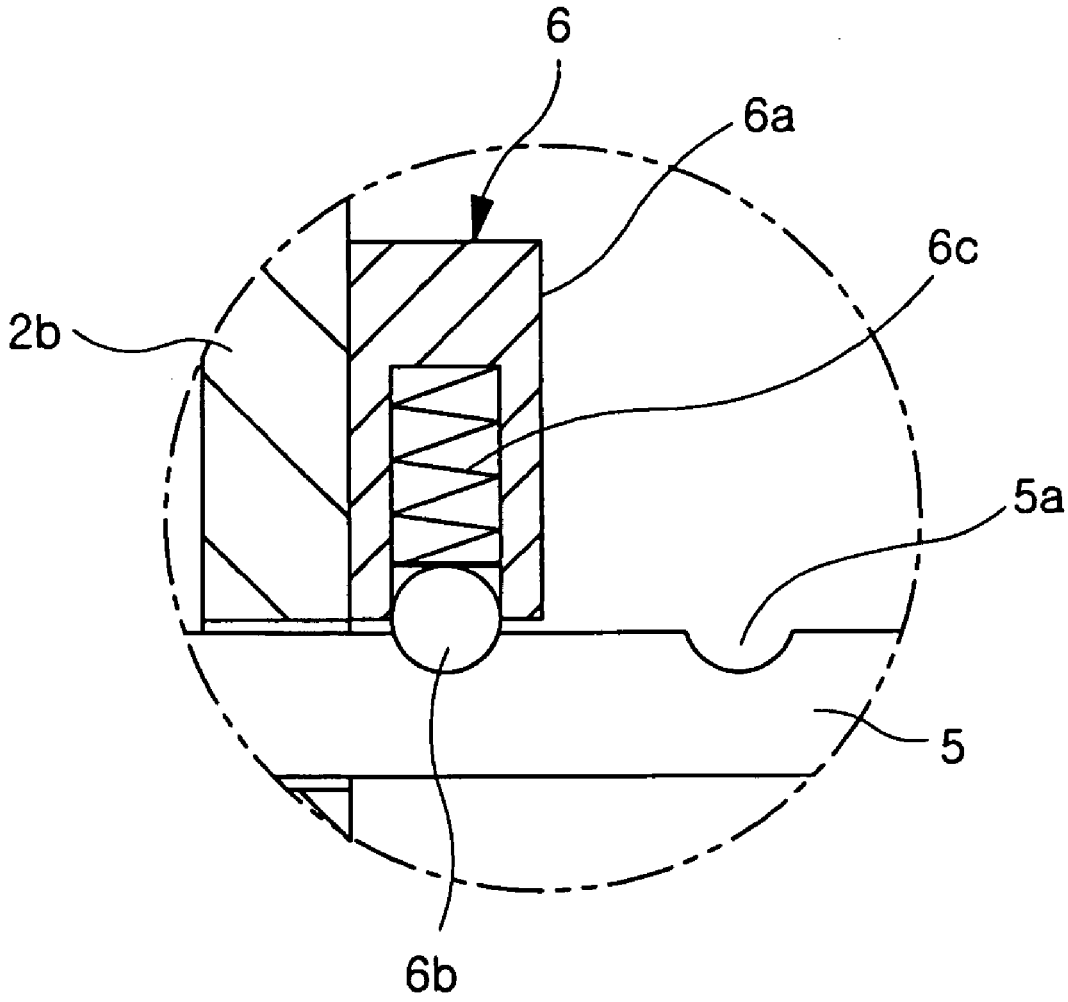
FIG.10 is a detailed view, taken from FIG.7, showing a manual frequency variation unit.

As shown in FIG. 10, the manual frequency variation unit 6 is positioned on a lateral surface of the housing 2, so that the position of the tuning rods 4 can be varied in a stepwise manner by sliding the tuning support 5, according to the frequency band. The manual frequency variation unit 6 includes an auxiliary housing 6*a*, a movable ball 6*b*, and a coil spring 6*c*.

The movable ball 6*b* is positioned within a working space formed in the auxiliary housing 6*a* and is adapted to move vertically in the working space, as the tuning support 5 is slid, so that it can be engaged with or released from the coupling grooves 5*a*, which are formed on the tuning support 5 according to the respective frequency bands. The coil spring 6*c* is positioned on top of the movable ball 6*b* to provide an elastic force so that the movable ball 6*b* can move vertically. The tuning support 5 is manually moved, in this state, so that the movable ball 6*b* of the manual frequency variation unit 6 is positioned to be received in the first coupling groove 5*a*, which is formed on an end of the tuning support 5.

If the frequency band is to be varied, the tuning support 5 is moved to position and receive the movable ball in the second coupling groove 5*a*. As the tuning support 5 is moved in this way, the area of the respective tuning rods 4 positioned on the respective resonator rods 3 is varied and the frequency band of the variable frequency band filter is adjusted.

When the tuning rods 4 are moved, the rate of change of the area of the tuning rods 4 positioned on the resonator rods 3 is constant. Accordingly, it is possible to simultaneously vary the resonance frequency of the variable frequency band filter 1, which depends on the respective resonator rods 3, with a single movement of the tuning support 5.

The operation of a variable frequency band filter according to a second embodiment of the present invention, which is adapted to automatically perform the operation of varying the frequency band of the first embodiment, will now be described with reference to FIGS. 11 to 13.

Figure 11:
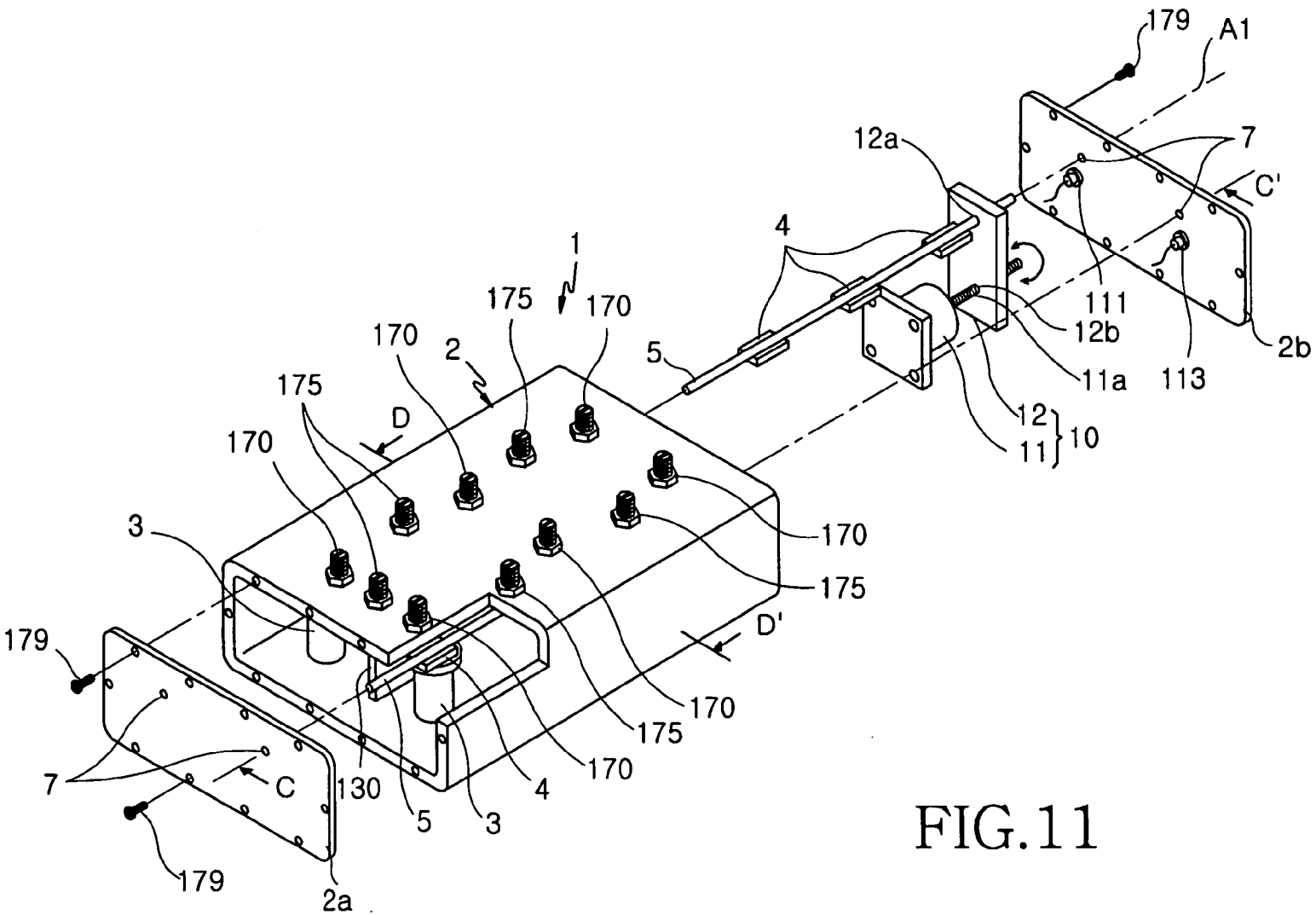
FIG. 11 is an exploded perspective view showing the construction of a variable frequency band filter according to a second preferred embodiment of the present invention.
Figure 12:
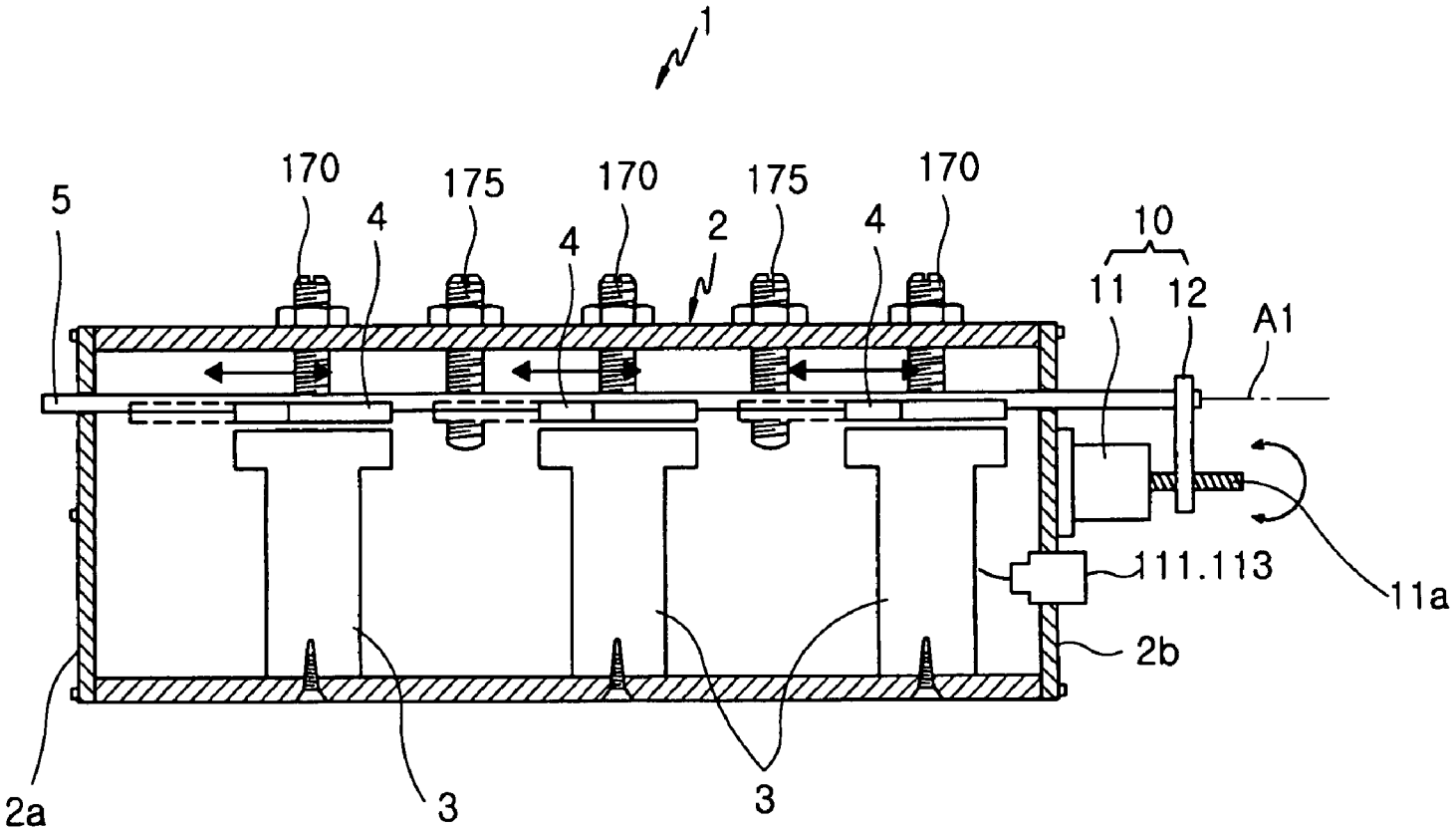
FIG. 12 is a sectional view taken along line C–C' of FIG. 11.
Figure 13:
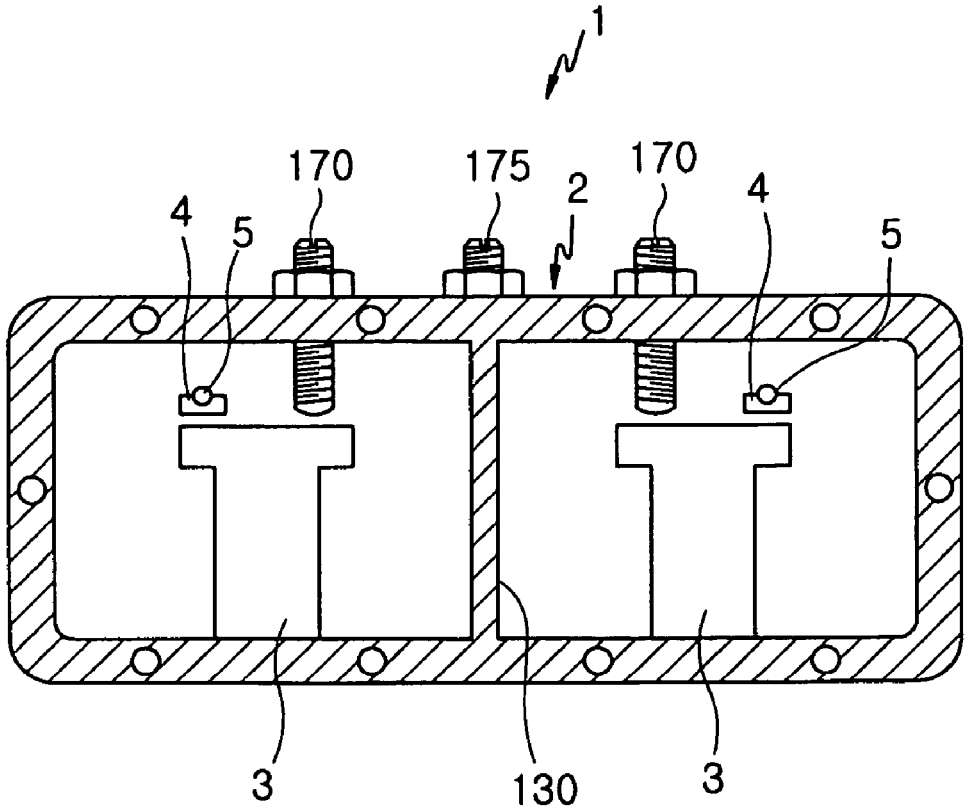
FIG. 13 is a sectional view taken along line D–D' of FIG. 11.

As shown in FIGS. 11 to 13, a variable frequency band filter according to a second embodiment of the present invention includes a housing 2, resonator rods 3, tuning/coupling screws 170 and 175, input and output connectors 111 and 113, tuning rods 4, a tuning support 5, and an automatic frequency variation unit 10.

In the following description of the second embodiment of the present invention, the same components as in the first embodiment are given the same reference numerals and repeated descriptions thereof will be omitted.

The automatic frequency variation unit 10 is positioned on a lateral surface of the housing 2 so that the position of the tuning rods 4 can be varied by sliding the tuning support 5. The automatic frequency variation unit 10 includes a driving motor 11 and a movable plate 12. The movable plate 12 has a first coupling hole 12*a* formed at a predetermined location on a side thereof to be fixedly coupled to an end of the tuning support 5. The movable plate 12 has a second coupling hole 12*b* formed at a predetermined location on the other side thereof to be screw-fastened to a gear unit 11 a of the driving motor 11.

As the gear unit l a is rotated by a driving force from the driving motor 11, the movable plate 12 is slid by the second coupling hole 12*b*, and so are the tuning rods 4. Since the gear unit 11*a* of the driving motor 11 is engaged with the movable plate 12, the actuation of the driving motor 11, which can be controlled by a switch, processor or any other suitable control mechanism, causes the movable plate 12 to slide. As the movable plate 12 is moved, the tuning support 5 is slid accordingly, because an end of the tuning support 5 is fixedly coupled in the first coupling hole 12*a* of the movable plate 12.

The movement of the tuning support 5 changes the area of the tuning rods 4 positioned on top of the resonator rods 3 and the spacing between them. The frequency band of the variable frequency band filter is then varied.

The operation of a variable frequency band filter according to a third embodiment of the present invention will now be described with reference to FIGS. 14 to 17.

Figure 14:
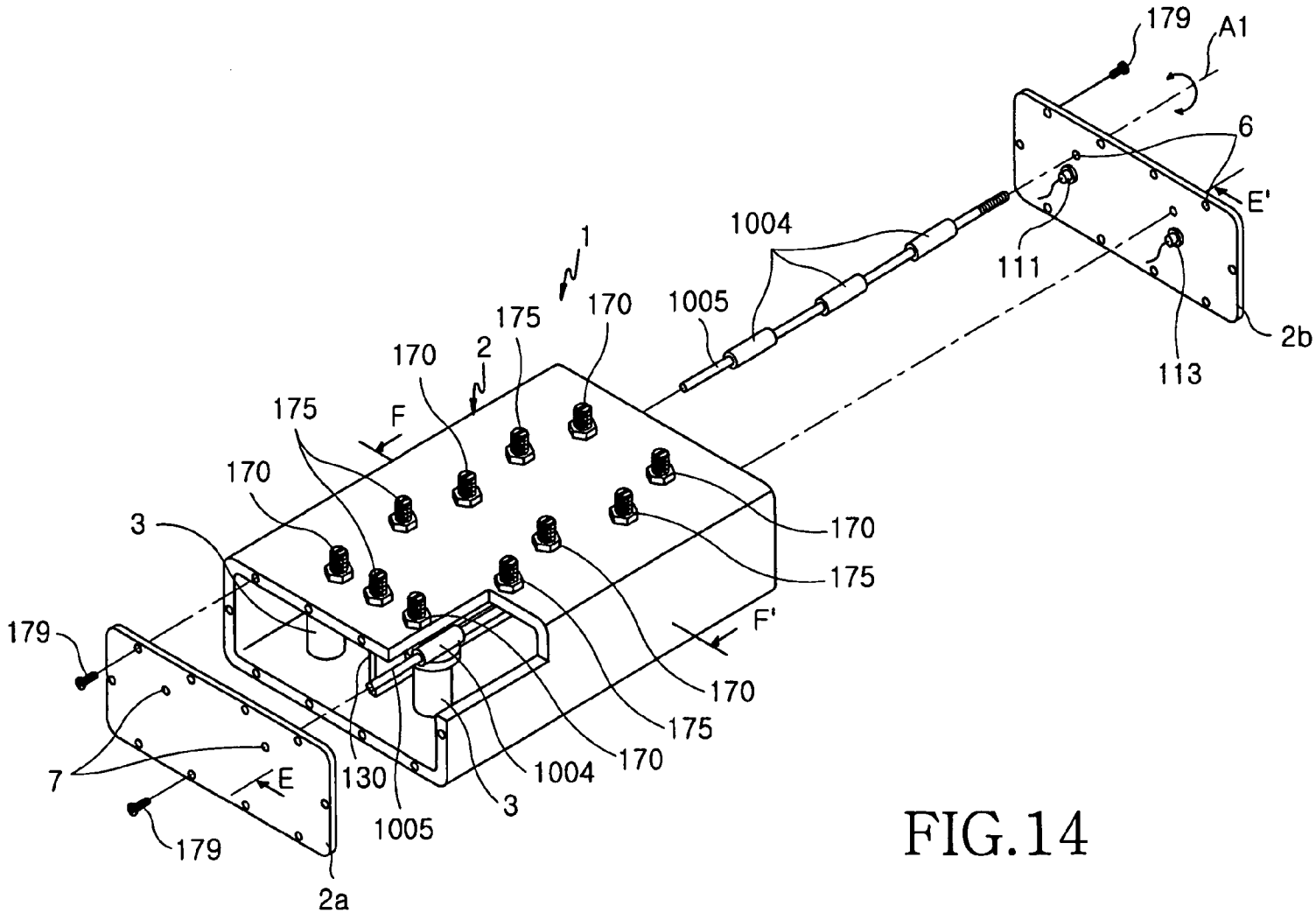
FIG. 14 is an exploded perspective view showing the construction of a variable frequency band filter according to a third preferred embodiment of the present invention.
Figure 15:
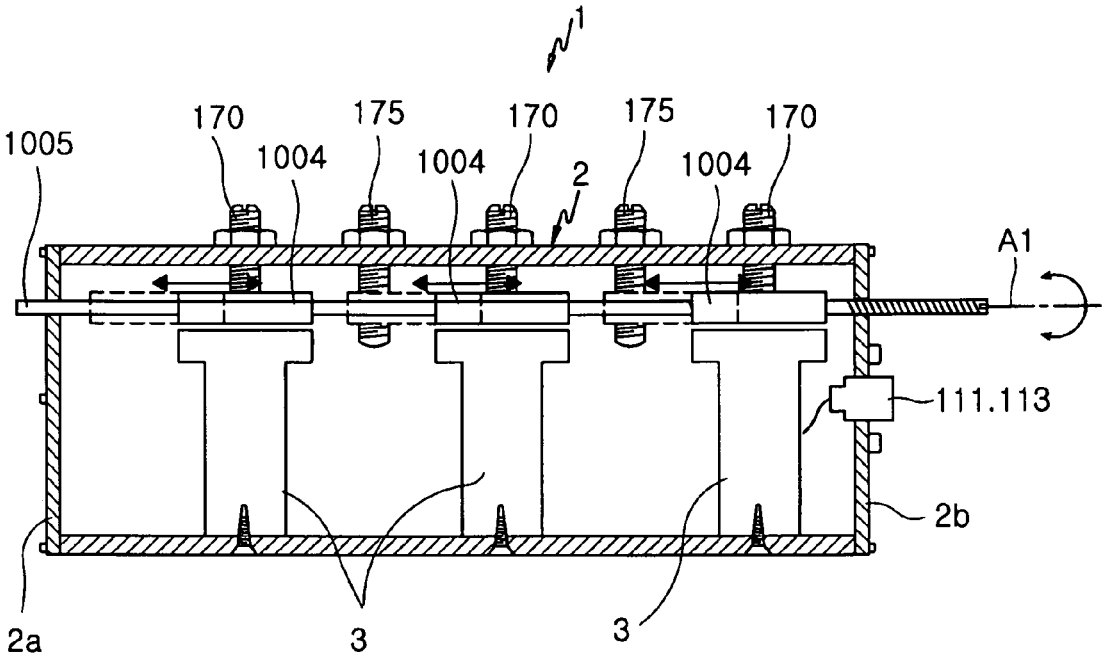
FIG. 15 is a sectional view taken along line E–E' of FIG. 14.
Figure 16:
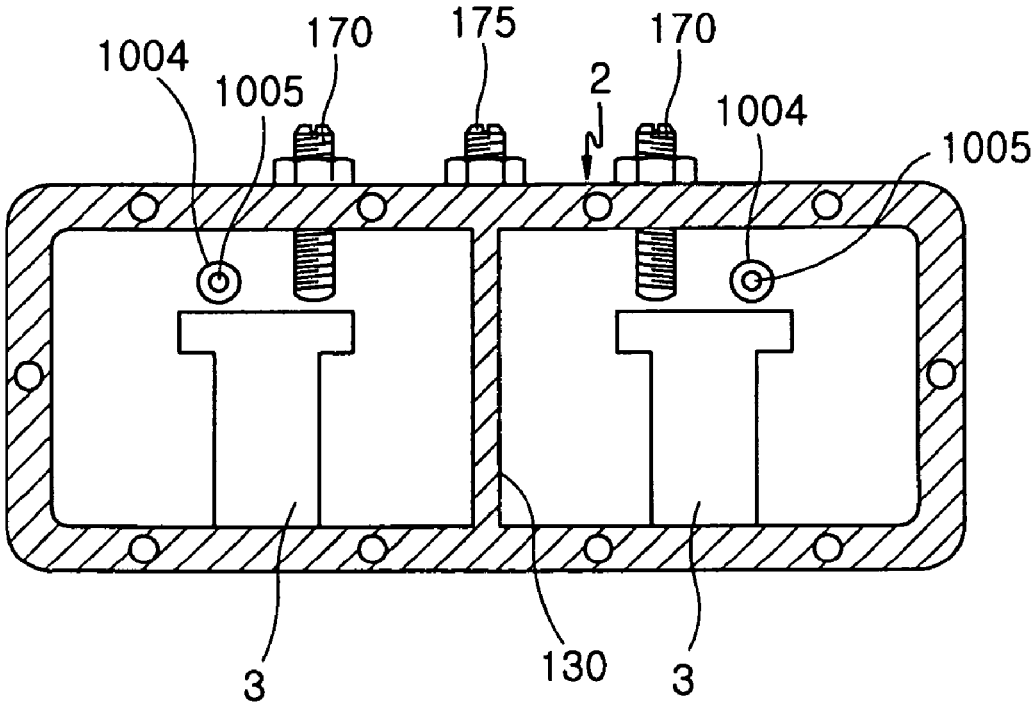
FIG. 16 is a sectional view taken along line F–F' of FIG.14.

As shown in FIGS. 14 to 16, a variable frequency band filter 1 according to a third embodiment of the present invention includes a housing 2, resonator rods 3, tuning/coupling screws 170 and 175, input and output connectors 111 and 113, tuning rods 1004, and a tuning support 1005. The housing 2 has a containing space extending along the longitudinal direction thereof. Both ends of the housing 2 are configured as open ends and are provided with support means, which are also configured as the front and rear covers 2*a* and 2*b* of the housing 2 and secured to the housing 2 by screws 179 as shown.

The front and rear covers 2*a* and 2*b* have fastening holes 7 formed thereon at predetermined locations for supporting the tuning support 1005 in such a manner that it can be rotated and moved. The resonator rods 3 extend upward from the bottom surface of the containing space and are arranged in two rows within the housing 2 along the longitudinal direction thereof. The containing space may be subdivided into a number of containing spaces by diaphragms 130, according to requirements on products, and the number of the resonator rods 3 is also determined by the requirements. The tuning rods 1004, the area of which corresponds to that of the resonator rods 3, are positioned on top of the respective resonator rods 3. The tuning rods 1004 have the shape of a hollow cylinder.

The tuning support 1005 extends through the fastening holes 7 and is adapted to be manually rotated and moved by an external force. The tuning support 1005 is inserted and retained in the hollow section of the tuning rods 1004 while maintaining a predetermined spacing between the tuning support 1005 and the tuning rods 1004. The tuning support 1005 is screw-fastened in the fastening hole 7 of one of the covers and is adapted to be rotated about a rotation axis A1 of the tuning rods 1004.

If the resonance frequency band of the filter is to be varied, an end of the tuning support 1005 is rotated by an external force. The tuning rods 1004, which are positioned on top of the resonator rods 3, are then moved while being rotated in one direction. The capacitance or inductance value can be tuned and adjusted according to the respective resonance frequencies in a simple manner. If the tuning rods 1004 are to be moved to their original positions, the tuning support 1005 is rotated in the other direction.

Figure 17:
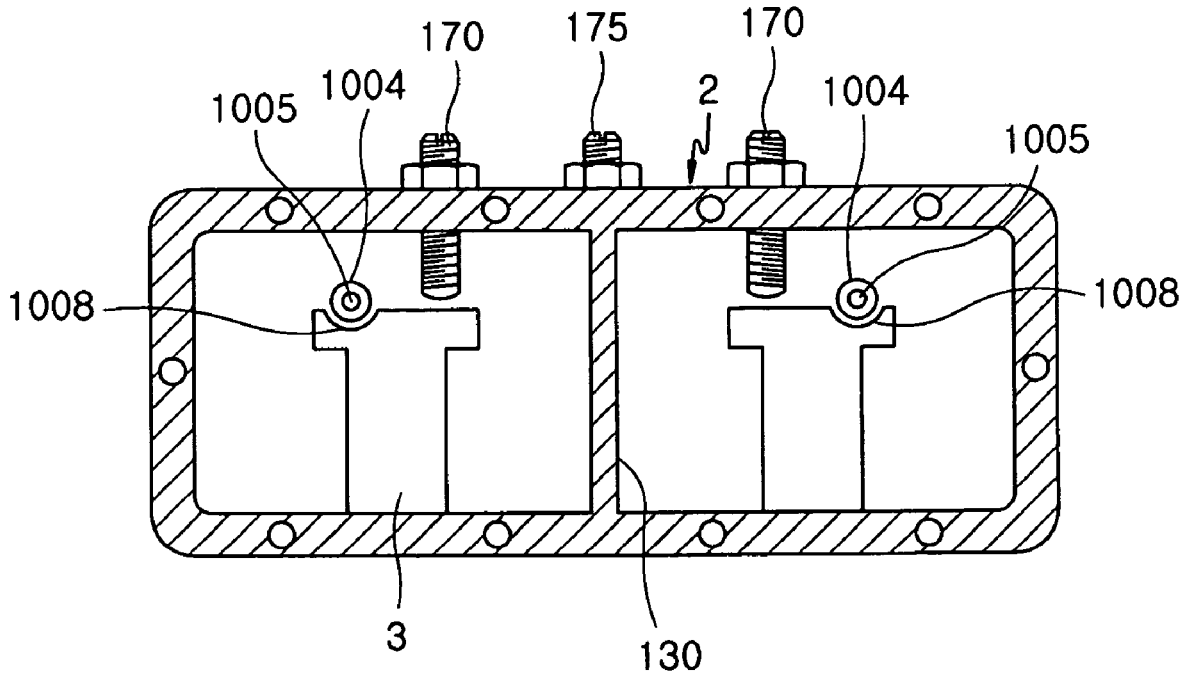
FIG. 17 is a sectional view showing an alternative embodiment of the resonator rod of the variable frequency band filter according to the third preferred embodiment of the present invention.

Referring to FIG. 17, an alternative embodiment of the resonator rods 3 is shown. The resonator rods 3 have an insertion groove 1008 formed at a predetermined location on the upper surface thereof for inserting the tuning rods 1004 therein. This increases the area of the tuning rods 1004 facing the resonator rods 3 and makes it easy to tune the capacitance or inductance value according to the respective resonance frequencies.

The operation of a variable frequency band filter according to a fourth embodiment of the present invention, which is adapted to automatically perform the operation of varying the frequency band of the third embodiment, will now be described with reference to FIGS. 18 to 20.

Figure 18:
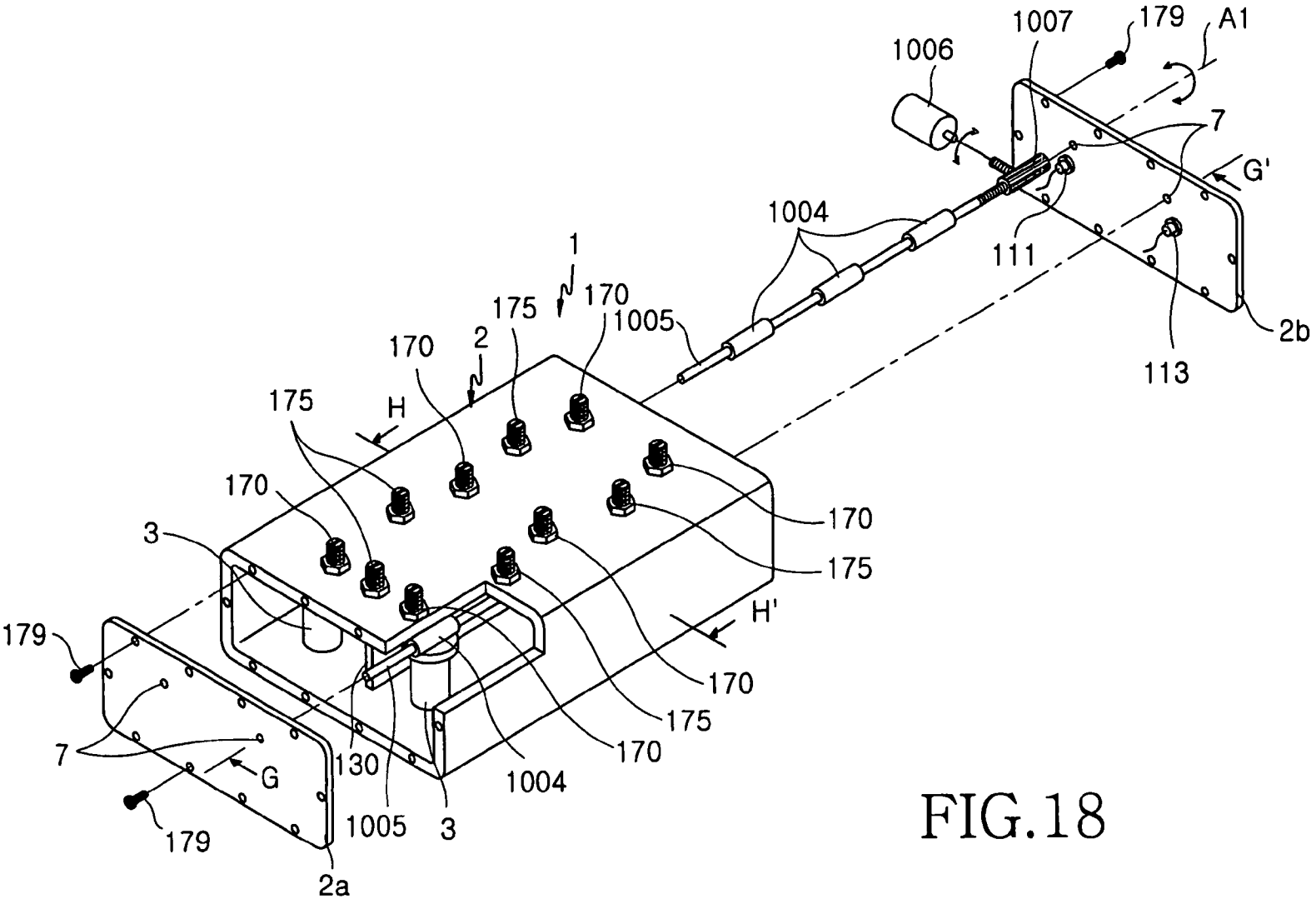
FIG. 18 is an exploded perspective view showing the construction of a variable frequency band filter according to a fourth preferred embodiment of the present invention.
Figure 19:
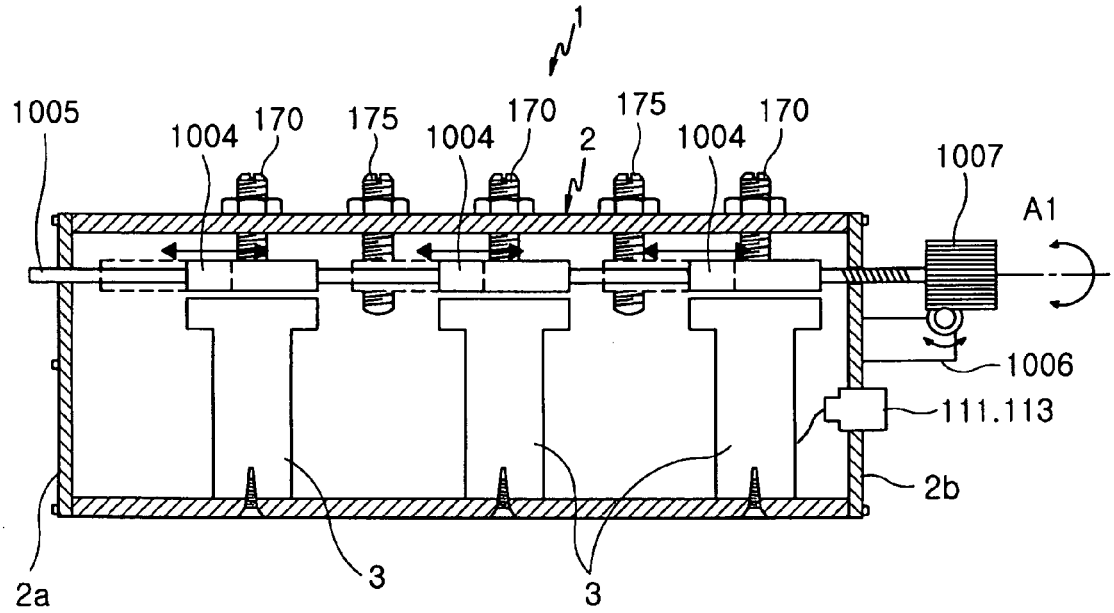
FIG. 19 is a sectional view taken along line G–G' of FIG. 18.
Figure 20:
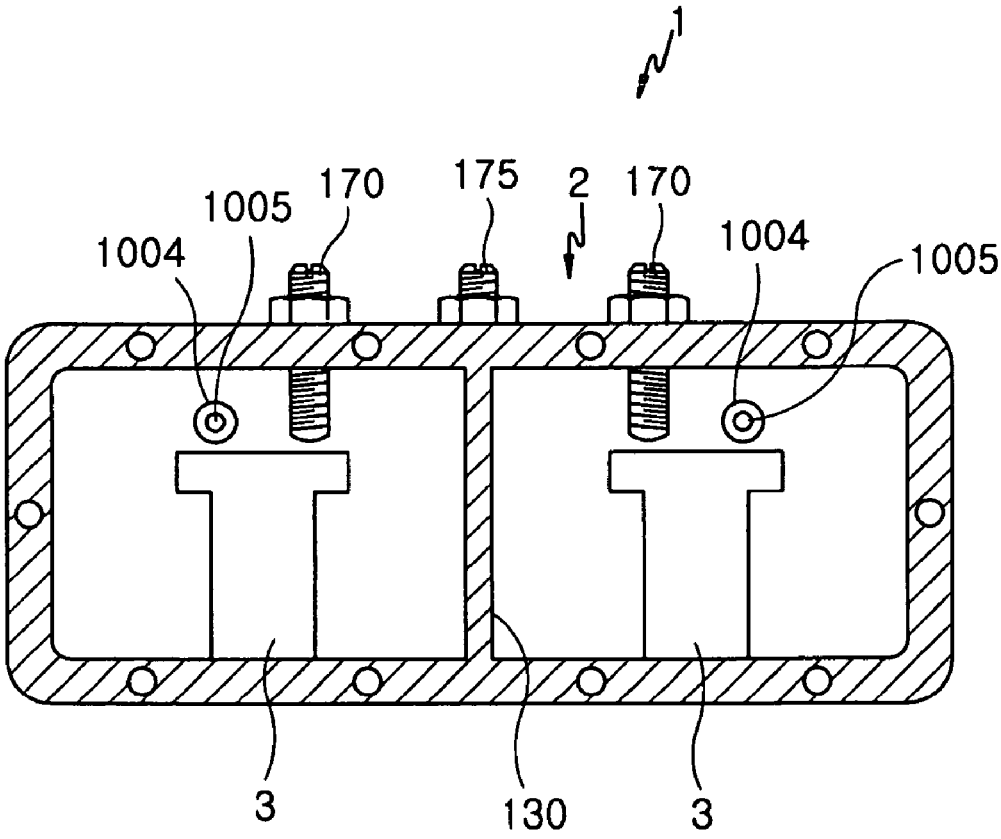
FIG. 20 is a sectional view taken along line H–H' of FIG. 18.

As shown in FIGS. 18 to 20, a variable frequency band filter 1 according to a fourth embodiment of the present invention includes a housing 2, resonator rods 3, tuning/coupling screws 170 and 175, input and output connectors 111 and 113, tuning rods 1004, and a tuning support 1005.

In the following description of the fourth embodiment of the present invention, the same components as in the third embodiment are given the same reference numerals and repeated descriptions thereof will be omitted.

The variable frequency band filter 1 has a motor driving unit including a motor 1006 and a gear unit 1007. The tuning support 1005 has an end engaged with the motor 1006, which is fixed on a side of a cover, via the gear unit 1007. The tuning support 1005 is screw-fastened in a fastening hole 7 of the cover and is adapted to be rotated and moved by the motor driving unit about a rotation axis A1 of the tuning rods 1004.

If the resonance frequency band of the filter is to be varied, the motor 1006 is rotated as controlled by a switch, processor or any other suitable control mechanism, and the rotation of the motor 1006 rotates a worm gear of the gear unit 1007, which is positioned about the rotation axis A1 of the motor 1006. At the same time, the tuning support 1005 and the tuning rods 1004 are moved linearly while being rotated by the gear unit 1007 as indicated. As a result, the area of the tuning rods 1004 positioned on the resonator rods 3 is varied and the frequency band of the variable frequency band filter is adjusted.

Figure 21:
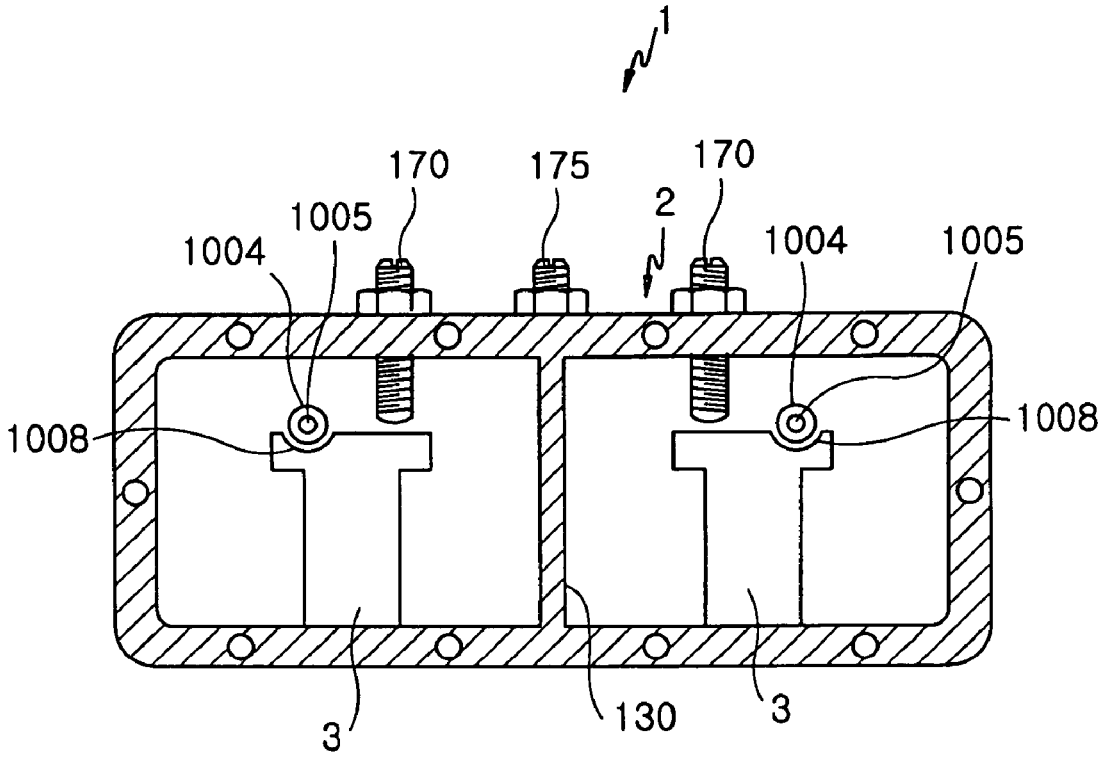
FIG. 21 is a sectional view showing an alternative embodiment of the resonator rod of the variable frequency band filter according to the fourth preferred embodiment of the present invention.

Referring to FIG. 21, an alternative embodiment of the resonator rods 3 is shown. The resonator rods 3 have an insertion groove 1008 formed at a predetermined location on the upper end thereof for inserting the tuning rods 1004 therein. This increases the area of the tuning rods 1004 facing the resonator rods 3 and makes it easy to tune the capacitance or inductance value according to the respective resonance frequencies.

The operation of a variable frequency band filter according to a fifth embodiment of the present invention will now be described in detail with reference to FIGS. 22 to 24.

Figure 22:
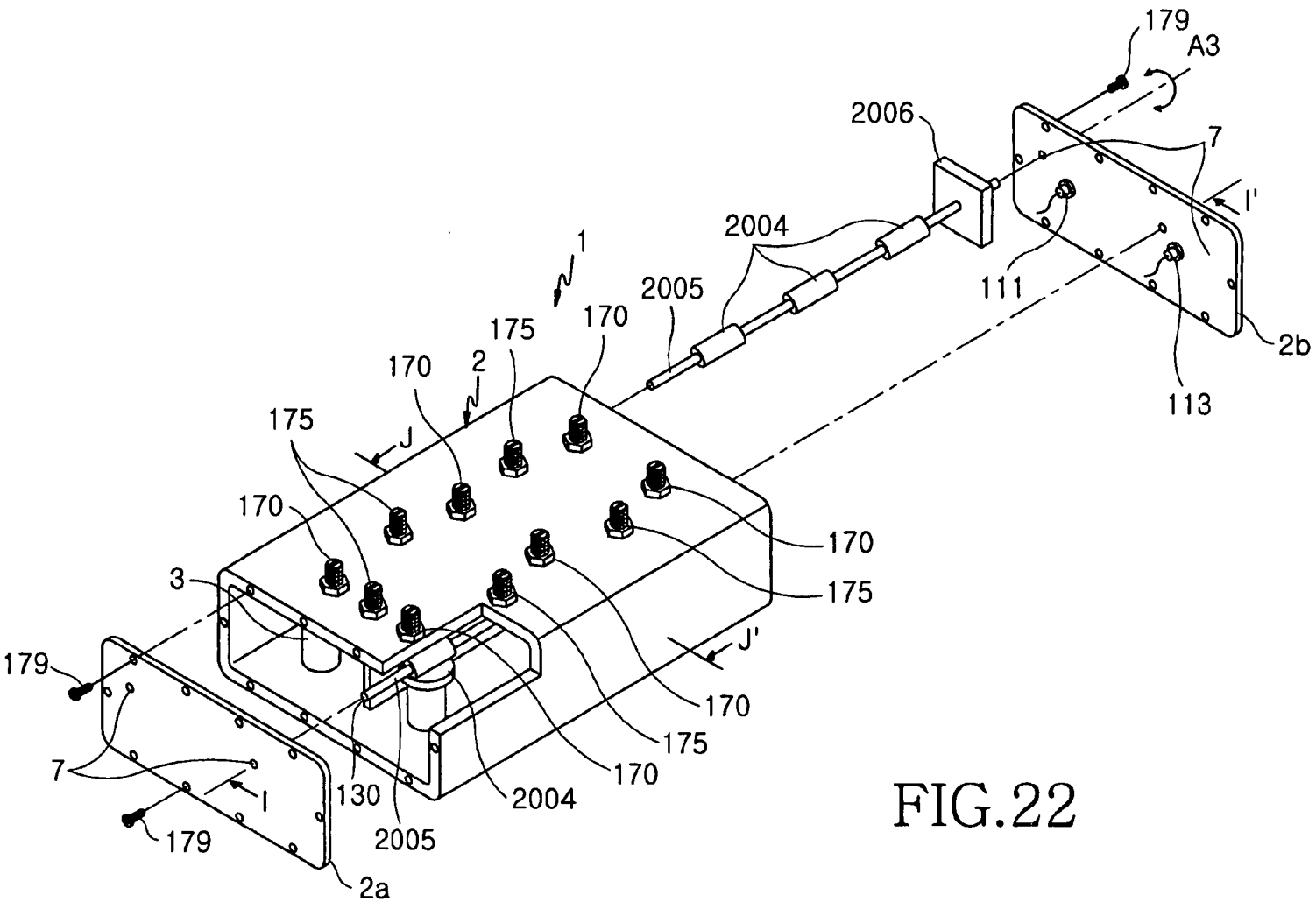
FIG. 22 is an exploded perspective view showing the construction of a variable frequency band filter according to a fifth preferred embodiment of the present invention.
Figure 23:
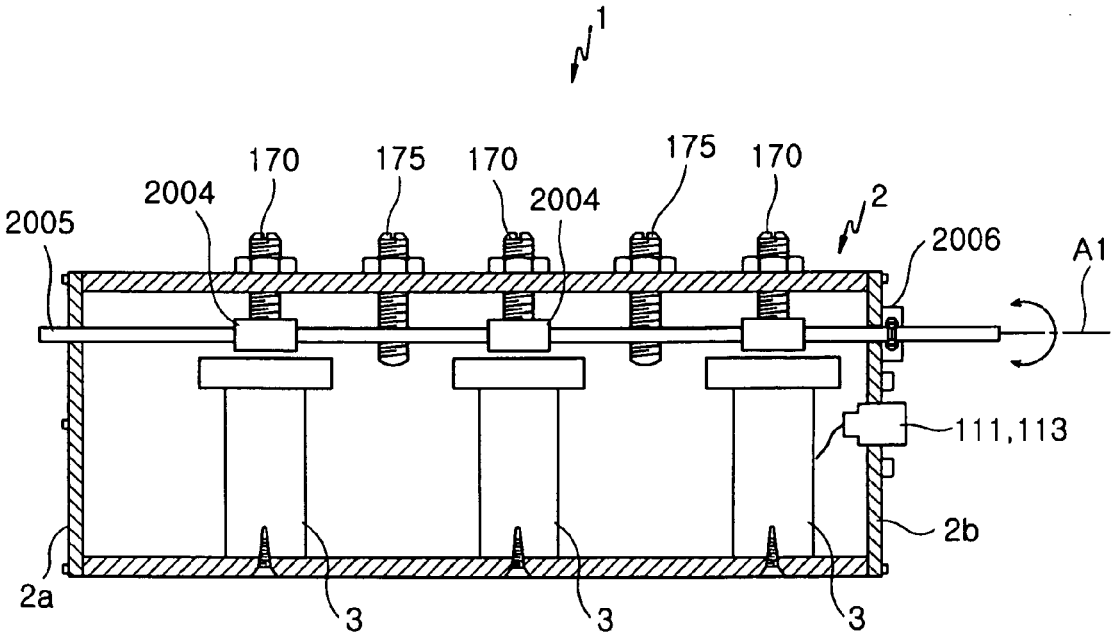
FIG. 23 is a sectional view taken along line I–I' of FIG. 22.
Figure 24:
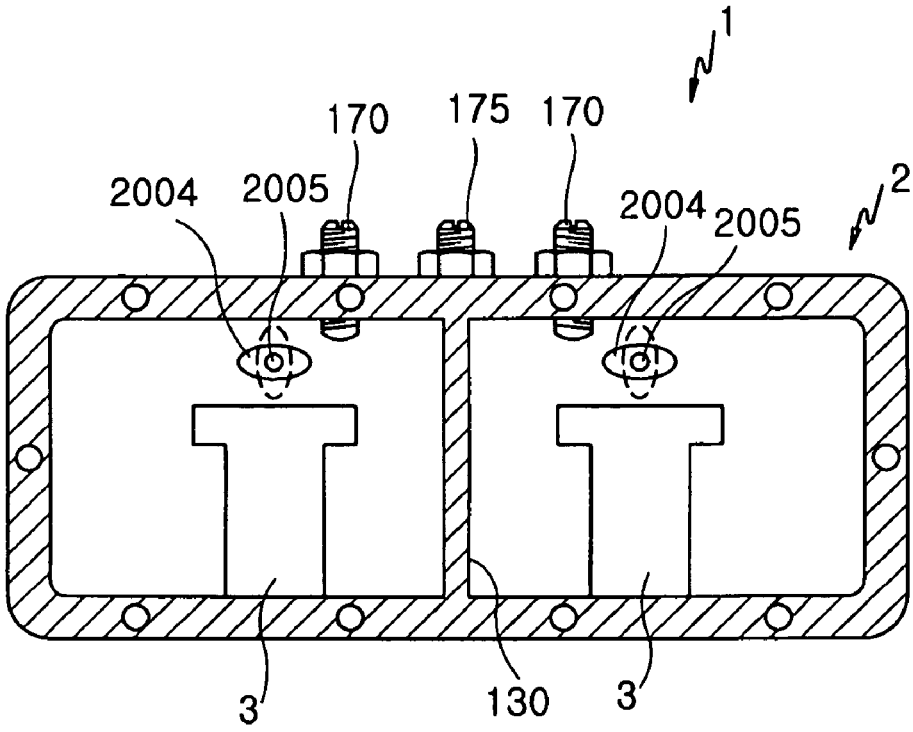
FIG. 24 is a sectional view taken along line J–J' of FIG. 22.

As shown in FIGS. 22 and 23, a variable frequency band filter 1 according to a fifth embodiment of the present invention includes a housing 2, resonator rods 3, tuning/coupling screws 170 and 175, input and output connectors 111 and 113, tuning rods 2004, and a tuning support 2005.

The housing 2 has a containing space extending along the longitudinal direction thereof. Both ends of the housing 2 are configured as open ends and are provided with support means, which are also configured as the front and rear covers 2*a* and 2*b* of the housing 2 that are secured to the housing 2 by screws 179. The front and rear covers 2*a* and 2*b* have fastening holes 7 formed at predetermined locations for supporting the tuning support 2005 in such a manner that it can be rotated.

The resonator rods 3 extend upward from the bottom surface of the containing space and are arranged in two rows within the housing 2 along the longitudinal direction thereof. The containing space may be subdivided into a number of containing spaces by diaphragms 130, according to requirements on products, and the number of the resonator rods 3 is also determined by the requirements. The tuning rods 2004 are positioned on top of the respective resonator rods 3. The tuning rods have the shape of a hollow elliptical post.

The tuning support 2005 extends through the fastening holes 7 and is adapted to be rotated by an external force in such a manner that it varies the rotation angle of the tuning rods 2004. The tuning support 2005 is inserted and retained in the hollow section of the tuning rods 2004. The tuning support 2005 is fastened in the fastening holes 7 and is adapted to be rotated by an external force about a rotation axis A1 of the tuning rods 2004. The tuning support 2005 can be rotated, but cannot be moved linearly. For stable support for the tuning support 2005, a retainer 2006 is provided in such a manner that a unit, such as the manual frequency variation unit 6 shown in FIG. 10, can be fixedly coupled to an end of the tuning support 2005.

If the tuning support 2005 is rotated a predetermined angle by an external force, the tuning rods 2004 are rotated. The area of the tuning rods 2004 positioned on top of the resonator rods 3 is then varied and the frequency band of the variable frequency band filter is adjusted.

The operation of a variable frequency band filter according to a sixth embodiment of the present invention, which is adapted to automatically perform the operation of varying the frequency band of the fifth embodiment, will now be described with reference to FIGS. 25 to 27.

Figure 25:
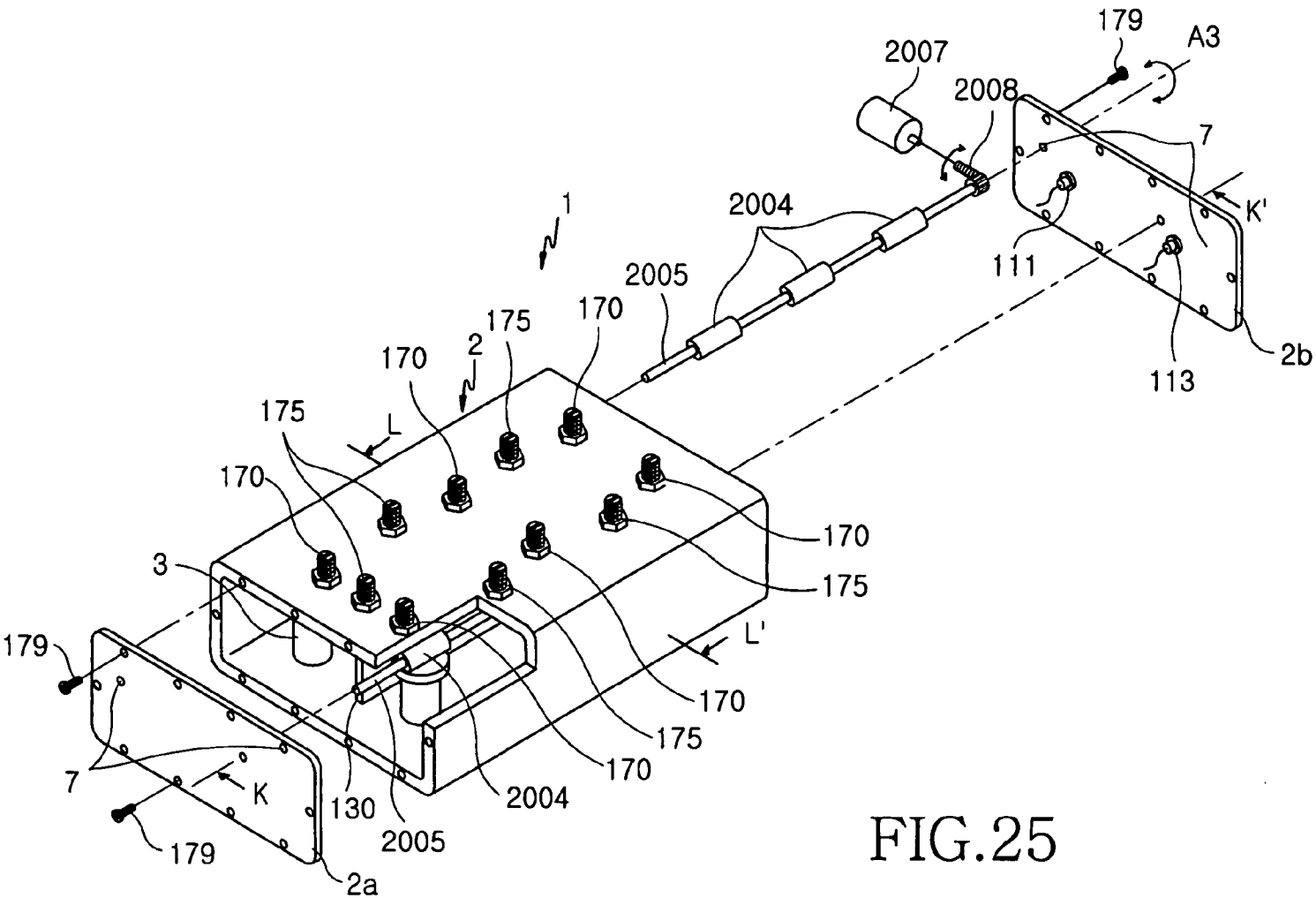
FIG. 25 is an exploded perspective view showing the construction of a variable frequency band filter according to a sixth preferred embodiment of the present invention.
Figure 26:
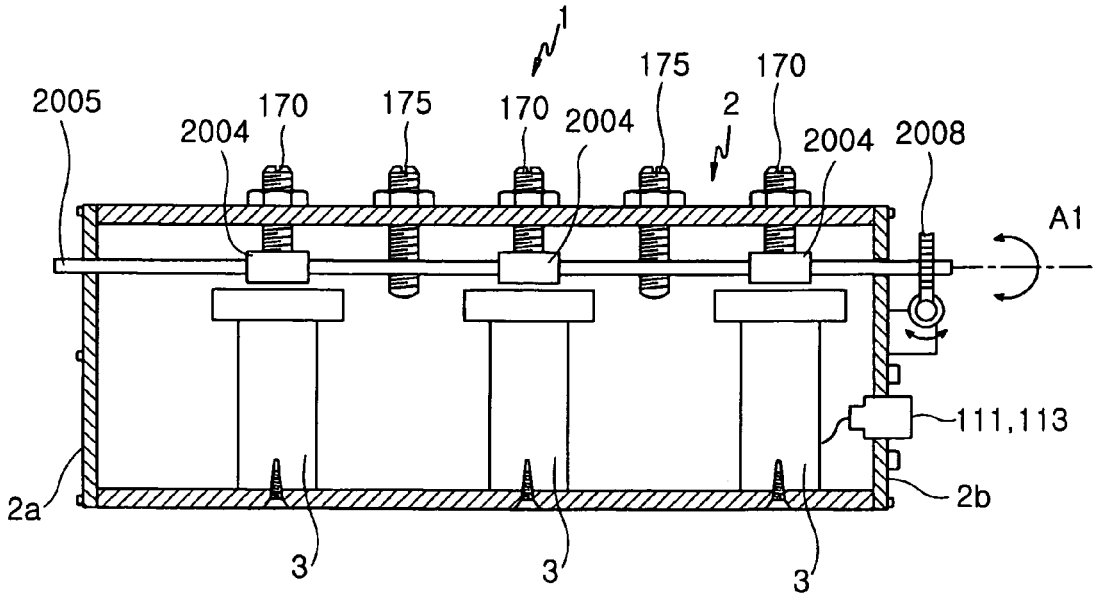
FIG. 26 is a sectional view taken along line K–K' of FIG. 25.
Figure 27:
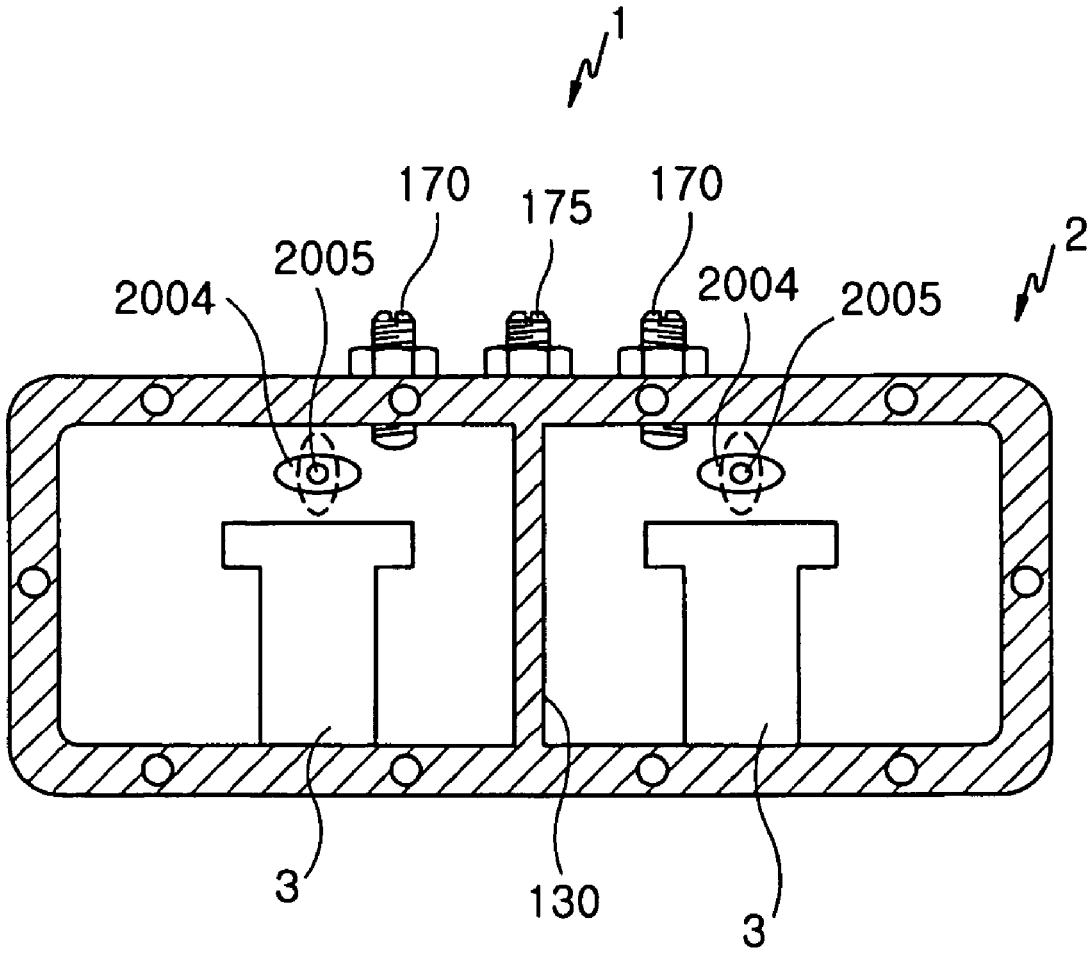
FIG. 27 is a sectional view taken along line L–L' of FIG.25.

As shown in FIGS. 25 and 26, a variable frequency band filter 1 according to a sixth embodiment of the present invention includes a housing 2, resonator rods 3, tuning/coupling screws 170 and 175, input and output connectors 111 and 113, tuning rods 2004, a tuning support 2005, and a motor driving unit.

In the following description of the sixth embodiment of the present invention, the same components as in the fifth embodiment are given the same reference numerals and repeated descriptions thereof will be omitted.

The motor driving unit includes a motor 2007 and a gear unit 2008. The tuning support 2005 has an end engaged with the motor, which is fixed on a side of a cover, via the gear unit. The tuning support 2005 is fastened in a fastening hole 7 of the cover and is adapted to be rotated by the motor driving unit about a rotation axis A1 of the tuning rods 2004. The tuning support 2005 can be rotated, but cannot be moved linearly.

If the resonance frequency band of the filter is to be varied, the motor 2007 is rotated as controlled by a switch, processor or any other suitable control mechanism, and rotates a worm gear of the gear unit 2008, which is positioned about the rotation axis A1 of the motor. At the same time, the tuning support 2005 and the tuning rods 2004 are rotated by the worm gear. As a result, the area of the tuning rods 2004 positioned on the resonator rods 3 and the spacing between them are varied, and the frequency band of the variable frequency band filter is adjusted.

The operation of a variable frequency band filter according to a seventh embodiment of the present invention will now be described in detail with reference to FIGS. 28 to 30.

Figure 28:
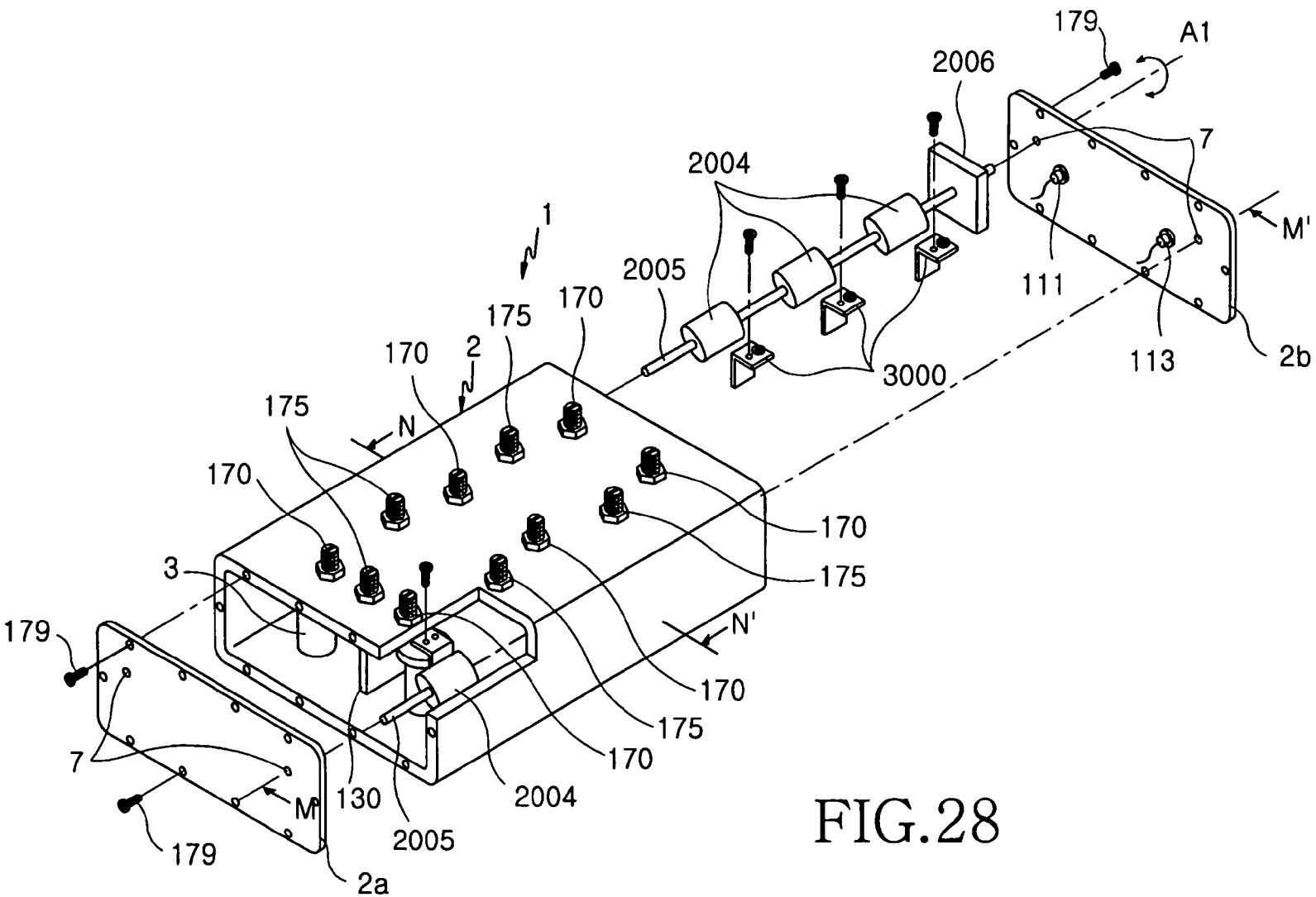
FIG. 28 is an exploded perspective view showing the construction of a variable frequency band filter according to a seventh preferred embodiment of the present invention.
Figure 29:
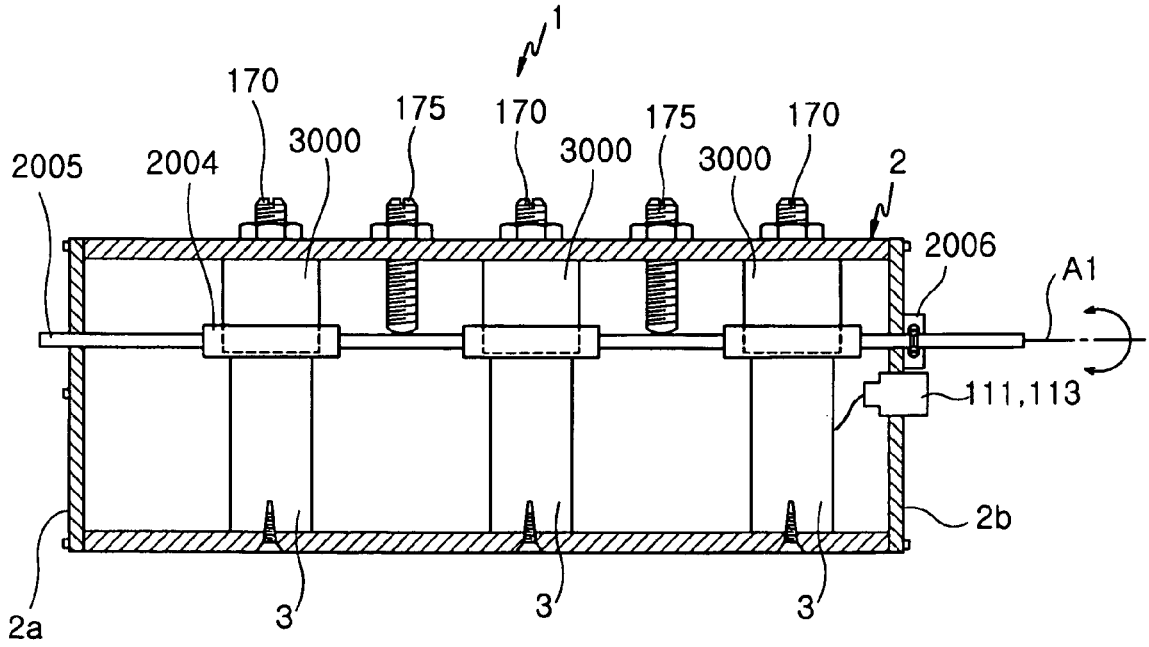
FIG. 29 is a sectional view taken along line M–M' of FIG. 28.

As shown in FIGS. 28 to 29, a variable frequency band filter 1 according to a seventh embodiment of the present invention includes a housing 2, resonator rods 3, tuning/coupling screws 170 and 175, input and output connectors 111 and 113, tuning rods 2004, a tuning support 2005, and spacing regulator plates 3000.

The housing 2 has a containing space extending along the longitudinal direction thereof. Both ends of the housing 2 are configured as open ends and are provided with support means, which are also configured as the front and rear covers 2*a* and 2*b* of the housing 2 and secured to the housing 2 by screws 179.

The front and rear covers 2*a* and 2*b* have fastening holes 7 formed at predetermined locations for supporting the tuning support 2005 in such a manner that it can be rotated. The resonator rods 3 extend upward from the bottom surface of the containing space and are arranged in two rows within the housing 2 along the longitudinal direction thereof.

The containing space may be subdivided into a number of containing spaces by diaphragms 130, according to requirements on products, and the number of the resonator rods 3 is also determined by the requirements. The tuning rods 2004 are positioned on a lateral surface of the respective resonator rods 3. The tuning rods 2004 have the shape of a hollow elliptical post. The tuning support 2005 extends through the fastening holes 7 and is adapted to be rotated by an external force.

The tuning support 2005 is fastened in the fastening holes 7 and is adapted to be rotated by an external force about a rotation axis A1 of the tuning rods 2004. The tuning support 2005 can be rotated, but cannot be moved linearly. For stable support for the tuning support 2005, a retainer 2006 is provided so that a unit, such as the manual frequency variation unit 6 shown in FIG. 10, can be fixedly coupled to an end of the tuning support 2005. The spacing regulator plates are of an "L"-shaped configuration.

Figure 30:
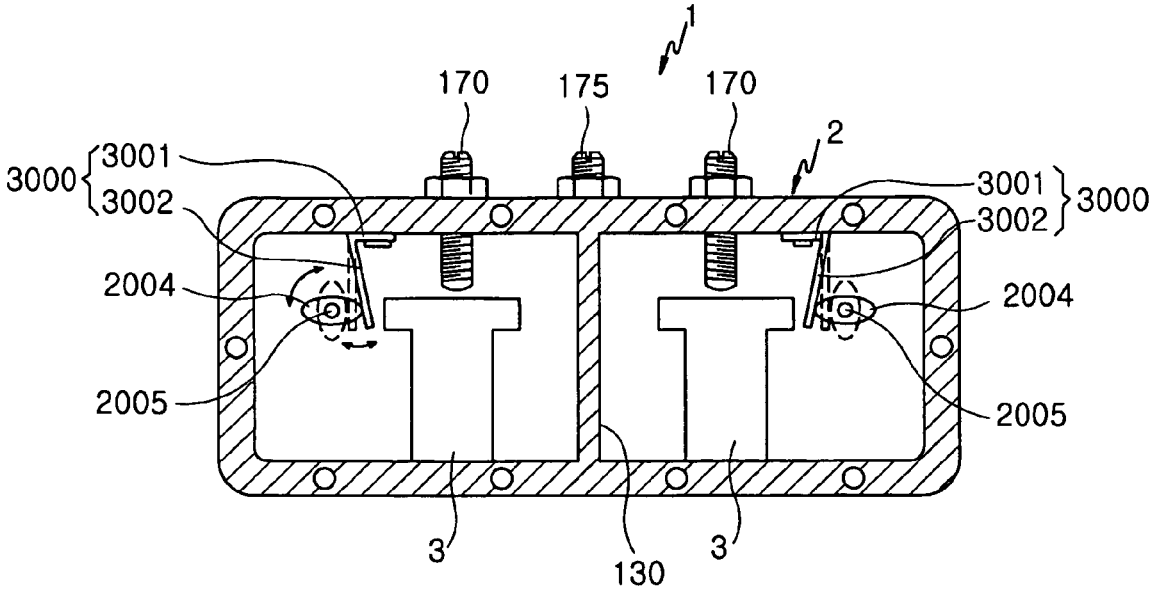
FIG. 30 is a sectional view taken along line N–N' of FIG.28.

As shown in FIGS. 28 and 30, the spacing regulator plates 3000 are positioned between the resonator rods 3 and the tuning rods 2004 to regulate the spacing between them as the tuning rods 2004 are rotated. If the frequency band of the filter is to be varied, an end of the tuning support 2005 is rotated a predetermined angle by an external force. As the tuning support 2005 is rotated, the tuning rods 2004, which are positioned on the lateral surface of the resonator rods 3, are rotated accordingly.

The spacing regulator plates 3000 have a fastening portion 3001 formed on the upper portion thereof to be screw-fastened to the inner wall surface of the housing 2. The spacing regulator plates 3000 have a plate spring 3002 formed on the lower portion thereof, which extends along the longitudinal direction of the resonator rods 3 and facilitates the rotation of the tuning rods 2004 upon contacting them. Hence, the rotation of the tuning rods 2004 having the shape of an elliptical post pushes the spacing regulator plates toward the resonator rods 3 as shown in FIG. 30. The spacing between the spacing regulator plates and the resonator rods 3 is thus varied, and so is the resonance frequency. The capacitance or inductance value can be tuned in a simple manner according to the respective resonance frequencies, by adjusting the spacing between the resonator rods 3 and the tuning rods 2004 as the tuning rods 2004 are rotated.

The operation of a variable frequency band filter according to an eighth embodiment of the present invention, which is adapted to automatically perform the operation of varying the frequency band of the seventh embodiment, will now be described with reference to FIGS. 31 to 33.

Figure 31:
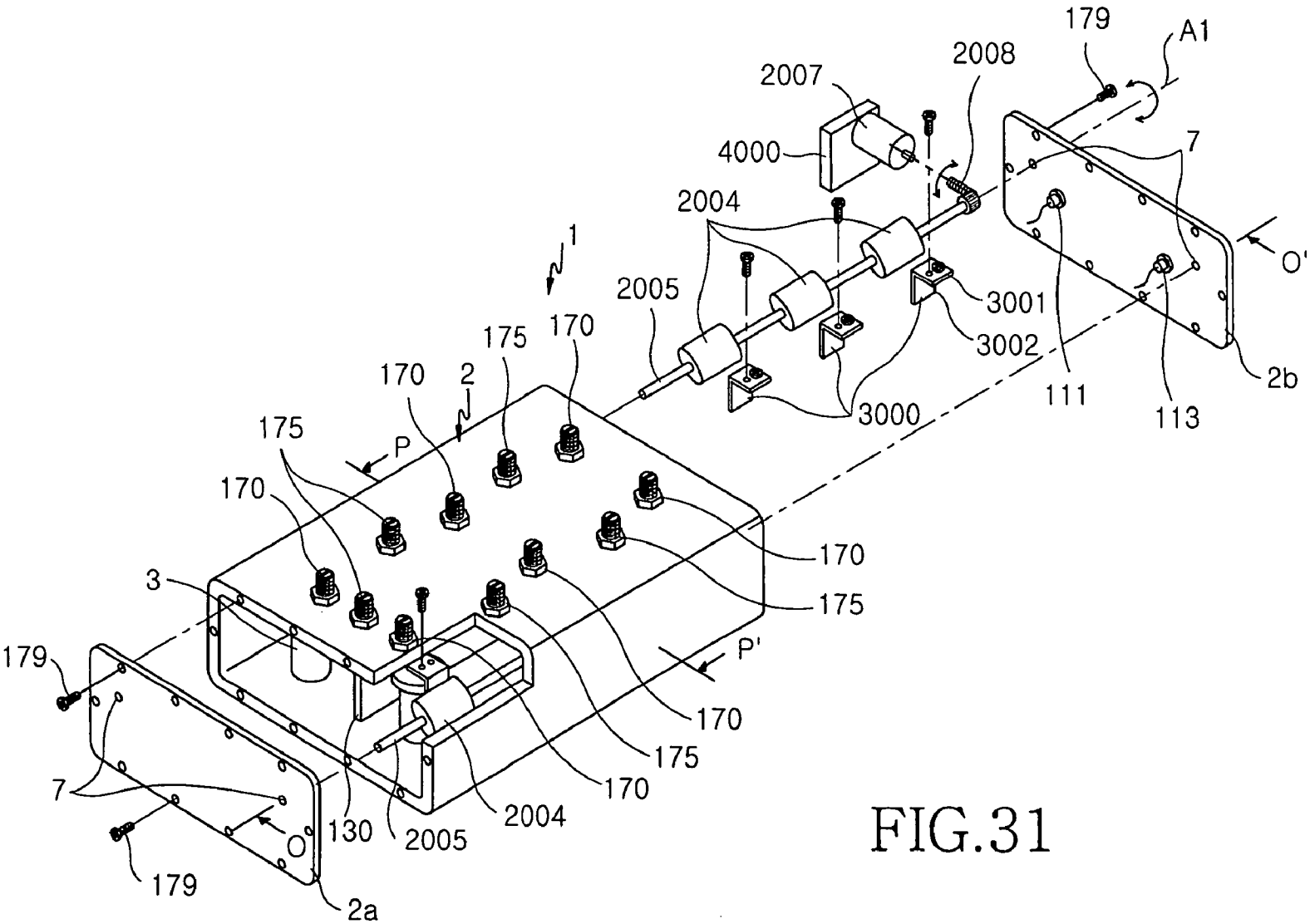
FIG. 31 is an exploded perspective view showing the construction of a variable frequency band filter according to an eighth preferred embodiment of the present invention.
Figure 32:
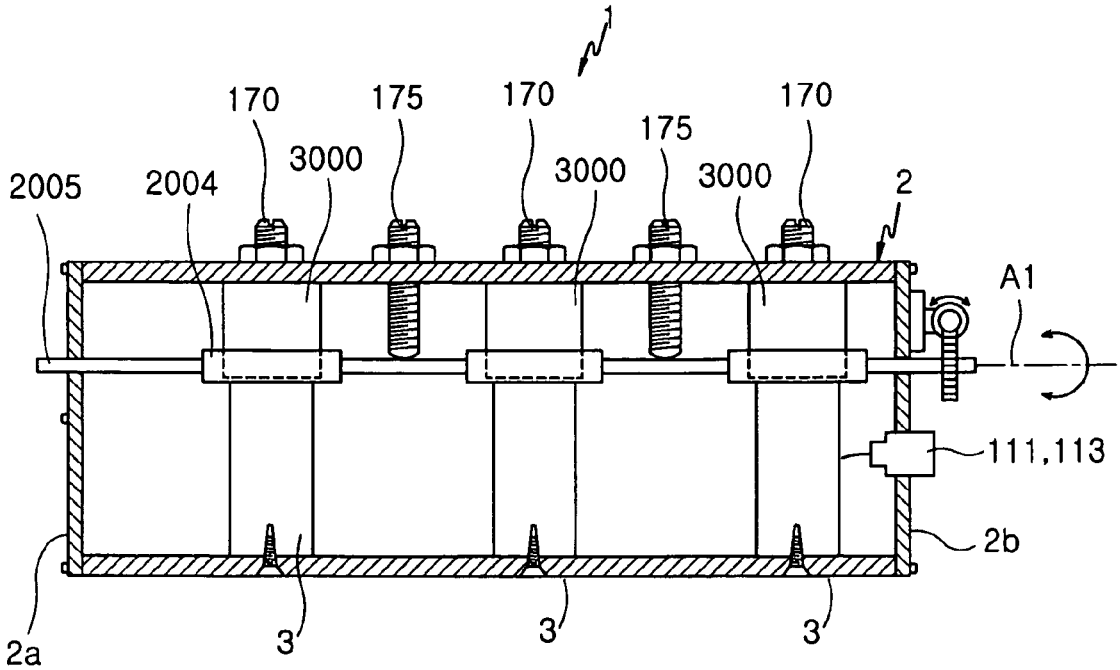
FIG. 32 is a sectional view taken along line O–O' of FIG.31.

As shown in FIGS. 31 and 32, a variable frequency band filter 1 according to an eighth embodiment of the present invention includes a housing 2, resonator rods 3, tuning/coupling screws 170 and 175, input and output connectors 111 and 113, tuning rods 2004, a tuning support 2005, spacing regulator plates 3000, and a motor driving unit.

In the following description of the eighth embodiment of the present invention, the same components as in the seventh embodiment are given the same reference numerals and repeated descriptions thereof will be omitted.

The motor driving unit includes a motor 2007 and a gear unit 2008. The tuning support 2005 has an end engaged with the motor 2007, which is fixed on a side of a cover, via the gear unit 2008. The tuning support 2005 is fastened in a fastening hole 7 of the cover and is adapted to be rotated by the motor driving unit about a rotation axis A1 of the tuning rods 2004. The tuning support 2005 can be rotated, but cannot be moved linearly. For fixed support for the motor 2007, a motor retainer 4000 is provided so that a unit, such as the manual frequency variation unit 6 shown in FIG. 10, can be fixedly coupled to an end of the tuning support 2005.

Figure 33:
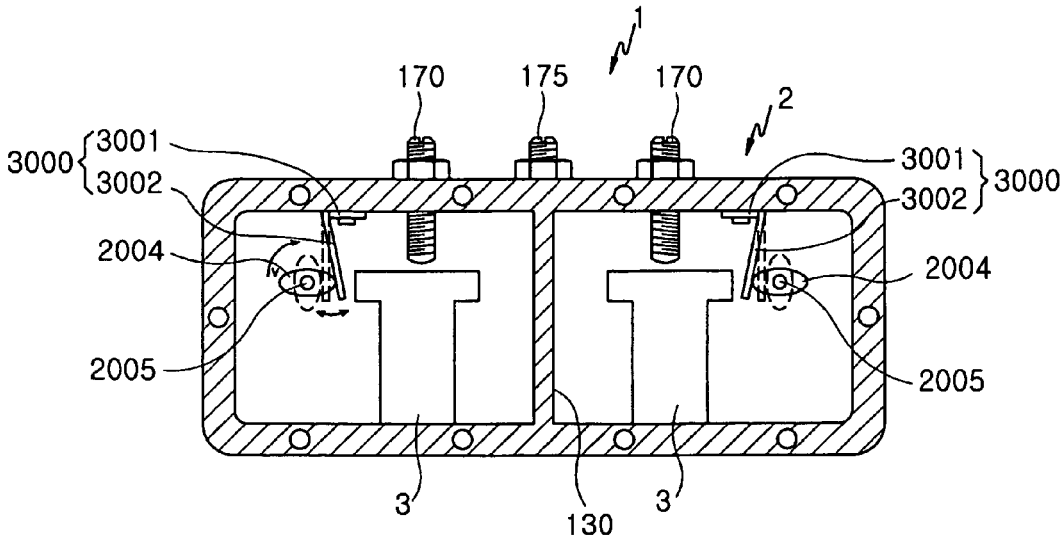
FIG. 33 is a sectional view taken along line P–P' of FIG. 31.

As shown in FIGS. 31 and 33, the spacing regulator plates 3000 are positioned between the resonator rods 3 and the tuning rods 2004 to regulate the spacing between them as the tuning rods 2004 are rotated. The spacing regulator plates 3000 are of an "L"-shaped configuration. If the resonance frequency band of the filter is to be varied, the motor 2007 is rotated as controlled by a switch, processor or any other suitable control mechanism, and rotates a worm gear of the gear unit 2008, which is positioned about the rotation axis A1 of the motor 2007. At the same time, the tuning support 2005 is rotated by the worm gear.

As the tuning support 2005 is rotated, the tuning rods 2004, which are positioned on the lateral surface of the resonator rods 3, are rotated accordingly. The spacing regulator plates 3000 have a fastening portion 3001 formed on the upper portion thereof to be screw-fastened to the inner wall surface of the housing 2. The spacing regulator plates 3000 have a plate spring 3002 formed on the lower portion thereof, which extends along the longitudinal direction of the resonator rods 3 and facilitates the rotation of the tuning rods 2004 upon contacting them. Hence, the rotation of the tuning rods 2004 having the shape of an elliptical post pushes the spacing regulator plates toward the resonator rods 3. The spacing between the spacing regulator plates and the resonator rods 3 is then varied, and so is the resonance frequency. Accordingly, the capacitance or inductance value can be tuned in a simple manner according to the respective resonance frequencies, by adjusting the spacing between the resonator rods 3 and the tuning rods 2004 as the tuning rods 2004 are rotated.

The operation of a variable frequency band filter according to a ninth embodiment of the present invention will now be described in detail with reference to FIGS. 34 and 35.

Figure 34:
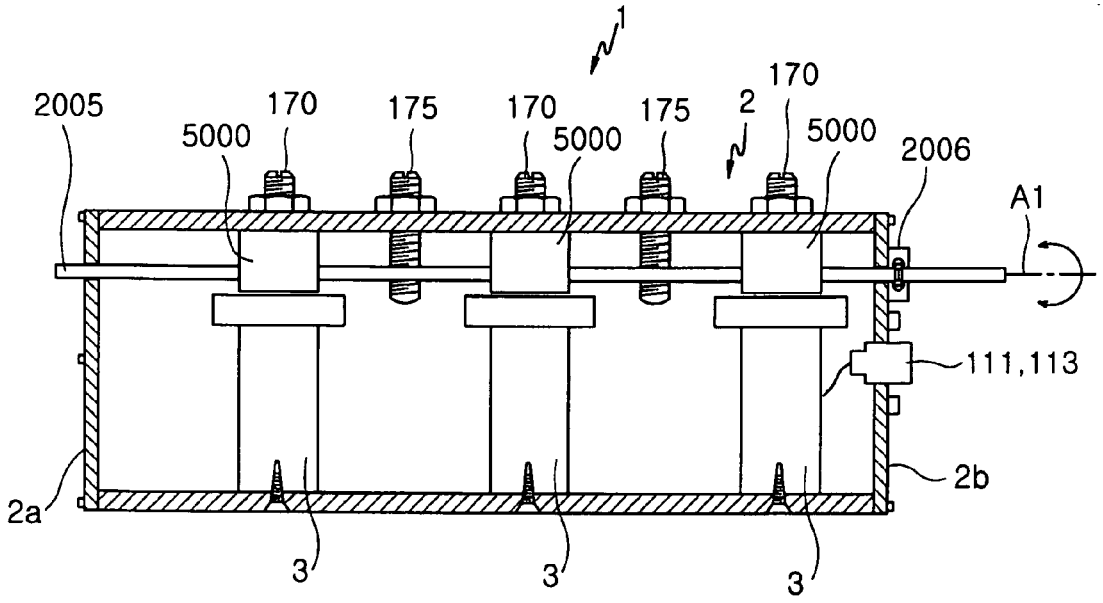
FIG. 34 is a lateral sectional view showing the construction of a variable frequency band filter according to a ninth preferred embodiment of the present invention.
Figure 35:
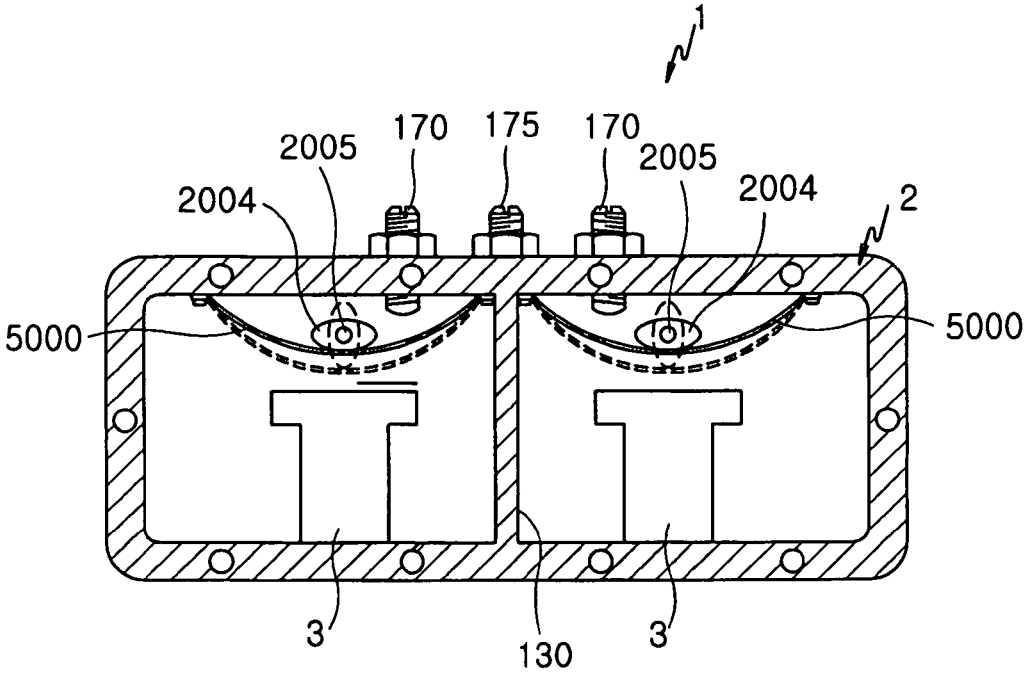
FIG. 35 is a lateral sectional view showing the variable frequency band filter according to the ninth preferred embodiment of the present invention during use.

As shown in FIGS. 34 and 35, a variable frequency band filter 1 according to a ninth embodiment of the present invention includes a housing 2, resonator rods 3, tuning/coupling screws 170 and 175, input and output connectors 111 and 113, tuning rods 2004, a tuning support 2005, and spacing regulator plates 5000. The housing 2 has a containing space extending along the longitudinal direction thereof. Both ends of the housing 2 are configured as open ends and are provided with support means, which are also configured as the front and rear covers 2*a* and 2*b* of the housing 2 and secured to housing 2 by screws 179.

The front and rear covers 2*a* and 2*b* have fastening holes 7 formed at predetermined locations for supporting the tuning support 2005 in such a manner that it can be rotated. The resonator rods 3 extend upward from the bottom surface of the containing space and are arranged in two rows within the housing 2 along the longitudinal direction thereof.

The containing space may be subdivided into a number of containing spaces by diaphragms 130, according to requirements on products, and the number of the resonator rods 3 is also determined by the requirements. The tuning rods 2004 are positioned on top of the resonator rods 3. The tuning rods 2004 have the shape of a hollow elliptical post.

The tuning support 2005 extends through the fastening holes 7 and is adapted to be rotated by an external force. The tuning support 2005 is fastened in the fastening holes 7 and is adapted to be rotated by an external force about a rotation axis A1 of the tuning rods 2004. The tuning support 2005 can be rotated, but cannot be moved linearly. For stable support for the tuning support 2005, a retainer 2006 is provided so that a unit, such as the manual frequency variation unit 6 shown in FIG. 10, can be fixedly coupled to an end of the tuning support 2005.

As shown in FIGS. 34 and 35, the spacing regulator plates 5000 are positioned between the resonator rods 3 and the tuning rods 2004 to regulate the spacing between as the tuning rods 2004 are rotated. The spacing regulator plates 5000 are of a curved configuration. If the frequency band of the filter is to be varied, an end of the tuning support 2005 is manually rotated by an external force, as shown in FIG. 35. The tuning support 2005, which is positioned on top of the resonator rods 3, is then rotated in one direction, and the tuning rods 2004, which have the shape of an elliptical post, simultaneously contact the spacing regulator plates 5000 to push them downward toward the resonator rods 3. The spacing regulator plates 5000 are then bent along the curve, and the spacing between the spacing regulator plates 5000 and the resonator rods 3 is decreased. Accordingly, the capacitance or inductance value can be tuned in a simple manner according to the respective resonance frequencies, by adjusting the spacing between the resonator rods 3 and the tuning rods 2004 as the tuning rods 2004 are rotated.

Figure 36:
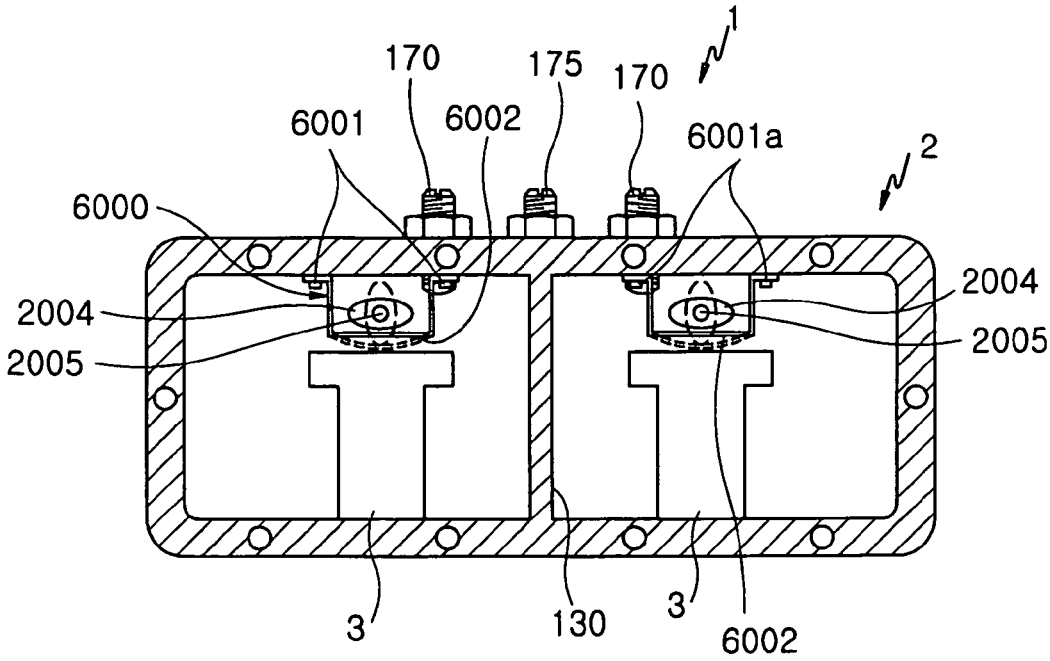
FIG. 36 is a lateral sectional view showing an alternative embodiment of a spacing regulator plate of the variable frequency filter according to the ninth preferred embodiment of the present invention.

Referring to FIG. 36, an alternative embodiment of the spacing regulator plates 6000 is shown. The spacing regulator plates 6000 have a pair of fastening portions 6001 formed on the upper portion thereof to be fixedly screw-fastened to the inner wall surface of the housing 2. A U-shaped containing space is defined between the pair of fastening portions 6001 for containing the tuning rods 2004 therein. Flexible plate members 6002 are positioned in the lower part of the containing space and deform elastically in the vertical direction as the tuning rods 2004 are rotated.

The operation of a variable frequency band filter according to a tenth embodiment of the present invention, which is adapted to automatically perform the operation of varying the frequency band of the ninth embodiment, will now be described with reference to FIGS. 37 and 38.

Figure 37:
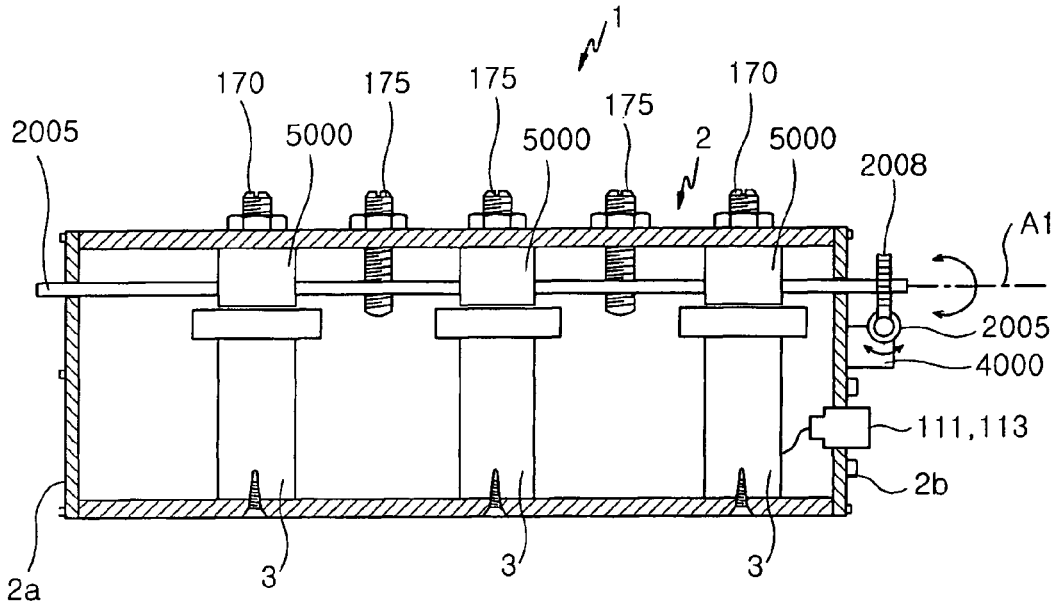
FIG. 37 is a lateral sectional view showing the construction of a variable frequency band filter according to a tenth preferred embodiment of the present invention.
Figure 38:
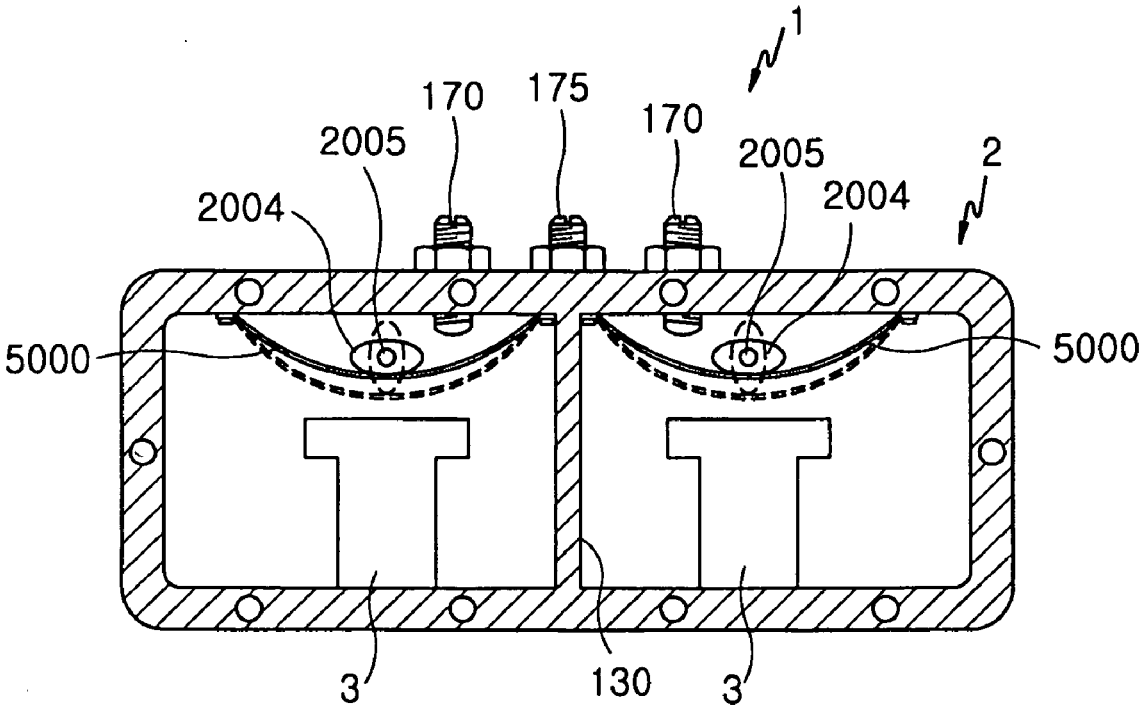
FIG. 38 is a lateral sectional view showing the variable frequency band filter according to the tenth preferred embodiment of the present invention during use.

As shown in FIGS. 37 and 38, a variable frequency band filter 1 according to a tenth embodiment of the present invention includes a housing 2, resonator rods 3, tuning/coupling screws 170 and 175, input and output connectors 111 and 113, tuning rods 2004, a tuning support 2005, spacing regulator plates 5000, and a motor driving unit.

In the following description of the tenth embodiment of the present invention, the same components as in the ninth embodiment are given the same reference numerals and repeated descriptions thereof will be omitted.

For fixed support for a motor 2007, a motor retainer 4000 is provided so that a unit, such as the manual frequency variation unit 6 shown in FIG. 10, can be fixedly coupled to an end of the tuning support 2005. The motor driving unit includes a motor 2007 and a gear unit 2008. The motor 2007 is engaged with the tuning support 2005 via the gear unit 2008.

As shown in FIGS. 37 and 38, the spacing regulator plates are positioned between the resonator rods 3 and the tuning rods 2004 to regulate the spacing between them as the tuning rods 2004 are rotated. The spacing regulator plates 5000 are of a curved configuration. If the resonance frequency band of the filter is to be varied, as shown in FIG. 38, the motor 2007 is actuated as controlled by a switch, processor or any other suitable control mechanism, and rotates a worm gear, which is positioned about the rotation axis A1 of the motor 2007. The tuning rods 2004 are then rotated, because the motor 2007 is engaged with the tuning support 2005 via the gear unit 2008.

The spacing regulator plates 500 are positioned between the resonator rods 3 and the tuning rods 2004 to automatically regulate the spacing between them as the tuning rods 2004 are rotated. Accordingly, as the motor 2007 is actuated, the tuning support 2005 is rotated in one direction. At the same time, the tuning rods 2004, which have the shape of an elliptical post, contact the spacing regulator plates 5000 and push them downward toward the resonator rods 3. The spacing regulator plates 5000 are then bent along the curve, and the spacing between the spacing regulator plates 5000 and the resonator rods 3 is decreased. Accordingly, the capacitance or inductance value can be tuned in a simple manner according to the respective resonance frequencies, by adjusting the spacing between the resonator rods 3 and the tuning rods 2004 as the tuning rods 2004 are rotated.

Figure 39:
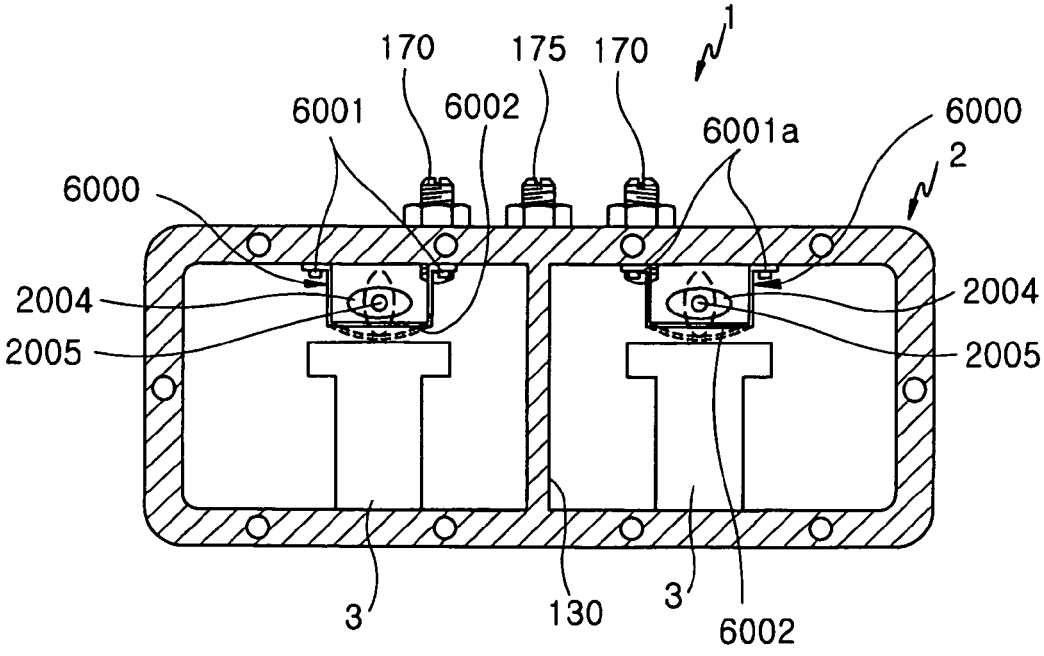
FIG. 39 is a lateral sectional view showing an alternative embodiment of a spacing regulator plate of the variable frequency filter according to the tenth preferred embodiment of the present invention.

Referring to FIG. 39, an alternative embodiment of the spacing regulator plates 6000 is shown. The spacing regulator plates 6000 have a pair of fastening portions 6001 formed on the upper portion thereof to fixedly screw-fastened to the inner wall surface of the housing 2.

A U-shaped containing space is defined between the pair of fastening portions 6001 for containing the tuning rods 2004 therein. Flexible plate members 6002 are positioned in the lower part of the containing space and deform elastically in the vertical direction as the tuning rods 2004 are rotated.

Figure 40:
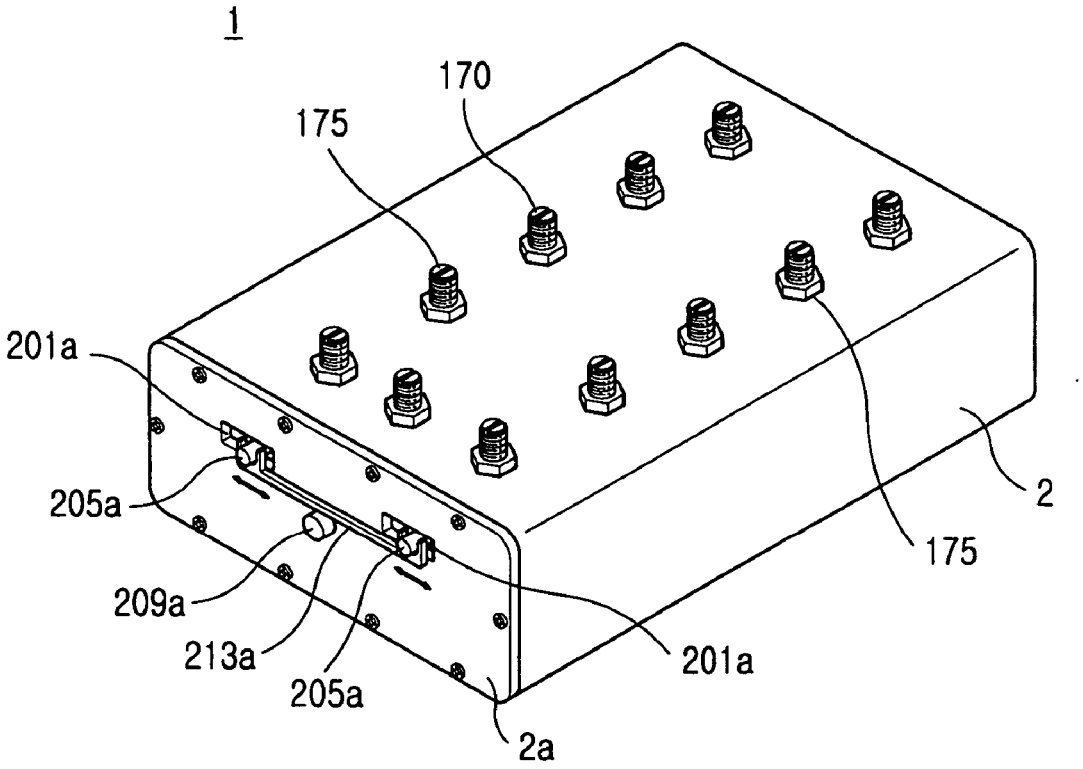
FIG. 40 is a perspective view showing a variable frequency band filter according to an eleventh preferred embodiment of the present invention.
Figure 41:
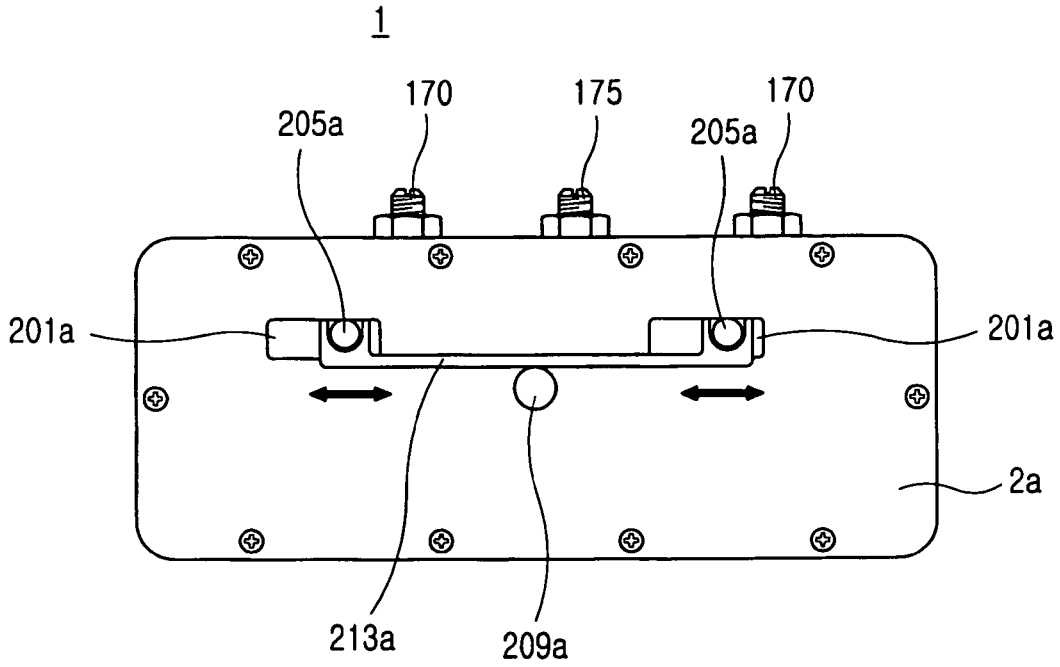
FIG. 41 is a front view of the variable frequency filter shown in FIG. 40.

Referring to FIG. 40, a perspective view of a variable frequency band filter 1 according to an eleventh preferred embodiment of the present invention is shown, and referring to FIG. 41, a front view of the variable frequency filter 1 of FIG. 40 is shown. In the following description of the eleventh embodiment of the present invention, the same components as in the previous embodiments are given the same reference numerals and repeated descriptions thereof will be omitted.

A variable frequency band filter 1 according to an eleventh embodiment of the present invention has a tuning support 205*a* adapted to slide on a horizontal plane in a direction perpendicular to the longitudinal direction thereof. The tuning support 205*a* is provided with tuning rods (not shown), as in the previous embodiments, which correspond to resonator rods (not shown). The tuning rods may be chosen from any one disclosed in the previous embodiments, and those skilled in the art can easily modify them as desired.

In the present embodiment, the tuning support 205*a* is adapted to slide on a horizontal plane in a direction perpendicular to the longitudinal direction thereof to adjust the frequency band of the variable frequency band filter 1. The configuration of the tuning rods can be properly adapted for individual products.

For the sliding movement of the tuning support 205*a*, the variable frequency band filter 1 has horizontal guide holes 201*a* formed on the front and rear covers 2*a* thereof. Both ends of the tuning support 205*a* are positioned in the horizontal guide holes 201*a* in such a manner that the tuning support 205*a* can slide. The tuning support 205*a* is moved horizontally, while being supported by the horizontal guide holes 201*a*, so that the frequency band is adjusted according to the area of the tuning rods positioned on top of the resonator rods. In order to adjust the frequency band of the variable frequency band filter 1, an operator may move the tuning support 205*a* in a horizontal direction manually, or with a driving motor 209*a*. The variable frequency band filter 1, as shown in the drawing, is configured in such a manner that a single driving motor 209*a* generates a driving force, which is transmitted by a link bar 213*a* to slide the tuning support 205*a*. Although a single driving motor 209*a* is used to control the position of a pair of tuning supports 205*a* in the present embodiment, it can be appreciated that each tuning support 205*a* can be provided with a driving motor to control the position thereof. Furthermore, the variable frequency band filter 1 may have driving motors positioned on both ends thereof to control the position or the tuning support 205*a* in a more stable manner.

Figure 42:
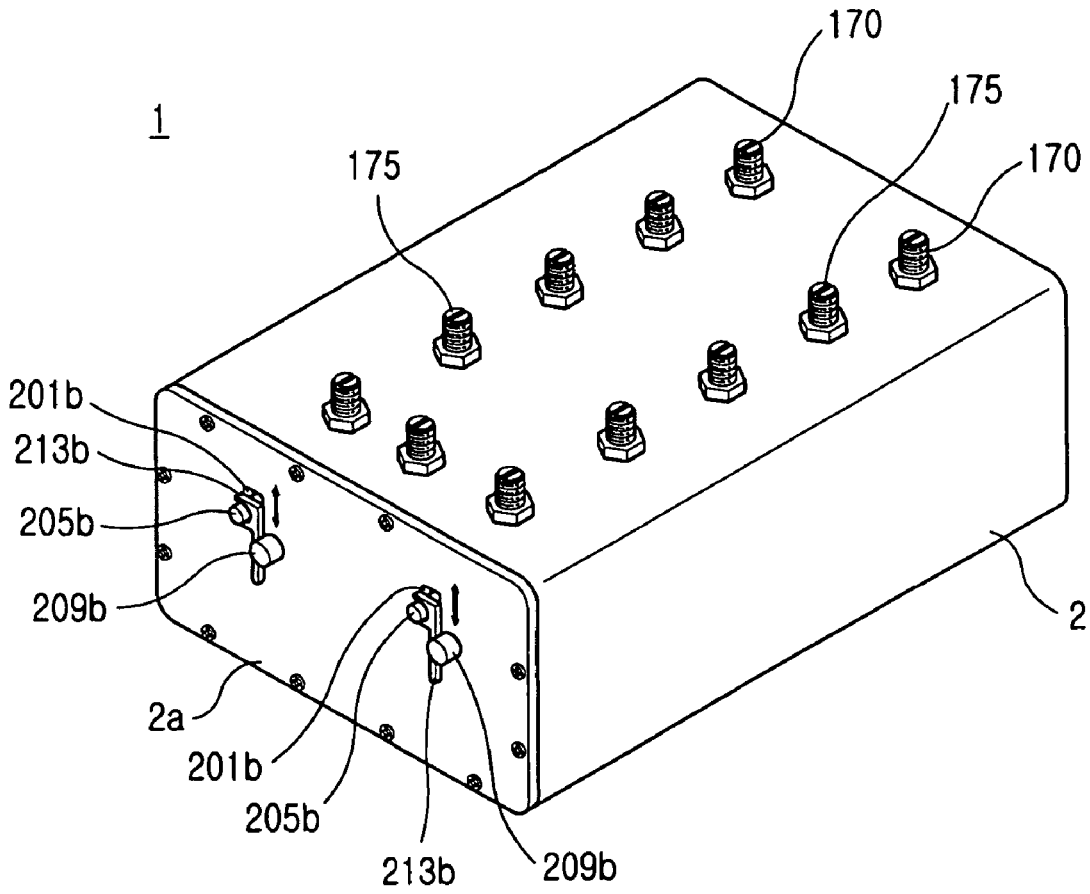
FIG. 42 is a perspective view showing a variable frequency band filter according to a twelfth preferred embodiment of the present invention.
Figure 43:
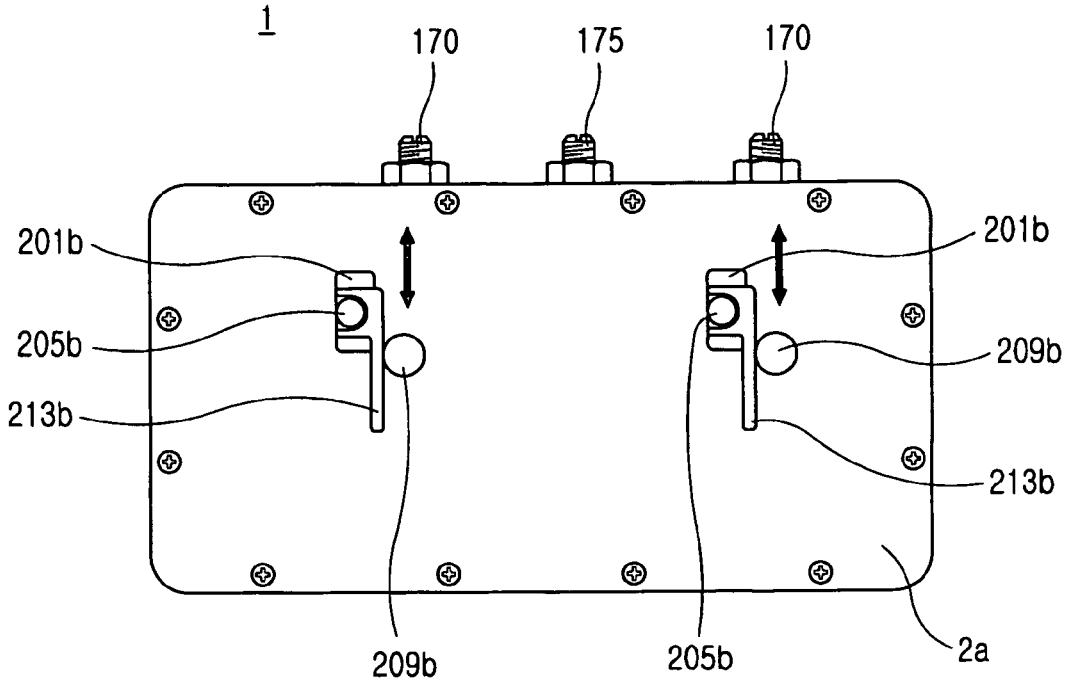
FIG. 43 is a front view of the variable frequency filter shown in FIG. 42.

Referring to FIG. 42, a perspective view of a variable frequency band filter 1 according to a twelfth preferred embodiment of the present invention is shown, and referring to FIG. 43, a front view of the variable frequency filter 1 of FIG. 42 is shown. In the following description of the twelfth embodiment of the present invention, the same components as in the previous embodiments are given the same reference numerals and repeated descriptions thereof will be omitted.

A variable frequency band filter 1 according to a twelfth embodiment of the present invention has a tuning support 205*b* adapted to slide in the vertical direction of the filter 1. The tuning support 205*b* is provided with tuning rods (not shown), as in the previous embodiments, which correspond to resonator rods (not shown). The tuning rods may be chosen from any one disclosed in the previous embodiments.

In the present embodiment, the tuning support 205*b* is adapted to slide vertically to adjust the frequency band of the variable frequency band filter 1. The configuration of the tuning rods can be properly adapted for individual products.

For the sliding movement of the tuning support 205*b*, the variable frequency band filter 1 has vertical guide holes 201*b* formed on the front and rear covers 2*a* thereof. Both ends of the tuning support 205*b* are positioned in the vertical guide holes 201*a* in such a manner that the tuning support 205*b* can slide. The tuning support 205*b* is moved vertically, while being supported by the vertical guide holes 201*b*, so that the frequency band is adjusted according to the distance between the tuning rods and the resonator rods. In order to adjust the frequency band of the variable frequency band filter 1, an operator may manually move the tuning support 205*a* in the vertical direction, or control the position of the tuning support 205*b* using a driving motor 209*b*. The variable frequency band filter 1, as shown in the drawing, has a pair of tuning supports 205*b*, a link bar 213*b* connected to each of the tuning support 205*b*, and a driving motor 209*b* connected to each link bar 213*b*. It is apparent that the link bars 213*b* may be connected to each other and a single driving motor may be used to move the tuning supports 205*b* vertically. Furthermore, the variable frequency band filter 1 may have driving motors positioned on both ends thereof to control the position or the tuning support 205*b* in a more stable manner.

Figure 44:
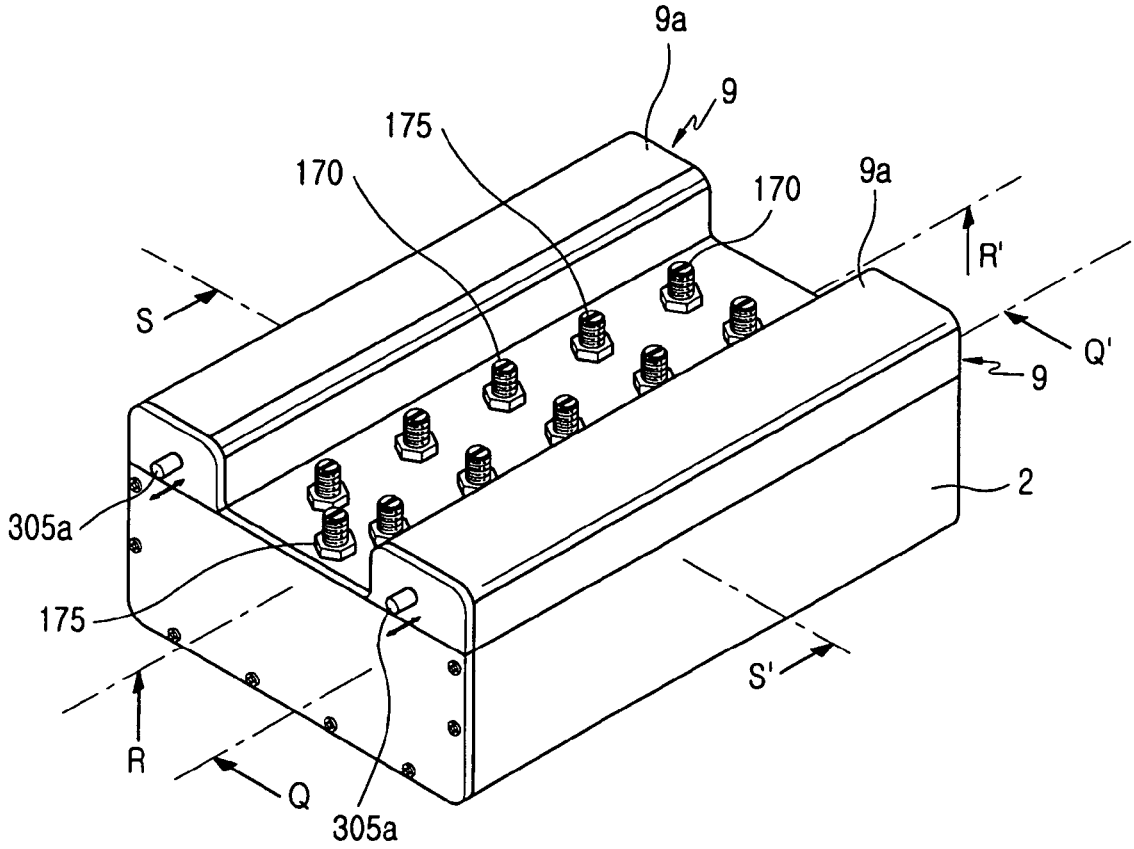
FIG. 44 is a perspective view showing a variable frequency band filter according to a thirteenth preferred embodiment of the present invention.
Figure 45:
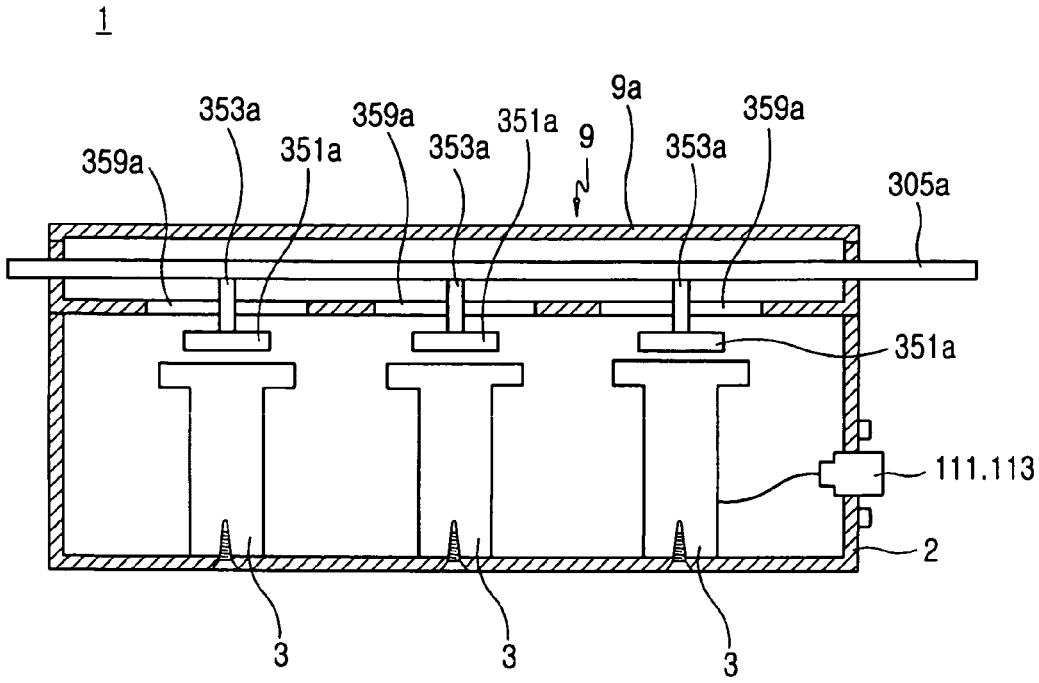
FIG. 45 is a sectional view taken along line Q–Q' of FIG. 44.
Figure 46:
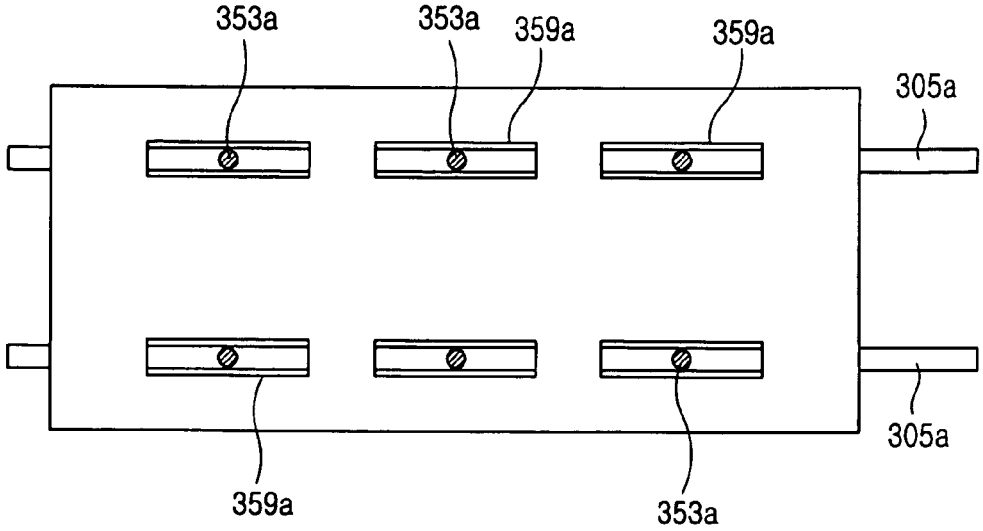
FIG. 46 is a sectional view taken along line R–R' of FIG. 44.
Figure 47:
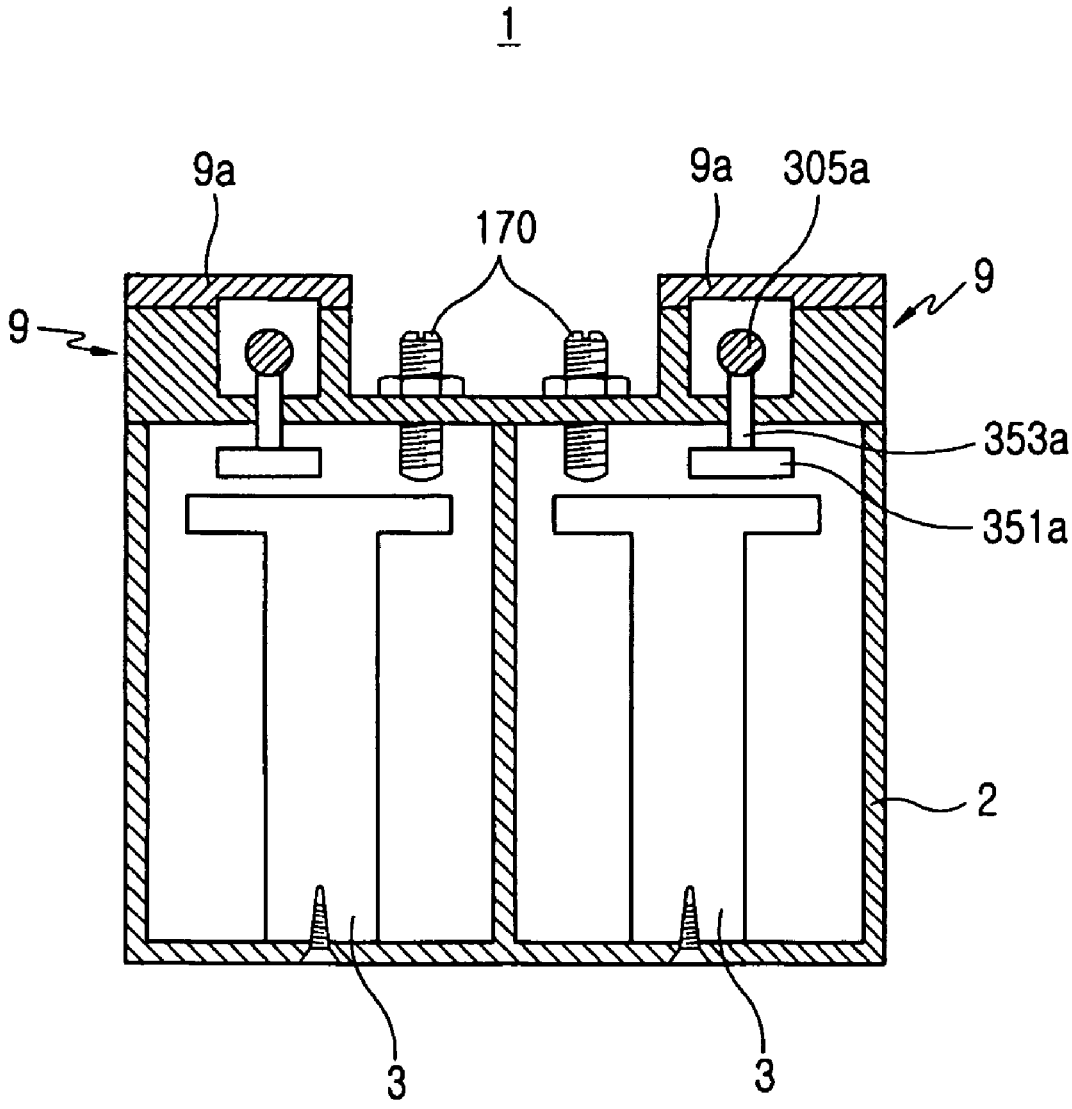
FIG. 47 is a sectional view taken along line S–S' of FIG.44.

Referring to FIG. 44, a perspective view of a variable frequency band filter according to a thirteenth preferred embodiment of the present invention is shown; referring to FIG. 45, a sectional view taken along line Q–Q' of FIG. 44 is shown; referring to FIG. 46, a sectional view taken along line R–R' of FIG. 44 is shown; and referring to FIG. 47, a sectional view taken along line S–S' of FIG. 44 is shown. In the following description of the thirteenth embodiment of the present invention, the same components as in the previous embodiments are given the same reference numerals and repeated descriptions thereof will be omitted.

As shown in FIGS. 44 to 47, a variable frequency band filter 1 according to a thirteenth embodiment of the present invention has a tuning support 305*a* positioned in a support housing 9, which is positioned on the exterior of a housing 2. Specifically, the housing 2 has a pair of support housings 9 integrally formed on its upper end along the longitudinal direction thereof. Both ends of the tuning support 305*a* are supported by the opposite ends of the support housing 9 in such a manner that the tuning support 305*a* can slide in the longitudinal direction. A housing cover 9*a* covers the support housing 9. The variable frequency band filter 1 has support bars 353*a* extending downward from the tuning support 305*a* and having an end positioned in the housing 2. The support bars 353*a* are positioned in such a manner that they face the respective resonator bars 3, which are positioned in the housing 2. Tuning rods 351*a*, which may be chosen from any one disclosed in the previous embodiments, are positioned on the lower end of the support bars 353*a*.

The housing 2 has guide holes 359*a* formed on the upper surface thereof, which extend along the longitudinal direction of the tuning support 305*a*, in order to provide the support bars 353*a* with a movement space as the tuning support 305*a* is slid along the longitudinal direction. As the tuning support 305*a* is slid on the support housing 9 along the longitudinal direction, the area of the tuning rods 351*a* positioned on the upper surface of the resonator rods 3 is varied, and so is the frequency band of the variable frequency band filter 1.

It is noted that the influence of the tuning support 305*a* on other characteristics, during the frequency band adjustment, is drastically decreased, because the tuning support 305*a* is positioned on the exterior of the housing 2. In the previous embodiments where the tuning support is positioned in the housing together with the resonator rods, the tuning support is made of alumina, polycarbonate, Teflon, metallic substance, or dielectric substance, in consideration of the influence of the tuning support on other characteristics during the frequency band adjustment. In contrast, the tuning support 305*a* is positioned on the exterior of the housing 2 according to the present embodiment and has less influence on other characteristics during the frequency band adjustment. Accordingly, the tuning support may be made of more inexpensive material.

Two alternative embodiments of a variable frequency band filter having a tuning support positioned in a separate support housing, as above, will now be described.

Figure 48:
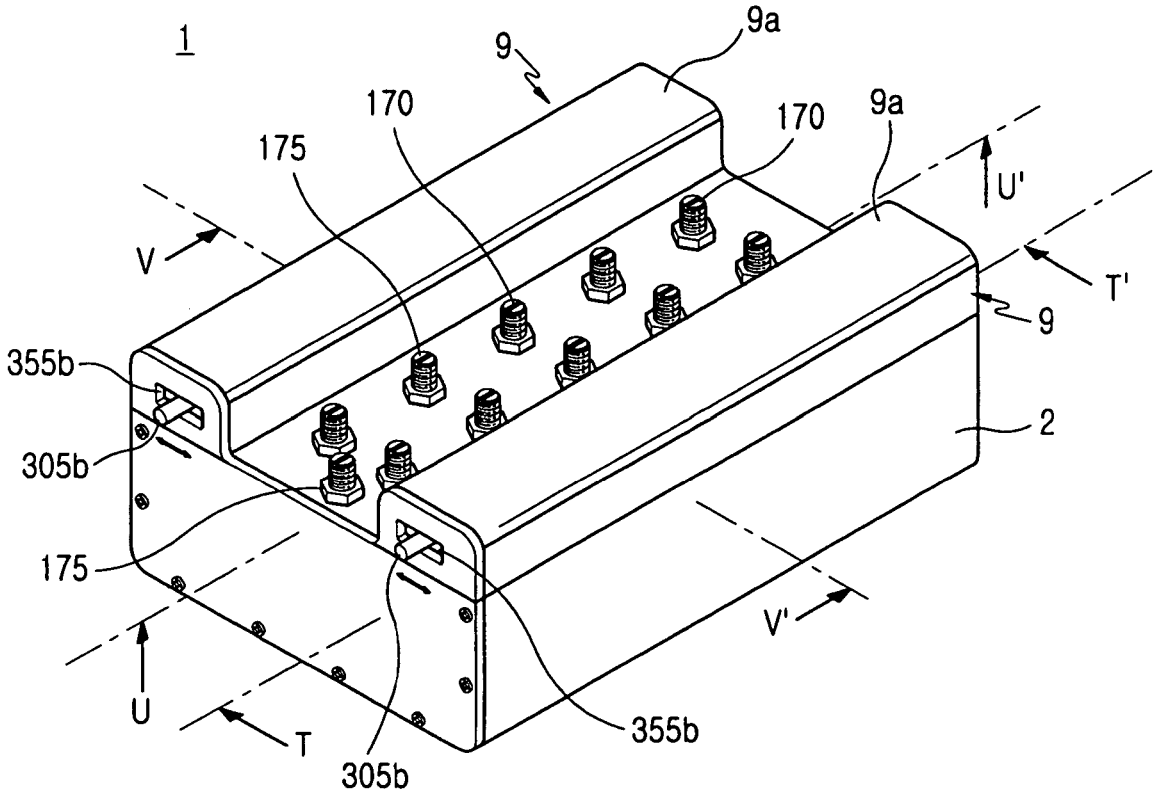
FIG. 48 is a perspective view showing a variable frequency band filter according to a fourteenth preferred embodiment of the present invention.
Figure 49:
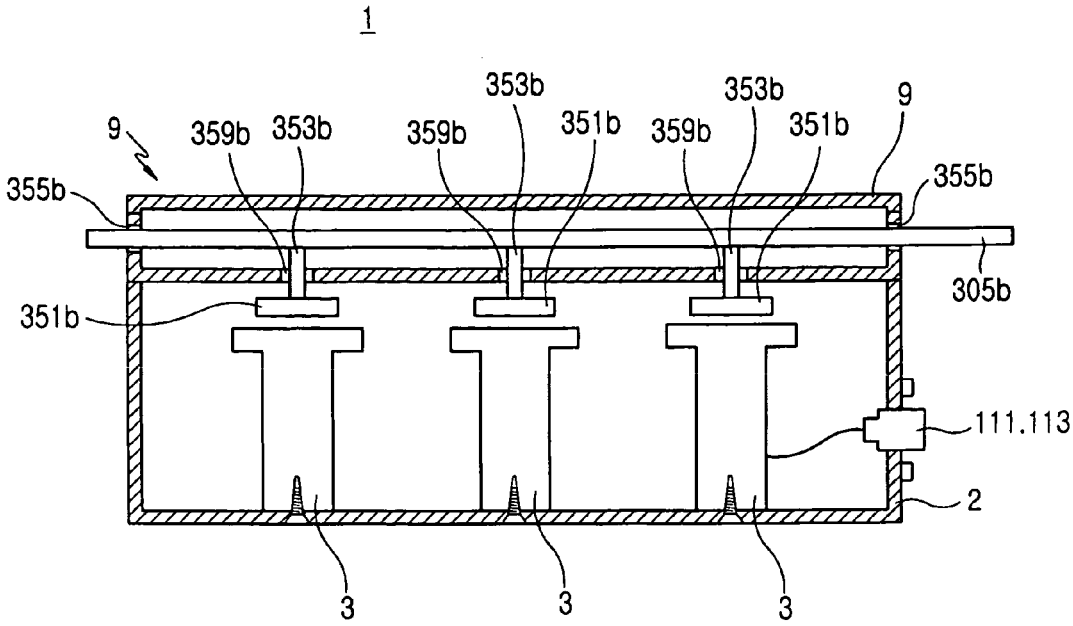
FIG. 49 is a sectional view taken along line T–T' of FIG. 48.
Figure 50:
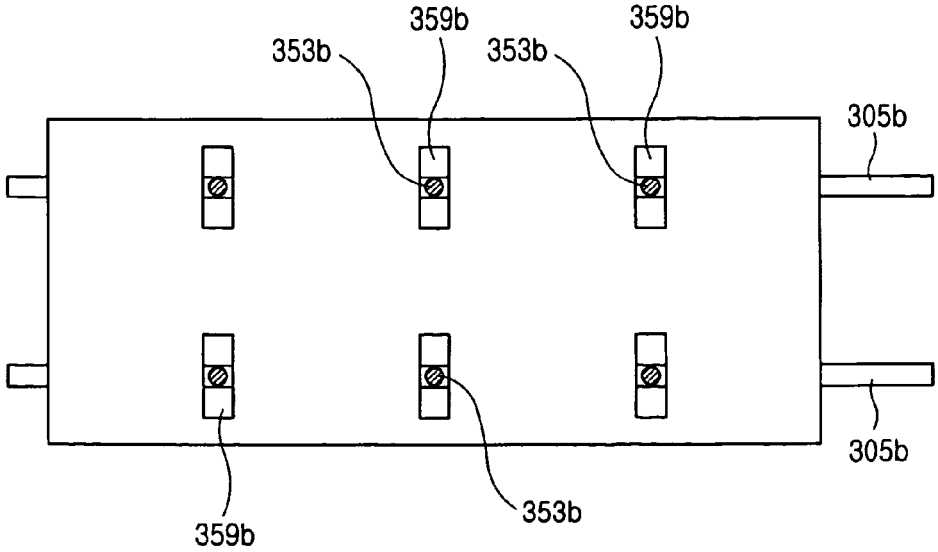
FIG. 50 is a sectional view taken along line U–U' of FIG. 48.
Figure 51:
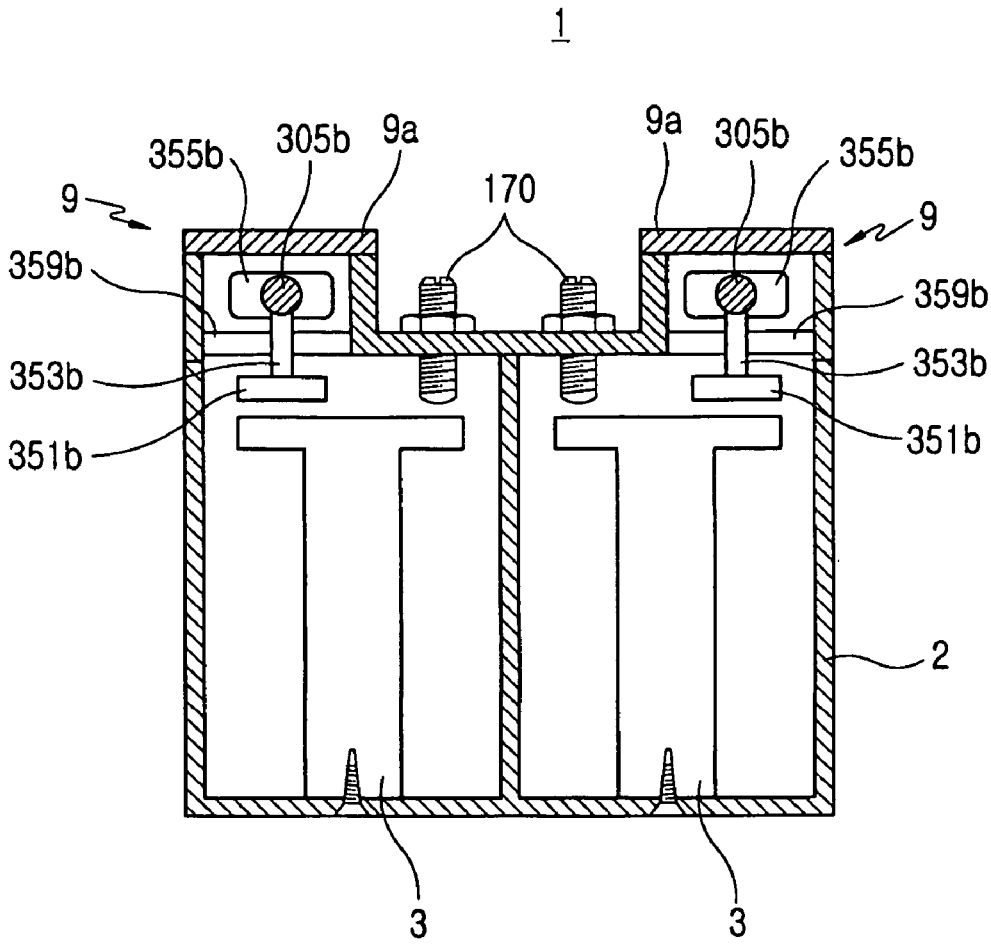
FIG. 51 is a sectional view taken along line V–V' of FIG. 48.

Referring to FIG. 48, a perspective view showing a variable frequency band filter 1 according to a fourteenth preferred embodiment of the present invention is shown; referring to FIG. 49, a sectional view taken along line T–T' of FIG. 48 is shown; referring to FIG. 50, a sectional view taken along line U–U' of FIG. 48 is shown; and referring to FIG. 51, a sectional view taken along line V–V' of FIG. 48 is shown. In the following description of a variable frequency band filter 1 of a fourteenth embodiment of the present invention, the same components as in the previous embodiments are given the same reference numerals and repeated descriptions thereof will be omitted.

A variable frequency band filter 1 according to a fourteenth embodiment of the present invention has a tuning support 305*b* adapted to slide on a horizontal plane in a direction perpendicular to the longitudinal direction thereof. A support housing 9 has horizontal guide holes 355*b* formed on both ends thereof. Support bars 353*b* extend from the tuning support 305*b* and have tuning rods 351*b* disposed on the lower end thereof. The tuning rods 351*b* are positioned on resonator rods 3 in the housing 2. The housing 2 has guide holes 359*b* formed on the upper surface thereof along the horizontal direction, in order to provide the support bars 353*b* with a movement space as the tuning support 305*b* is slid in the horizontal guide holes 355*b*. As the tuning support 305*b* is slid on the support housing 9 along the horizontal direction, the area of the tuning rods 351*b* positioned on the upper surface of the resonator rods 3 is varied, and so is the frequency band of the variable frequency band filter 1.

Although not shown in the drawing, it is apparent that a driving motor and a link bar for transmitting a driving force may be used to control the position of the tuning support 305*b*, as in the eleventh embodiment of the present invention.

Figure 52:
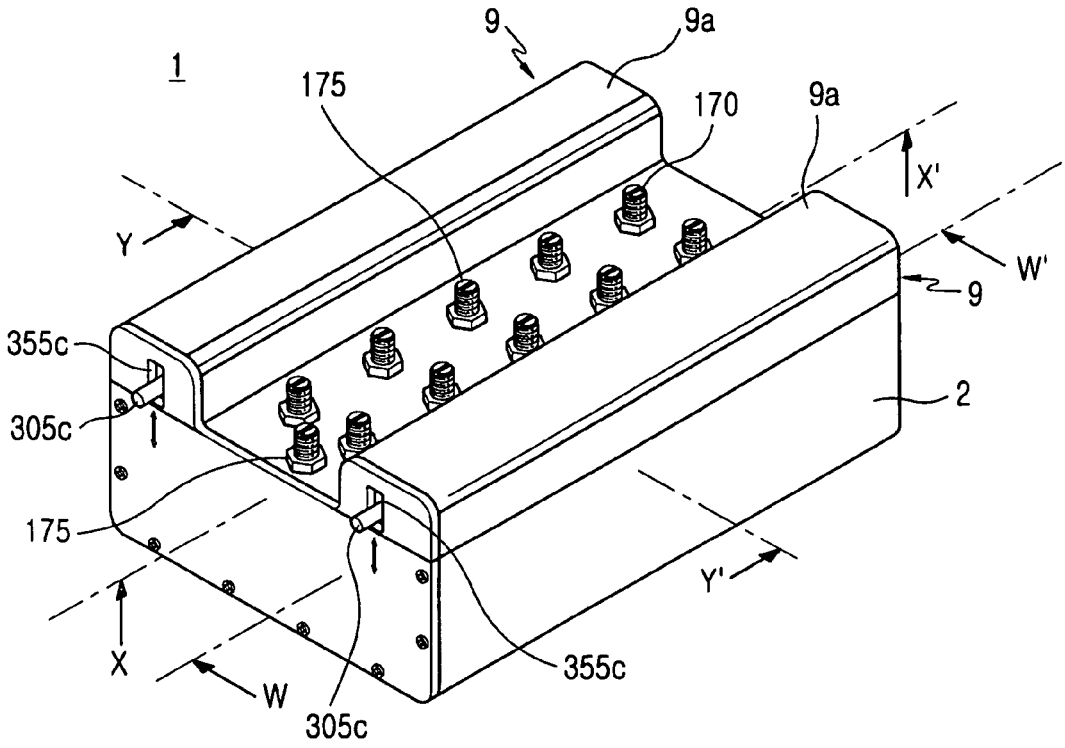
FIG. 52 is a perspective view showing a variable frequency band filter according to a fifteenth preferred embodiment of the present invention.
Figure 53:
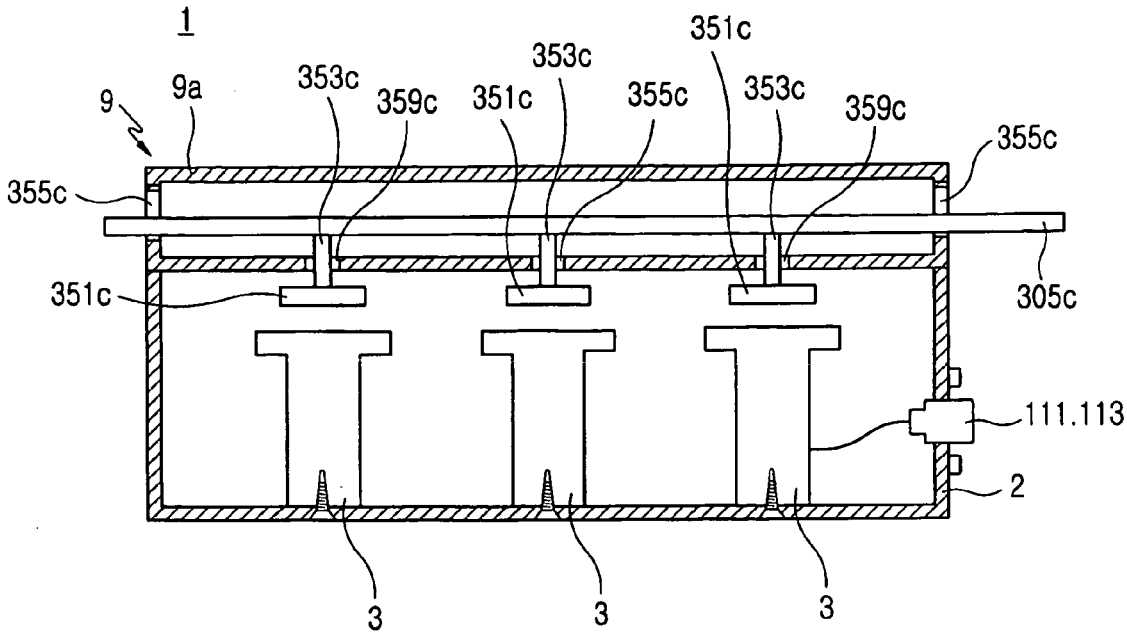
FIG. 53 is a sectional view taken along line W–W' of FIG.52.
Figure 54:
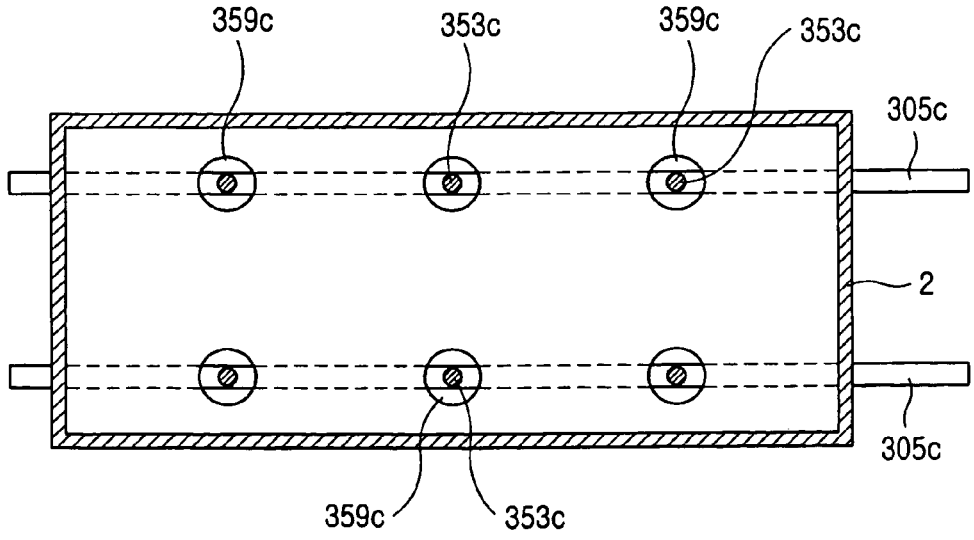
FIG. 54 is a sectional view taken along line X–X' of FIG. 52.
Figure 55:
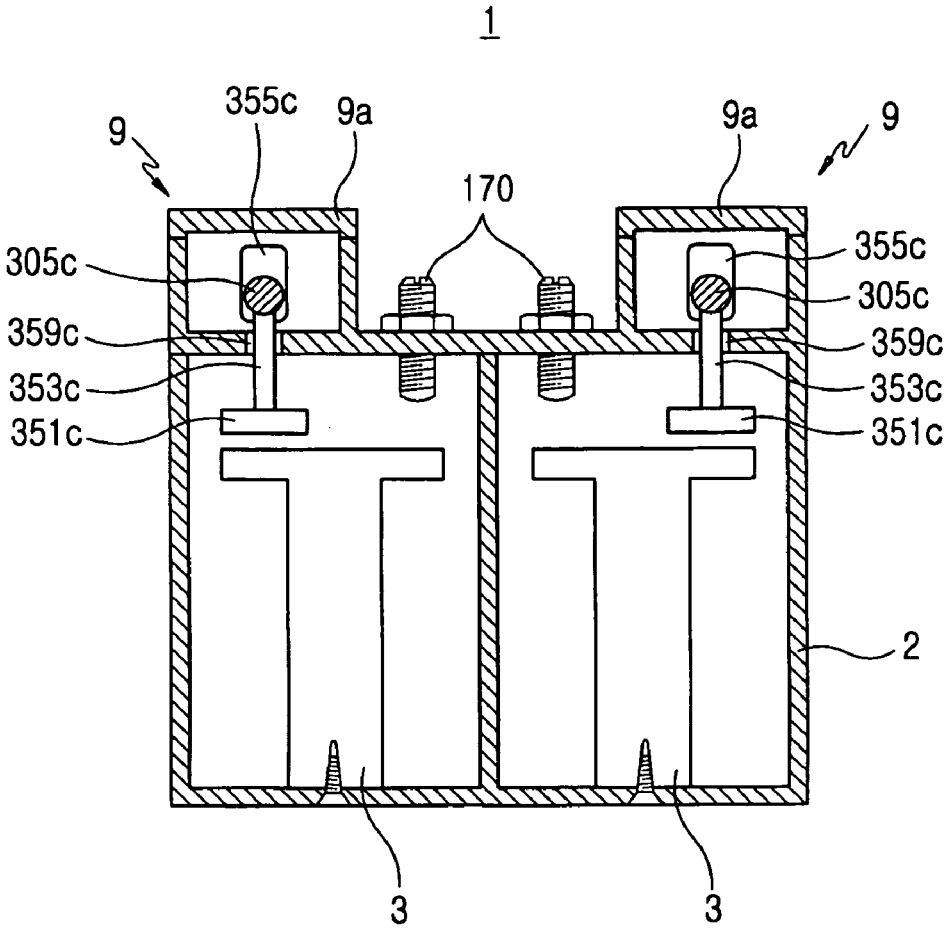
FIG. 55 is a sectional view taken along line Y–Y' of FIG. 52.

Referring to FIG. 52, is a perspective view showing a variable frequency band filter 1 according to a fifteenth preferred embodiment of the present invention is shown; referring to FIG. 53, a sectional view taken along line W–W' of FIG. 52 is shown; referring to FIG. 54, a sectional view taken along line X–X' of FIG. 52 is shown; and referring to FIG. 55, a sectional view taken along line Y–Y' of FIG. 52 is shown. In the following description of a variable frequency band filter 1 of a fifteenth embodiment of the present invention, the same components as in the previous embodiments are given the same reference numerals and repeated descriptions thereof will be omitted.

A variable frequency band filter 1 according to a fifteenth embodiment of the present invention has a tuning support 305*c* adapted to be moved vertically in a support housing 9. The support housing 9 have vertical guide holes 355*c* formed on both ends thereof. Support bars 353c extend from the tuning support 305*c* and have tuning rods 351*c* disposed on the lower end thereof The tuning rods 351*c* are positioned on resonator rods 3 in the housing 2. As the tuning support 305*c* is slid vertically in the support housing 9, the distance between the tuning rods 351*c* and the resonator rods 3 is varied, and so is the frequency band of the variable frequency band filter 1.

Although not shown in the drawing, it is apparent that a driving motor and a link bar for transmitting a driving force may be used to control the position of the tuning support 305*c*, as in the twelfth embodiment of the present invention.

Figure 56:
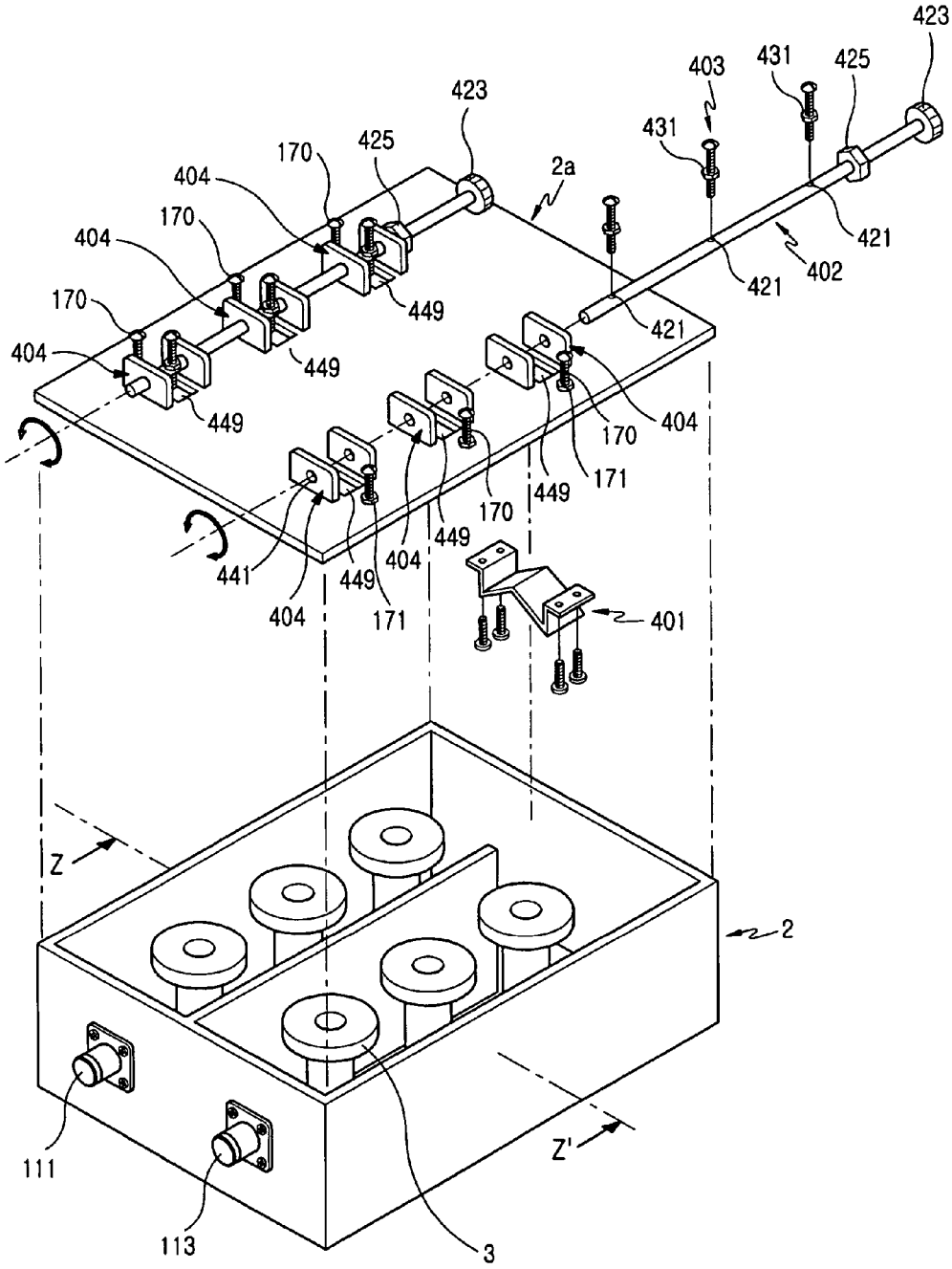
FIG. 56 is an exploded perspective view showing a variable frequency band filter according to a sixteenth preferred embodiment of the present invention.
Figure 57:
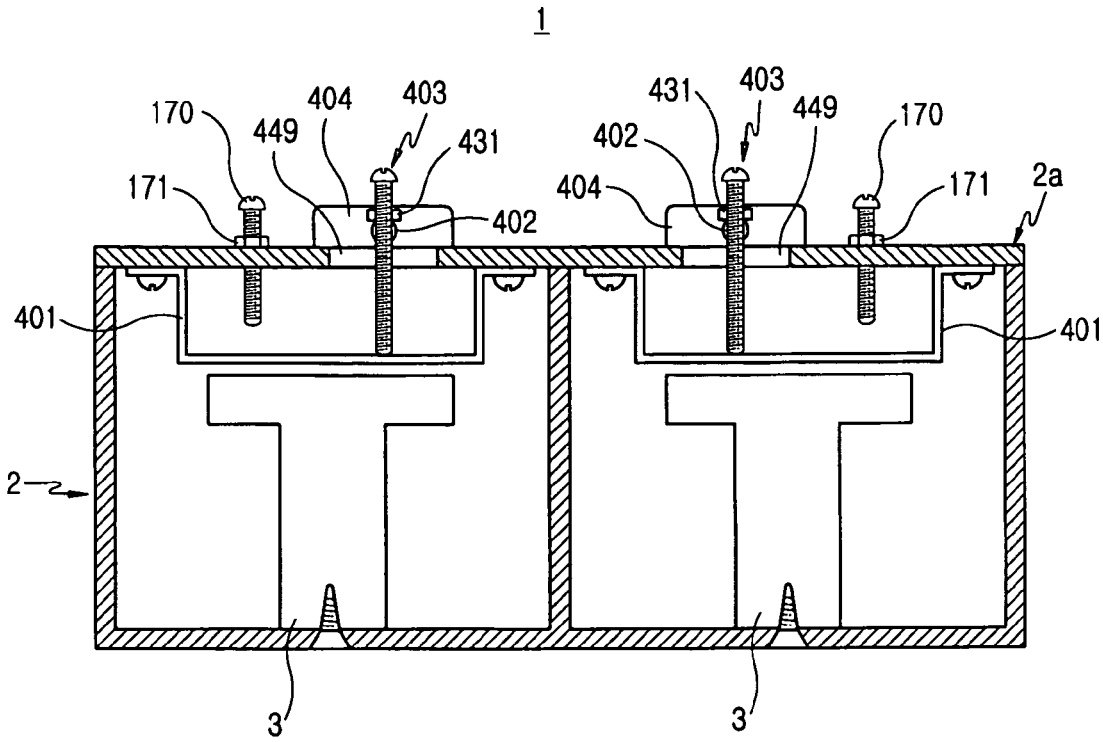
FIGS. 57 and 58 are sectional views taken along line Z–Z' of FIG. 56, with FIG. 57 showing tuning plates positioned most adjacently to the resonator rods by the tuning bars and FIG. 58 showing the tuning plates positioned away from the resonator rods.
Figure 58:
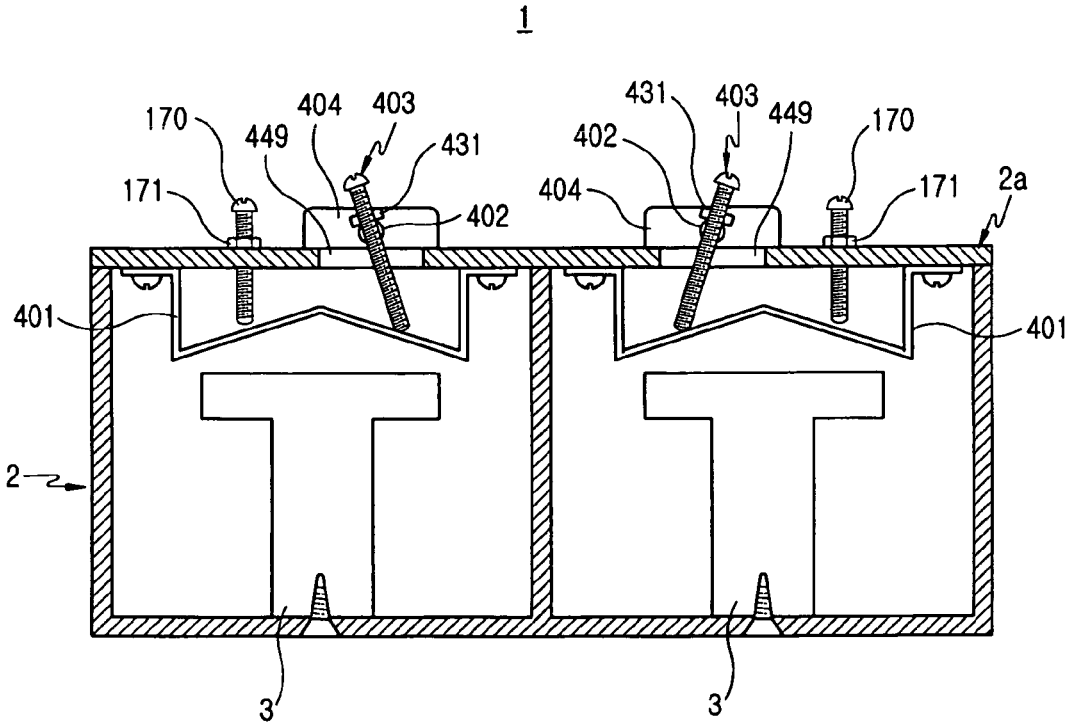

Referring to FIG. 56, an exploded perspective view of a variable frequency band filter according to a sixteenth preferred embodiment of the present invention is shown, and referring to FIGS. 57 and 58, sectional views taken along line Z–Z' of FIG. 56 are shown. As shown in FIGS. 56 to 58, a variable frequency band filter 1 according to a sixteenth preferred embodiment of the present invention includes a housing 2, resonator rods 3, tuning screws 170, input and output connectors 111 and 113, tuning plates 401, a tuning support 402, and tuning bars 403.

The housing 2 has a containing space extending along the longitudinal direction thereof. The input and output connectors 111 and 113 are positioned on an end of the housing 2. The upper end of the housing is open, and a housing cover 2*a* is coupled thereto. The resonator rods 3 extend upward from the internal bottom surface of the housing 2 and are arranged in two rows within the housing 2 along the longitudinal direction thereof. The containing space may be subdivided into two or more of containing spaces by diaphragms, according to requirements on products, and the resonator rods 3 may be positioned in the respective containing spaces. The tuning plates 401 are positioned on top of the respective resonator rods 3.

The tuning plates 401 are fastened to the lower surface of the housing cover 2*a*, i.e., to the inner top surface of the housing 2. Both ends of the tuning plates 401 are bent in a direction, respectively, and fastened to the surface by screws. Alternatively, the tuning plates 401 may be welded to the inner top surface of the housing 2. Each of the tuning plates 401 faces the upper end surface of the resonator rods 3. The tuning plates 401 are made of a flexible plate material so that they can be deformed to some degree by an external force and return to their original shape by an accumulated elastic force. Considering such characteristics, the tuning plates 401 may be made of a beryllium copper plate or any other suitable material.

The tuning support 402 is positioned on the housing 2, specifically on top of the housing cover 2*a*, in such a manner that it can be rotated. The tuning support 402 has the shape of a bar extending along the longitudinal direction of the housing and is provided with an adjustment knob 423 on an end thereof so that an operator can manually operate and rotate it. Of course, it is apparent that a driving motor may be used to rotate the tuning support 402, as in the previous embodiments. The tuning support 402 has a number of screw holes 421 formed thereon. The screw holes 421 are positioned in such a manner that they face the corresponding resonator rods 3, when the tuning support 402 is assembled on the housing cover 2*a*. The tuning support 402 has at least one fixation nut 425 coupled thereto for fixing the tuning support 402 and preventing it from rotating after the frequency band is adjusted using the tuning support 402.

The housing cover 2*a* has at least one support base 404 positioned on the upper surface thereof for accommodating the tuning support 402. The support base 404 has a through-hole 441 extending along the longitudinal direction of the housing 2. The tuning support 402 is coupled to the support base 404 via the through-hole 441 in such a manner that it can be rotated. A bearing (not shown) or a guide dielectric member may be interposed between the tuning support 402 and the through-hole 441 for smooth rotation. After the tuning support 402 is rotated, the fixation nut 425 is rotated to fix the tuning support 402 at a suitable position. The fixation nut 425 is then tightened, while contacting the support base 404, to firmly maintain the fixation.

In the present embodiment, a pair of support bases 404, which constitute a set, are positioned to face each resonator rod 3. Since six resonator rods 3 are provided, a total of six pairs (i.e., six sets) of supports bases 404 are provided. A tuning hole 449 is formed between each of the support bases 404 and extends through the upper and lower portions of the housing cover 2*a*.

The tuning bars 403 are fastened in the screws holes 421 of the tuning support 402 and have an end passing through the tuning holes 449 to contact the tuning plates 401, which are positioned on the top surface of the housing 2. The tuning plates 401 have an elastic force accumulated therein, which acts in a direction away from the resonator rods 3. If the tuning support 402 is rotated, the tuning bars 403 change the shape of the tuning plates 401 in such a manner that they approach the resonator rods 3. When the tuning bars 403 are positioned perpendicularly to the ground, as shown in FIG. 57, the tuning plates 401 are positioned most adjacently to the resonator rods 3.

When the tuning bars 403 are rotated and slanted relative to the ground, as shown in FIG. 58, the tuning plates 401 are deformed in such a manner that they move away from the resonator rods 3. The rotation of the tuning support 402 changes the slant angle of the tuning bars 403 relative to the ground, because the tuning bars 403 are fastened to the tuning support 402. Accordingly, the distance between the tuning plates 401 and the resonator rods 3 is adjusted according to the slant angle of the tuning bars 403, and so is the resonance frequency band of the variable frequency band filter 1. The tuning bars 403 have a nut 431 fastened thereto for fixing the tuning bars 403 to the tuning support 402 and preventing them from rotating. An end of the tuning bars 403 may be coated with dielectric substance to avoid scratching due to friction with the tuning plates 401, when the tuning bars 403 are rotated, and guarantee smooth rotation.

As mentioned above, in order to vary the resonance frequency band of the variable frequency band filter 1, the distance between the resonator rods 3 and the tuning plates 401 can be adjusted using the tuning plates 401 and the tuning bars 403. If the frequency band is varied, a deviation in electric characteristics occurs according to the respective frequency bands. The tuning screws 170 are used to perform compensation tuning in order to compensate for the deviation. Although not shown in the drawing, it is apparent that coupling screws may be additionally positioned between the resonators 3 to regulate the coupling characteristics of the variable frequency band filter 1.

Figure 59:
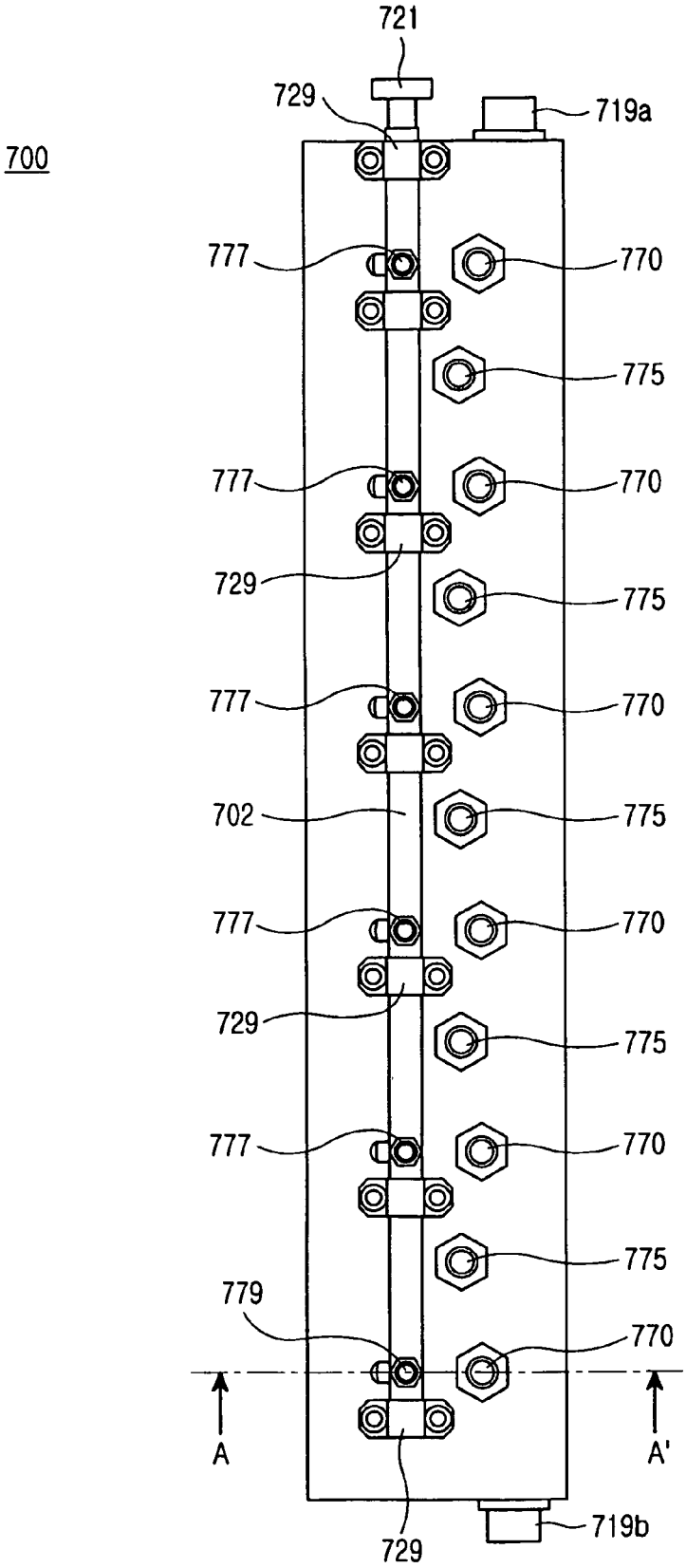
FIG. 59 is a top view showing a variable frequency band filter according to a seventeenth preferred embodiment of the present invention.
Figure 60:
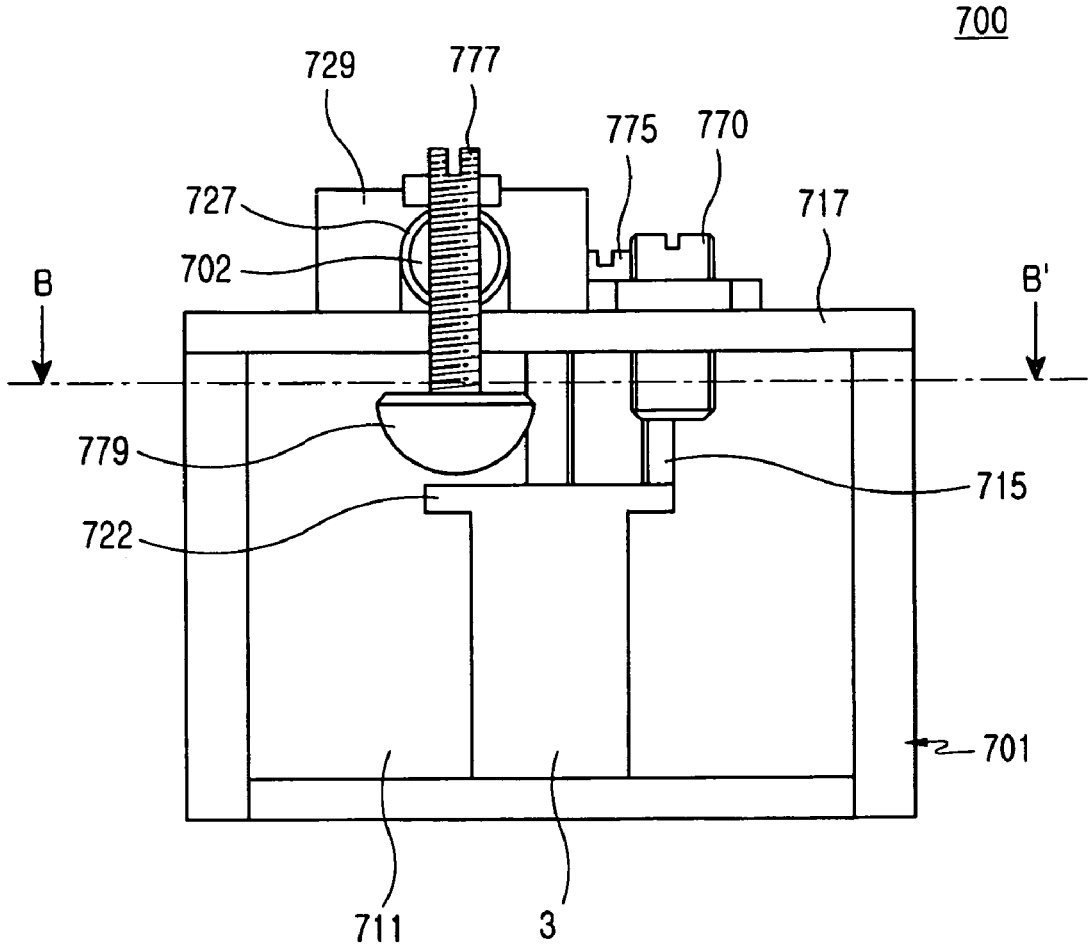
FIG. 60 is a sectional view taken along line A–A' of FIG. 59.
Figure 61:
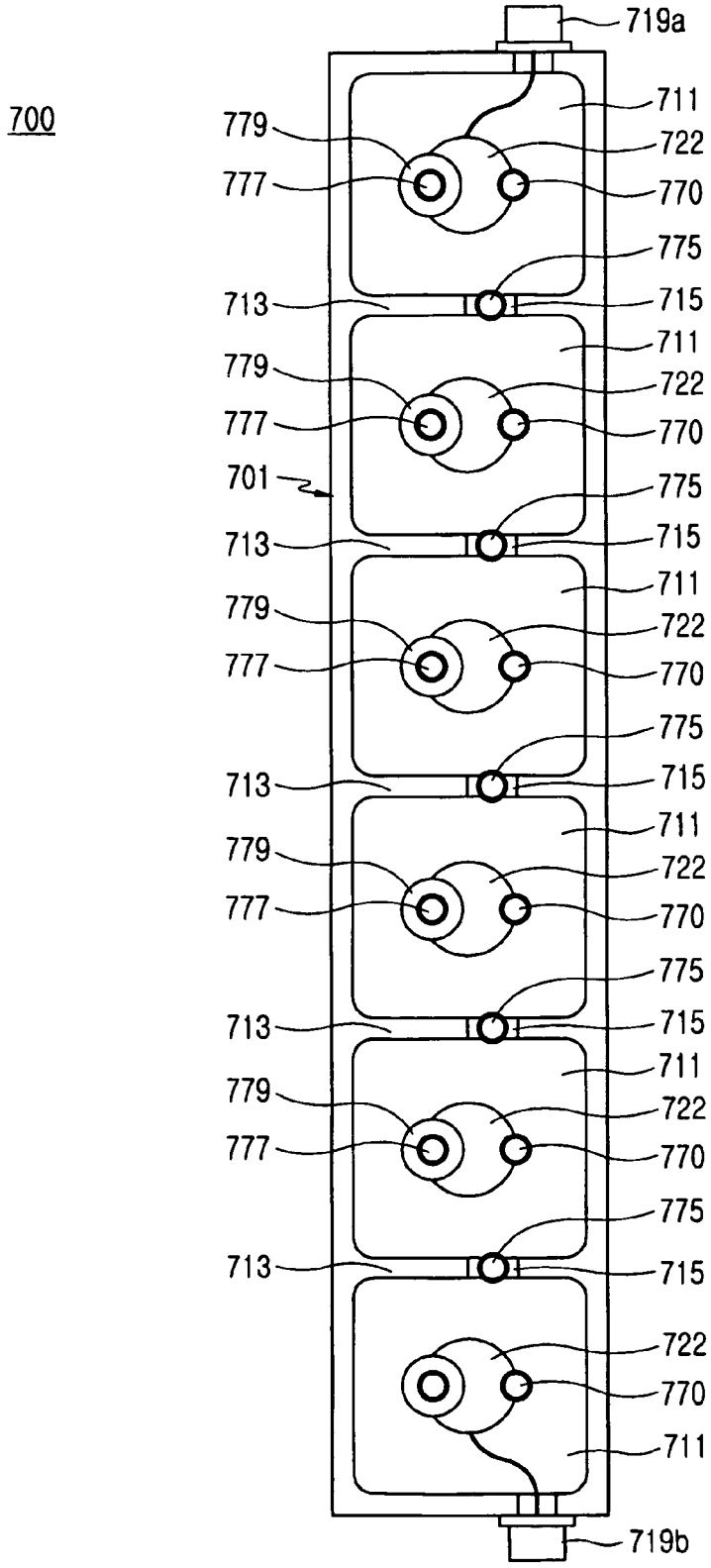
FIG. 61 is a sectional view taken along line B–B' of FIG. 60.

As shown in FIGS. 59 to 61, a variable frequency band filter 700 according to a seventeenth preferred embodiment of the present invention includes a housing 701, resonator rods 3, tuning screw bars 777, tuning disks 779, resonance and coupling tuning screws 770 and 775, input and output connectors 719*a* and 719*b*, a tuning support 702, coupling windows 715, and a knob 721.

The housing 701 has input and output connectors 719*a* and 719*b*. The interior of the housing 701 is divided by diaphragms 713 into a number of containing spaces, in which disk-shaped resonator rods 3 are contained.

The input connector 719*a* and the output connector 719*b* are positioned on the opposite end surfaces of the housing 701, respectively, and each of them is connected to a chosen containing space 711. The diaphragms 713 have coupling windows 715 formed therein for serial connection from a containing space, to which the input connector 719*a* is connected, to another containing space, to which the output connector 719*b* is connected. The housing 701 has an open upper surface. After the disk-shaped resonator rods 3 are contained in the respective containing spaces 711, the upper end of the housing 701 is sealed using a cover 717.

The disk-shaped resonators 3 have a disk 722 extending in the diametric direction along the upper outer peripheral surface thereof. The variable frequency band filter 700, wherein disks 722 are positioned on the upper end of the resonator rods 3 which is assembled in the housing 701, is characterized in that it is operated for a low resonance frequency.

The interrelationship between the resonance frequency and the housing 701, the disk-shaped resonator rods 3, the diaphragms 713, as well as the cover 717, will now be explained with reference to FIG. 6.

The resonance frequency of the variable frequency band filter 700 is determined by values of capacitance and inductance, which are formed among capacitive components 17 and inductive components 19 constituting resonance circuits 10, 11, 12, 13, 14, and 15, particularly among the housing 701, the disk-shaped resonator rods 3, the diaphragms 713, and the cover 717. Meanwhile, the input and output connectors 719*a* and 719*b* are connected the disk-shaped resonator rods 3 via an input terminal coupling copper wire and an output terminal coupling copper wire, respectively.

The resonance frequency of the variable frequency band filter 700, configured as above, is affected by the length, outer diameter, and the like of the disk-shaped resonator rods 3 and is tuned more precisely with separate tuning disks 779, which are fastened to the resonance tuning screws 770 and the tuning screw bars 777. The tuning screw bars 777 are fastened to the tuning support 702 with a predetermined spacing. The tuning support 702 is coupled to support bases 729 in such a manner that it can be rotated. Tuning support guides 727 are interposed between the outer peripheral surface of the tuning support 702 and the support bases 729 for lubrication.

The tuning screw bars 777 have a semi-spherical tuning disk 779 fastened to an end thereof. A surface of the tuning disk 779 is planar and the other surface is of a semi-spherical shape, on which a screw hole is formed to be screw-fastened to an end of the tuning screw bars 777.

The support bases 729 have fastening holes (not shown) formed on both ends thereof and are fastened to the cover 717 through the fastening holes. A number of support bases 729 are coupled on the cover 717 with a predetermined spacing to support the tuning support 702 in such a manner that it can be rotated.

The tuning disks 779, which are assembled on the tuning screw bars 777, are positioned in such a manner that they face the disk-shaped resonator rods 3, which are contained in the housing 701. The resonance frequency band of the variable frequency band filter 700 is varied according to the area of the tuning disks 779 facing the resonator rods 3 and the distance between them.

The containing space 711 may be subdivided into a number of containing spaces by diaphragms 731, according to requirements on products, and the number of the resonator rods 3 is also determined by the requirements. For stable support for the tuning support 702, a means for retaining and supporting may be additionally provided, such as the manual frequency variation unit 6 shown in FIG. 10.

If the tuning support 702 is rotated a predetermined angle by an external force, the tuning screw bars 777 are rotated accordingly. The area of the tuning disks 779 positioned on top of the resonator rods 3 and the distance between them are then changed, and the resonance frequency band is varied accordingly.

When the frequency band is varied, a deviation in electric characteristics occurs according to the respective frequency bands. In this case, the resonance tuning screws 770 are used to perform fine compensation tuning. After completion of the frequency variation tuning of the variable frequency band filter 700, nuts may be used to fix the tuning support 702 and prevent it from rotating and changing the resonance frequency characteristics.

Figure 62:
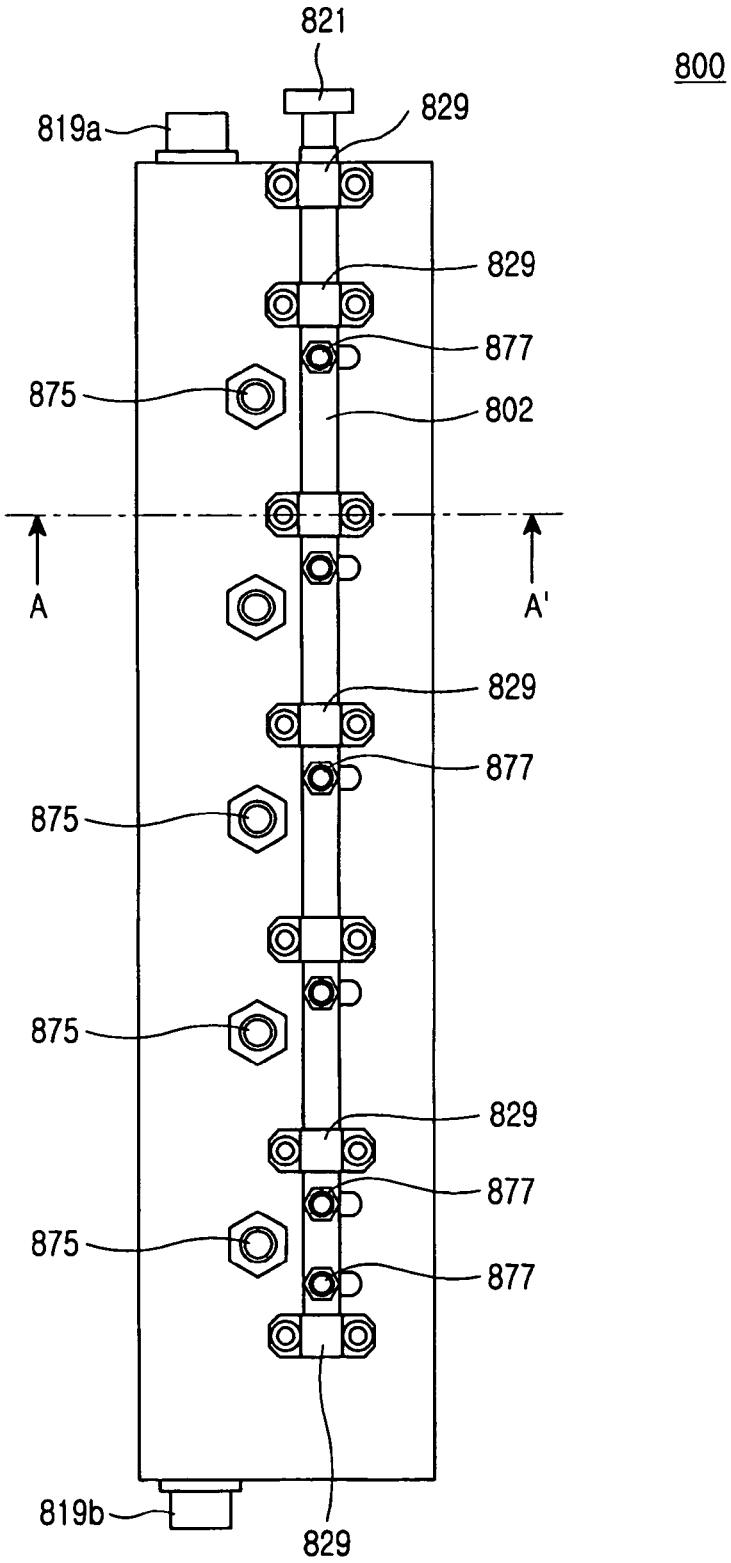
FIG. 62 is a top view showing a variable frequency band filter according to an eighteenth preferred embodiment of the present invention.
Figure 63:
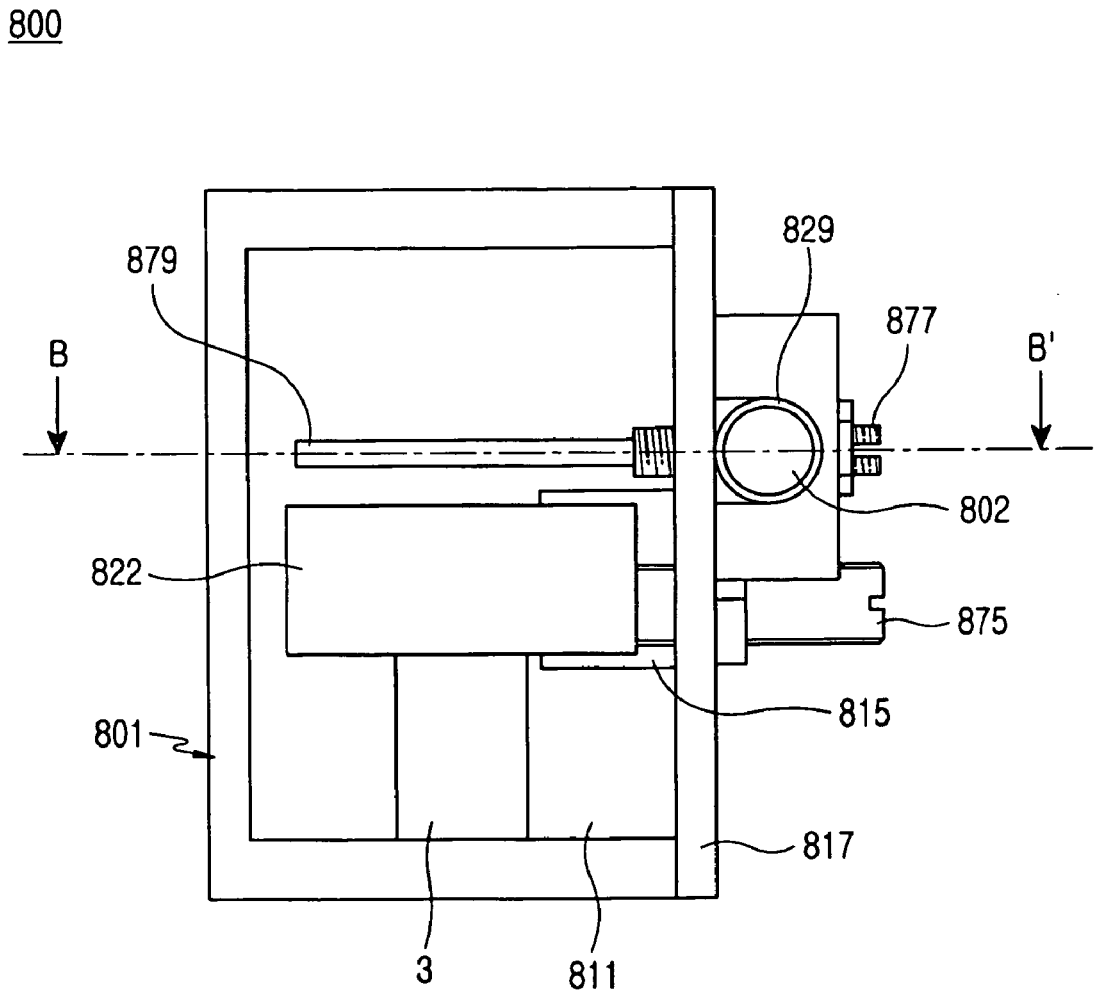
FIG. 63 is a sectional view taken along line A–A' of FIG. 62.
Figure 64:
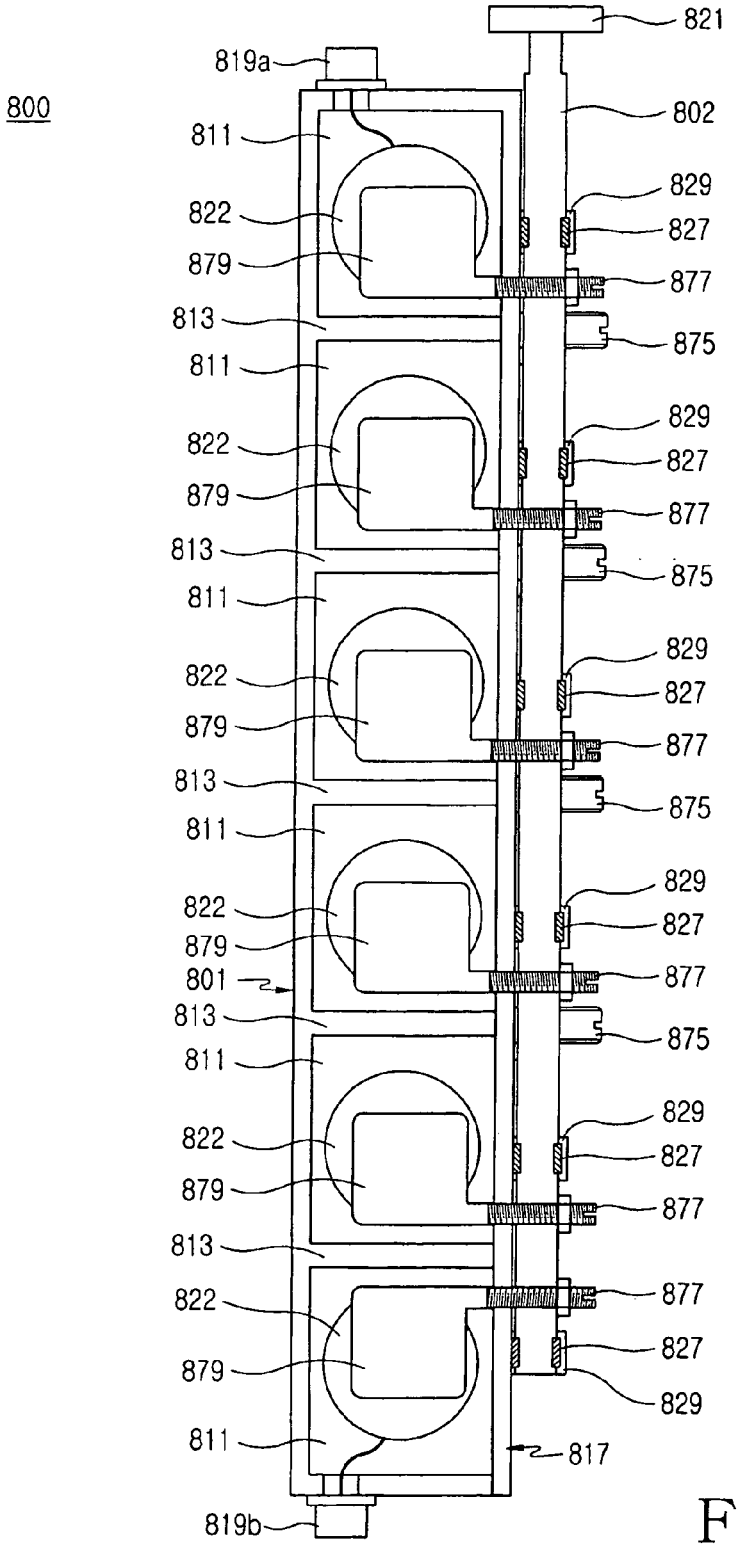
FIG. 64 is a sectional view taken along line B–B' of FIG. 63.

As shown in FIGS. 62 to 64, a variable frequency band filter 800 according to an eighteenth preferred embodiment of the present invention includes a housing 801, resonator rods 3, tuning screw bars 877, tuning plates 879, coupling tuning screws 875, input and output connectors 819*a* and 819*b*, a tuning support 802, coupling windows 815, and a knob 821.

The housing 801 has input and output connectors 819*a* and 819*b*. The interior of the housing 801 is divided by diaphragms 813 into a number of containing spaces 811, in which disk-shaped resonator rods 811 are contained.

The input connector 819*a* and the output connector 819*b* are positioned on the opposite end surfaces of the housing 801, respectively, and each of them is connected to a chosen containing space. The diaphragms 813 have coupling windows 815 formed therein for serial connection from a containing space, to which the input connector 819*a* is connected, to another containing space, to which the output connector 819*b* is connected. The housing 801 has an open upper surface. After the disk-shaped resonator rods 3 are contained in the respective containing spaces 811, the upper end of the housing 801 is sealed using a cover 817. The disk-shaped resonators 3 have a disk 822 extending in the diametric direction along the upper outer peripheral surface thereof. The variable frequency band filter 800, wherein disks 822 are positioned on the upper end of the resonator rods 3 which is assembled in the housing 801, is characterized in that it is operated for a low resonance frequency.

The interrelationship between the resonance frequency and the housing 801, the disk-shaped resonator rods 3, the diaphragms 813, as well as the cover 817, will now be explained with reference to FIG. 6.

The resonance frequency of the variable frequency band filter 800 is determined by values of capacitance and inductance, which are formed among capacitive components 17 and inductive components 19 constituting resonance circuits 10, 11, 12, 13, 14, and 15, particularly among the housing 801, the disk-shaped resonator rods 3, the diaphragms 813, and the cover 817. Meanwhile, the input and output connectors 819*a* and 819*b* are connected the disk-shaped resonator rods 3 via an input terminal coupling copper wire and an output terminal coupling copper wire, respectively, for frequency signal energy. The resonance frequency of the variable frequency band filter 800, configured as above, is affected by the length, outer diameter, and the like of the disk-shaped resonator rods 3 and is tuned more precisely with separate tuning plates 879 fastened to the tuning screw bars 877.

The tuning screw bars 877 are fastened to the tuning support 802 with a predetermined spacing. The tuning support 802 is coupled to support bases 829 in such a manner that it can be rotated. Tuning support guides 827 are interposed between the tuning support 802 and the support bases 829 for lubrication.

The tuning screw bars 877 have an I-shaped grooved formed on an end surface thereof. The tuning plates 879, which are of a plate shape and have a narrow side, are fastened to the I-shaped grooves and glued with an adhesive, such as epoxy.

The support bases 829 have fastening holes (not shown) formed on both ends thereof and are fastened to the cover 817 through the fastening holes. The tuning plates 879, which are assembled on the tuning screw bars 877, are positioned in such a manner that they face the disk-shaped resonator rods 3, which are contained in the housing 801. The resonance frequency band of the variable frequency band filter 800 is varied according to the area of the tuning plates 879 facing the resonator rods 3 and the distance between them. The tuning support 802 can be rotated, but cannot be moved linearly.

The containing space 811 may be subdivided into a number of containing spaces by diaphragms 813, according to requirements on products, and the number of the resonator rods 3 is also determined by the requirements. For stable support for the tuning support 802, a means for retaining and supporting may be additionally provided, such as the manual frequency variation unit 6 shown in FIG. 10.

If the tuning support 802 is rotated a predetermined angle by an external force, the tuning screw bars 877 are rotated accordingly. The area of the tuning plates 879 positioned on top of the resonator rods 3 and the distance between them are then changed, and the resonance frequency band is varied accordingly. After completion of the frequency variation tuning of the variable frequency band filter 800, nuts may be used to fix the tuning support 802 and prevent it from rotating and changing the resonance frequency characteristics.

Figure 65:
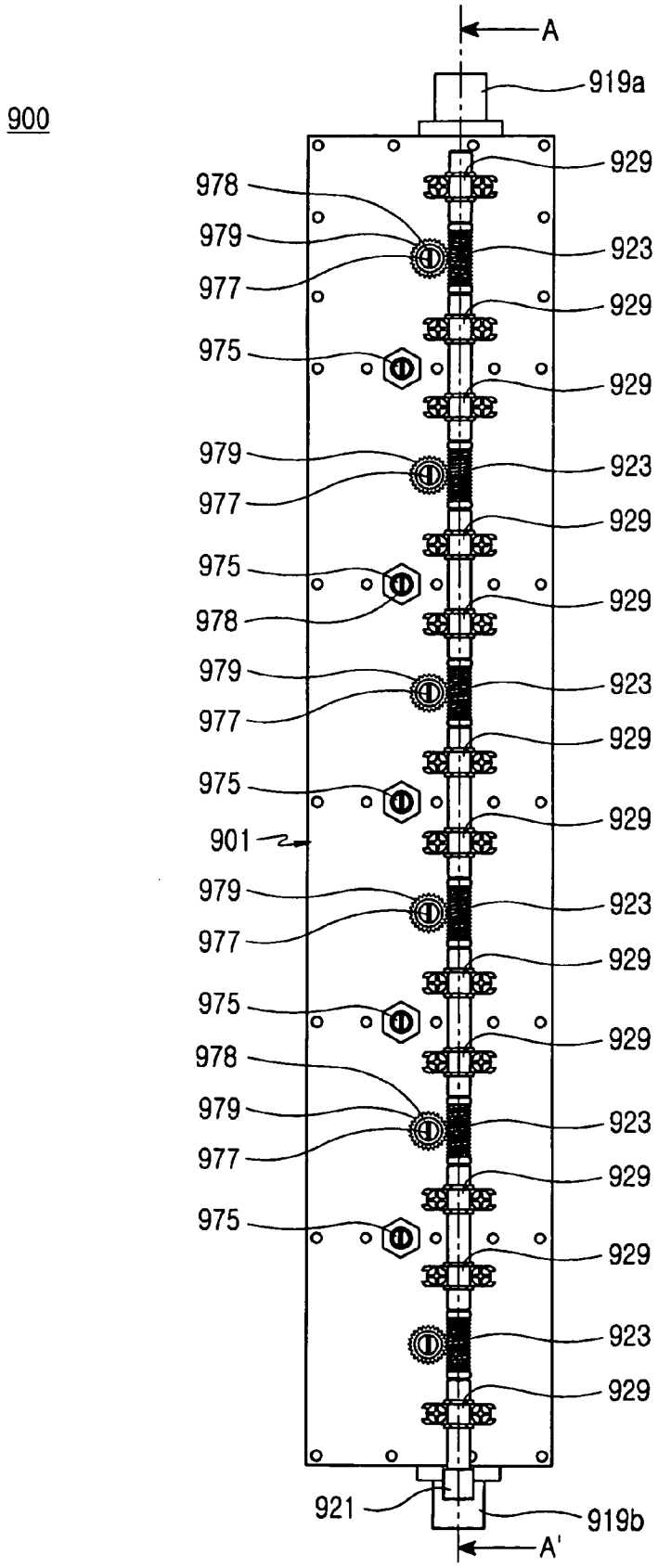
FIG. 65 is a top view showing a variable frequency band filter according to a nineteenth preferred embodiment of the present invention.
Figure 66:
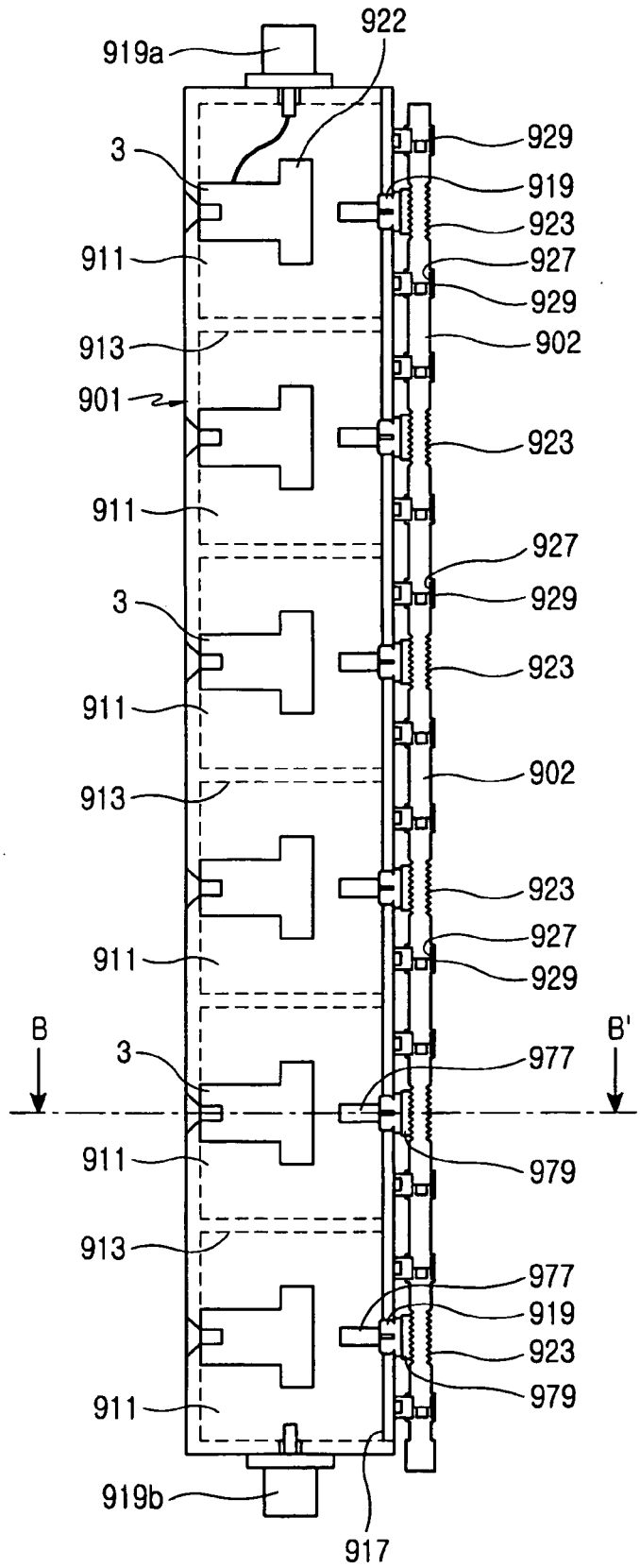
FIG. 66 is a sectional view taken along line A–A' of FIG. 65.
Figure 67:
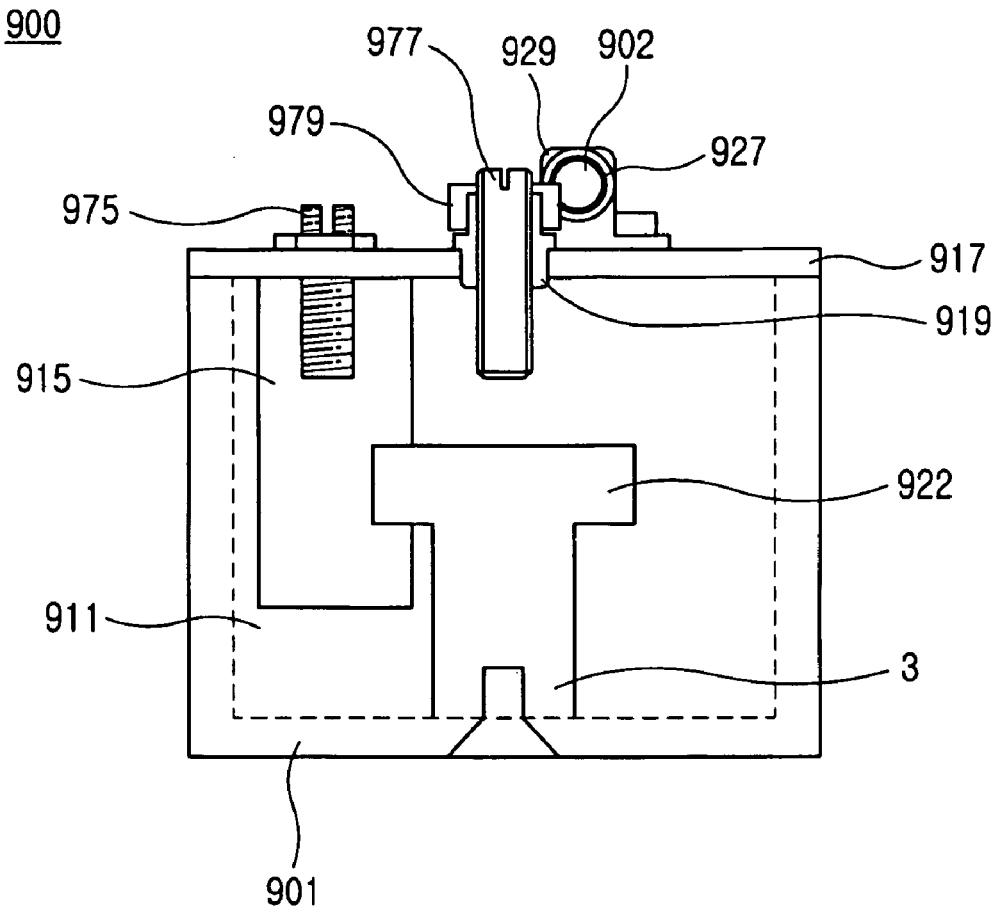
FIG. 67 is a sectional view taken along line B–B' of FIG. 66.

As shown in FIGS. 65 to 67, a variable frequency band filter 900 according to a nineteenth preferred embodiment of the present invention includes a housing 901, resonator rods 3, resonance and coupling tuning screws 977 and 975, input and output connectors 919*a* and 919*b*, a tuning support 902, tension nuts 919, resonance tuning gears 979, tuning support gears 923, coupling windows 915, and a knob 921. The housing 901 has input and output connectors 919*a* and 919*b*. The interior of the housing 901 is divided by diaphragms 913 into a number of containing spaces 911, in which disk-shaped resonator rods 3 are contained.

The input connector 919*a* and the output connector 919*b* are positioned on the opposite end surfaces of the housing 901, respectively, and each of them is connected to a chosen containing space. The diaphragms 913 have coupling windows 915 formed therein for serial connection from a containing space, to which the input connector 919*a* is connected, to another containing space, to which the output connector 919*b* is connected. The housing 901 has an open upper surface. After the disk-shaped resonator rods 3 are contained in the respective containing spaces, the upper end of the housing 901 is sealed using a cover 917.

The disk-shaped resonators 3 have a disk 922 extending in the diametric direction along the upper outer peripheral surface thereof. The variable frequency band filter 900, wherein disks 922 are positioned on the upper end of the resonator rods 3 which is assembled in the housing 901, is characterized in that it is operated for a low resonance frequency. The interrelationship between the resonance frequency and the housing 901, the disk-shaped resonator rods 3, the diaphragms 913, as well as the cover 917, will now be explained with reference to FIG. 6.

Figure 6:
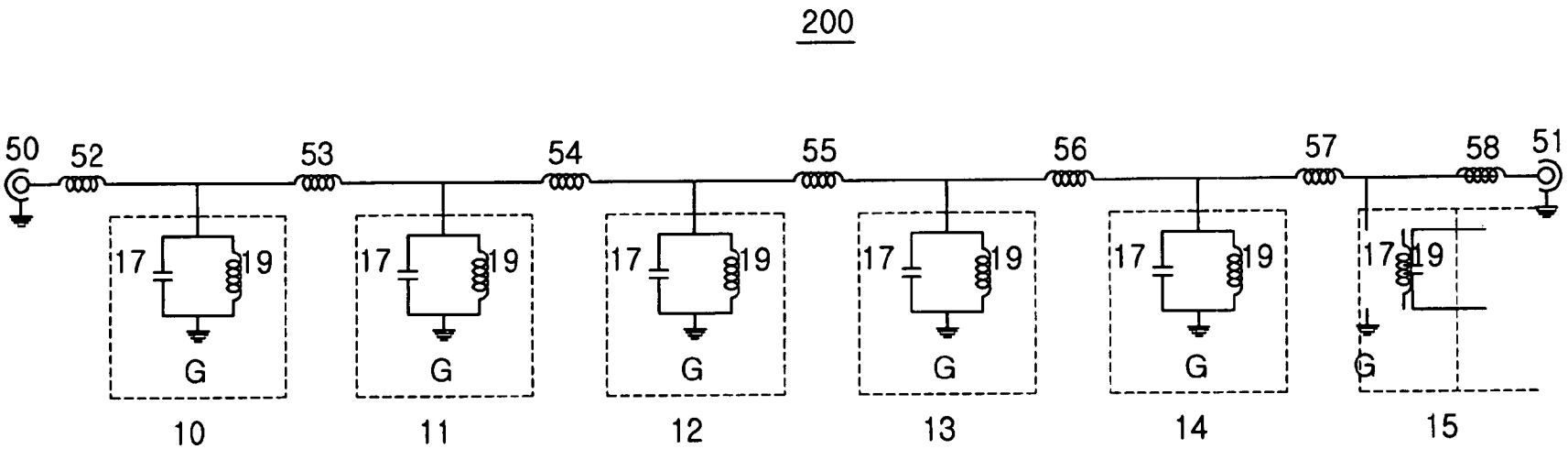
FIG. 6 is an equivalent circuit diagram illustrating the operation of the radio frequency filter shown FIG. 1.

The resonance frequency of the variable frequency band filter 900 is determined by values of capacitance and inductance, which are formed among capacitive components 17 and inductive components 19 constituting resonance circuits 10, 11, 12, 13, 14, and 15, particularly among the housing 901, the disk-shaped resonator rods 3, the diaphragms 913, and the cover 917, as is clear from the circuit diagram shown in FIG. 6. Also, the input and output connectors 919*a* and 919*b* are connected the disk-shaped resonator rods 3 via an input terminal coupling copper wire and an output terminal coupling copper wire, respectively. The resonance frequency of the variable frequency band filter 900, configured as above, is affected by the length, outer diameter, and the like of the disk-shaped resonator rods 3 and can be tuned more precisely with separate resonance tuning screws, as in the previous embodiment.

The resonance tuning screws 977 are fastened to the cover 917, which has screw tap holes formed with a predetermined spacing. The tension nuts 919 are previously fastened at locations where the resonance tuning screws 977 are fastened to the cover 917. The tension nuts 919 have screw tabs formed in both the exterior and interior thereof. The tension nuts 919 have an I-shaped slot facing downward for maintaining tension. The resonance tuning screws 977 are fastened to the tension nuts 919. Specifically, the resonance tuning gears 979, which are fastened on the upper end of the resonance tuning screws 977, are fastened to the resonance tuning screws 977 with a resonance tuning guide 978 inserted between them.

The tuning support 902 is coupled to support bases 929 in such a manner that it can be rotated. Tuning support guides 927 are interposed between the tuning support 902 and the support bases 929 for lubrication. The tuning support 902 has tuning support gears 923 formed on the outer peripheral surface thereof. The tuning support gears 923 are positioned at locations of the corresponding resonance tuning gears 979.

The support bases 929 have fastening holes (not shown) formed on both ends thereof and are fastened to the cover 917 through the fastening holes. The tuning support gears 923, which are formed on the tuning support 902, are engaged with the resonance tuning gears 979. If the tuning support 902 is rotated by an external force, the resonance tuning screws 977, which are integrated to the resonance tuning gears 979, are moved vertically. The resonance tuning guides 978, which are positioned between the resonance tuning screws 977 and the resonance tuning gears 979, are compressed by a friction force which is large enough to rotate the resonance tuning screws 977 and the resonance tuning gears 979 simultaneously. The resonance tuning screws 977 are positioned in such a manner that they correspond to the respective the disk-shaped resonator rods 3, which are contained in the housing 901. The capacitance component is adjusted and the respective resonance frequency bands are varied according to the area of the resonance tuning screws 977 facing the resonator rods 3 and the distance between them. For stable support for the tuning support 902, a means for retaining and supporting may be additionally provided, such as the manual frequency variation unit 6 shown in FIG. 10.

When the frequency band is varied, a deviation in electric characteristics occurs according to the respective frequency bands. The resonance tuning screws 977 are used to perform fine compensation tuning.

The friction force of the resonance tuning guides 978, which are positioned between the resonance tuning screws 977 and the resonance tuning gears 979, is smaller than the force which keeps the resonance tuning gears 979 engaged with the tuning support gears 923. Accordingly, the resonance tuning screws 977 are rotated and regulated. In summary, the resonance tuning screws 977 combine the function of the tuning screw bars with that of the resonance tuning screws of the previous embodiments. After completion of the frequency variation tuning of the variable frequency band filter 900, no fixing process is necessary.

Figure 68:
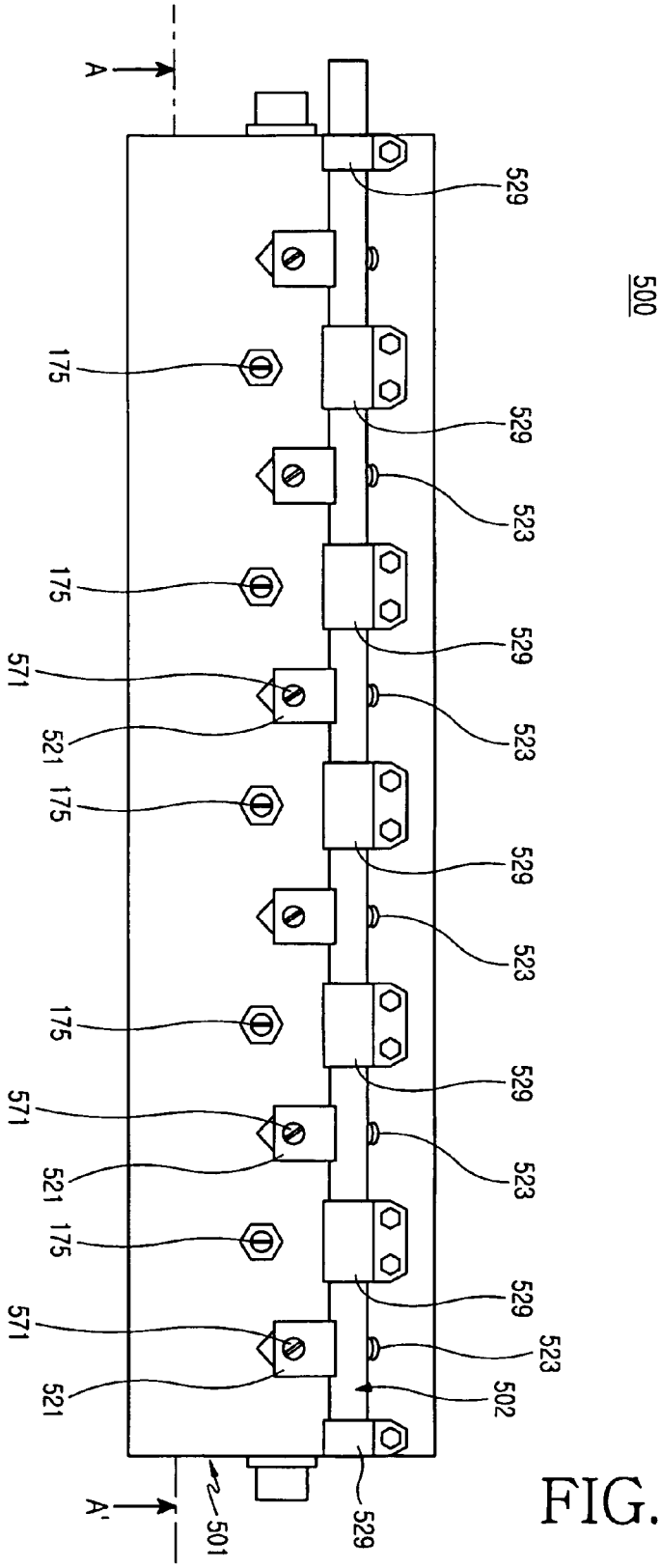
FIG. 68 is a top view showing a variable frequency band filter according to a twentieth preferred embodiment of the present invention.
Figure 69:
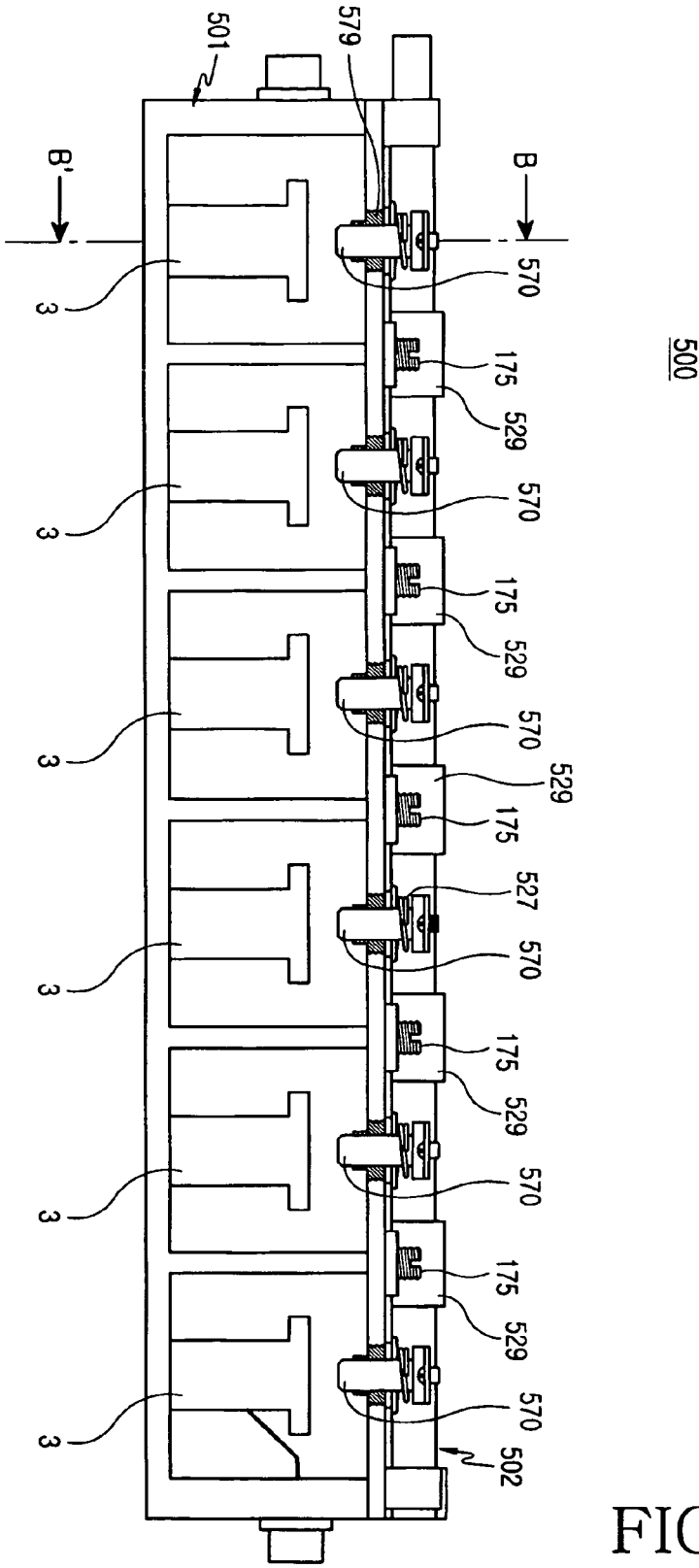
FIG. 69 is a sectional view taken along line A–A' of FIG. 68.
Figure 70:
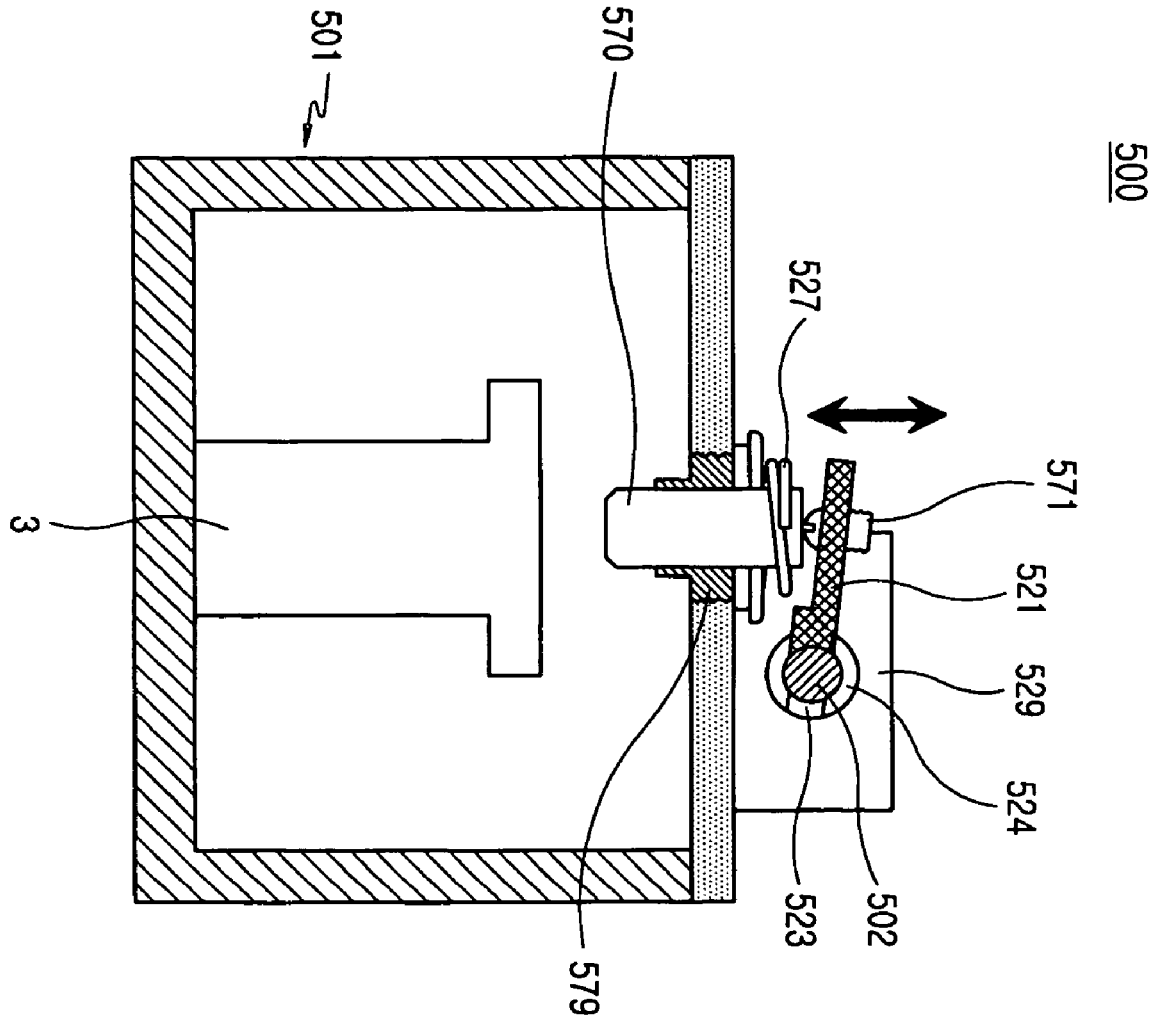
FIG. 70 is a sectional view taken along line B–B' of FIG. 69.

FIGS. 68 to 70 show a variable frequency band filter 500 according to a twentieth embodiment of the present invention. In the following description of the twentieth embodiment of the present invention with reference to FIGS. 68 to 70, the same components as in the previous embodiments are given the same reference numerals and repeated descriptions thereof will be omitted.

A variable frequency band filter 500 according to a twentieth embodiment of the present invention includes a housing 501, at least one resonator rod 3 extending from the bottom surface of the housing 501, first resonance tuning screws 570 coupled to the outer peripheral surface of the housing 501 in such a manner that an end thereof can move linearly in a direction approaching or away from the resonator rod 3, a tuning support 502 adapted to be rotated on the outer peripheral surface of the housing 501, support plates 521 extending from the outer peripheral surface of the tuning support 502 along the diametric direction thereof, and support springs 527 for providing an elastic force in such a direction that the first resonance tuning screws 570 are moved away from the resonator rod 3.

The first resonance tuning screws 570 are fastened in screw tap holes, which are formed on the outer peripheral surface of the housing 501 with a predetermined spacing. The location of the screw tap holes corresponds to that of the resonator rods 3. Tension nuts 579, which have a screw tap formed on the outer peripheral surface thereof, are fastened in the screw tap holes of the housing 501. The first resonance tuning screws 570 then pass through the tension nuts 579 and are coupled thereto. Consequently, the tension nuts 579 guide the linear movement of the first resonance tuning screws 570. The tension nuts 579 may have an I-shaped slot formed on the lower portion thereof for maintaining tension. After the first resonance tuning screws 570 are inserted into the tension nuts 579, support springs 527 are coupled between the first resonance tuning screws 570 and the outer peripheral surface of the housing 501 to provide and maintain a predetermined elastic force. An end of the support springs 527 is supported on the outer peripheral surface of the housing 501, and the other end thereof is supported on the other end of the first resonance tuning screws 570, so that the support springs 527 provide an elastic force in such a direction that an end of the first resonance tuning screws 570 is moved away from the resonator rods 3.

The tuning support 502 is coupled in such a manner that it can be rotated on the outer peripheral surface of the housing 501. In order to support the rotation of the tuning support 502, at least one support base 529 is fixed on the outer peripheral surface of the housing 501. The tuning support 502 then extends through the support base 529 and is coupled thereto. For stable rotation of the tuning support 502, a number of support bases 529 may be positioned with a predetermined spacing, but the location and shape of the support base may be modified as desired. In addition, a support guide 524 may be interposed between the outer peripheral surface of the tuning support 502 and the support base 529 so that the tuning support 502 can be rotated smoothly while it extends through the support base 529.

The support plates 521 extend from the outer peripheral surface of the tuning support 502 along the diametric direction thereof and have an end positioned adjacently to a surface of the other end of the first resonance tuning screws 570. If the tuning support 502 is rotated in one direction by an external force, the support plates 521 are rotated about the tuning support 502 and press the first resonance tuning screws 570, so that an end of the first resonance tuning screws 570 approaches the resonator rods 3. If the tuning support 502 is rotated in the other direction, the support plates 521 are moved away from the other end of the first resonance tuning screws 570. As the elastic force from the support springs 527 moves the first resonance tuning screws 570 away from the resonator rods 3, the other end of the first resonance tuning screws 570 continuously faces a surface of the support plates 521.

The support plates 521 have a planar shape. As the tuning support 502 is rotated, the support plates 521 are slanted relative to the first resonance tuning screws 570. The slant angle of the support plates 521 depends on the degree at which the tuning support 502 is rotated. In this case, the linear traveling distance of the first resonance tuning screws 570, which depends on the amount of rotation of the tuning support 502, may not be maintained constant.

Accordingly, second resonance tuning screws 571 may be fastened to the support plates 521 and face the other end surface of the first resonance tuning screws 570. The end of the second resonance tuning screws 571, which faces a surface of the other end of the first resonance tuning screws 570, has a curved surface so that the contact area and the contact location can be maintained constant, even when the tuning support 502 is rotated.

The support springs 527, which are inserted between the outer peripheral surface of the housing 501 and the first resonance tuning screws 570 to maintain a predetermined tension, makes it possible to perform tuning smoothly using the second resonance tuning screws 571 and improves the stability when varying the respective resonance frequency band, as well as when being subject to external impacts.

The support plates 521, which extend from the outer peripheral surface of the tuning support 502 along the diametric direction thereof, may be separately fabricated and fastened to the tuning support 502 by screws 523, which extend through the tuning support 502 along the diametric direction, or may be integrated to the tuning support 502, considering the convenience in assembling the tuning support 502, the support bases 529, and the support guides 524. For example, when through-holes are formed on the support bases 529 and the support guides 524 and the tuning support 502 is assembled in such a manner that it extends through the support bases 529 and the support guides 524, it is impossible to integrally fabricate the tuning support 502 and the support plates 521. However, when the support bases 529 and the support guides 524 have the shape of a ring surrounding a part of the outer peripheral surface of the tuning support 502, it is possible to integrally fabricate the tuning support 502 and the support plates 521, because the tuning support 502 is not assembled in such a manner that it extends through the support bases 529 and the support guides 524, but the support bases and the support guides are rotatably coupled to the outer peripheral surface of the support rod 502. Alternatively, the tuning support 502 and the support plates 521 can be integrally fabricated by assembling a pair of support guides, which surround only a part of the outer peripheral surface of the tuning support 502, in such a manner that they face each other to completely surround the outer peripheral surface of the tuning support 502 and by assembling a pair of support bases, which surround only a part of the outer peripheral surface of the tuning support 502, in such a manner that they face each other.

The location of the first resonance tuning screws 570 corresponds to that of the resonator rods 3 contained in the housing 2. The capacitance component is adjusted and the respective resonance frequency bands are varied according to the area of the first resonance tuning screws 570 facing the resonator rods 3 and the distance between them.

The containing space within the housing 501 may be further subdivided into a number of containing spaces by diaphragms, according to requirements on products, and the number of the resonator rods 3 is also determined by the requirements. It is also possible to automatically control the tuning rods using a driving motor, as disclosed in the previous embodiments.

Meanwhile, the tuning rods of the variable frequency band filter according to the above-mentioned embodiments of the present invention may be made of dielectric substance or metallic material. Alternatively, they may be made of a combination of dielectric substance having different dielectric constants.

Figure 1:
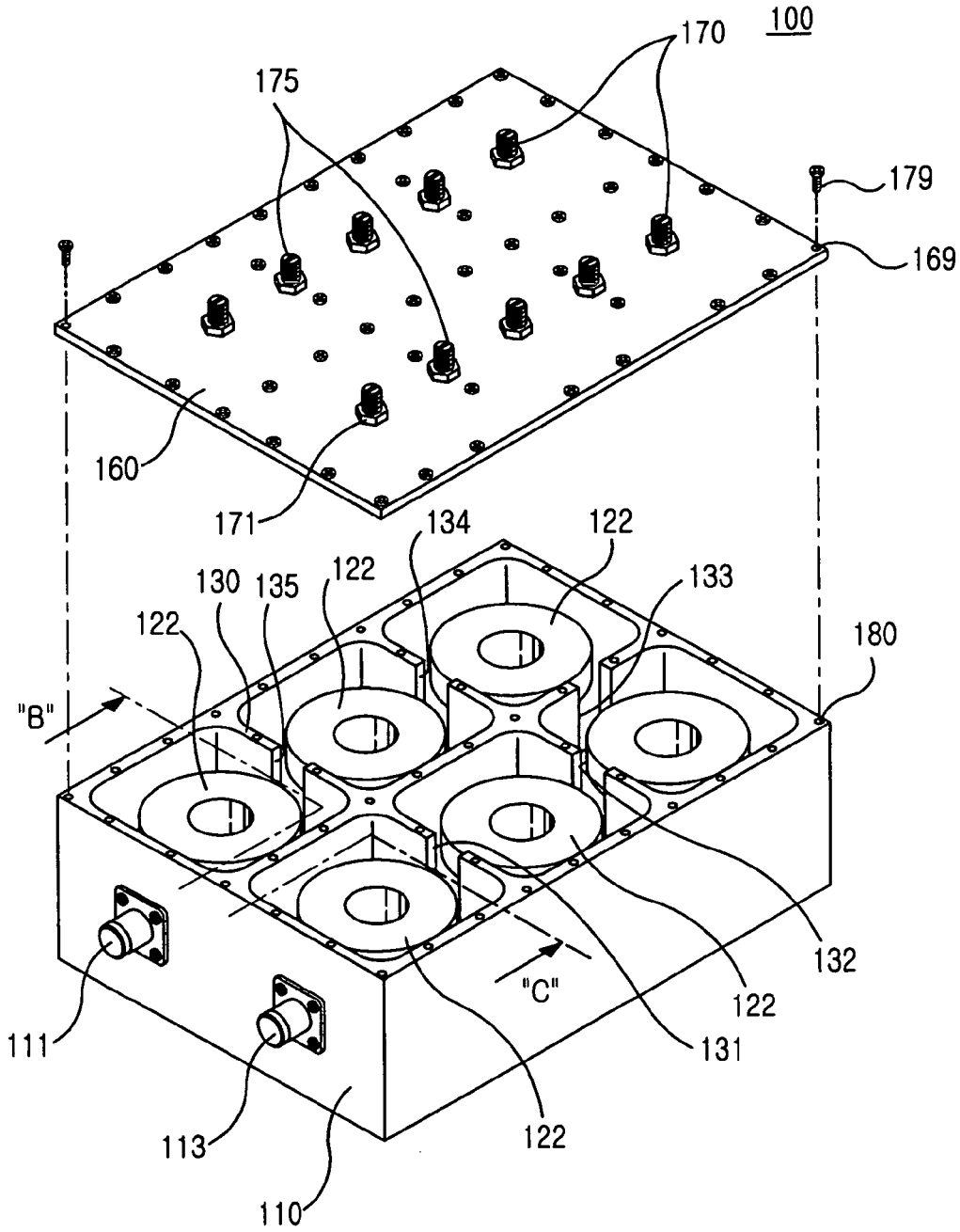
FIG. 1 is a perspective view showing an embodiment of a conventional radio frequency filter.
Figure 2:
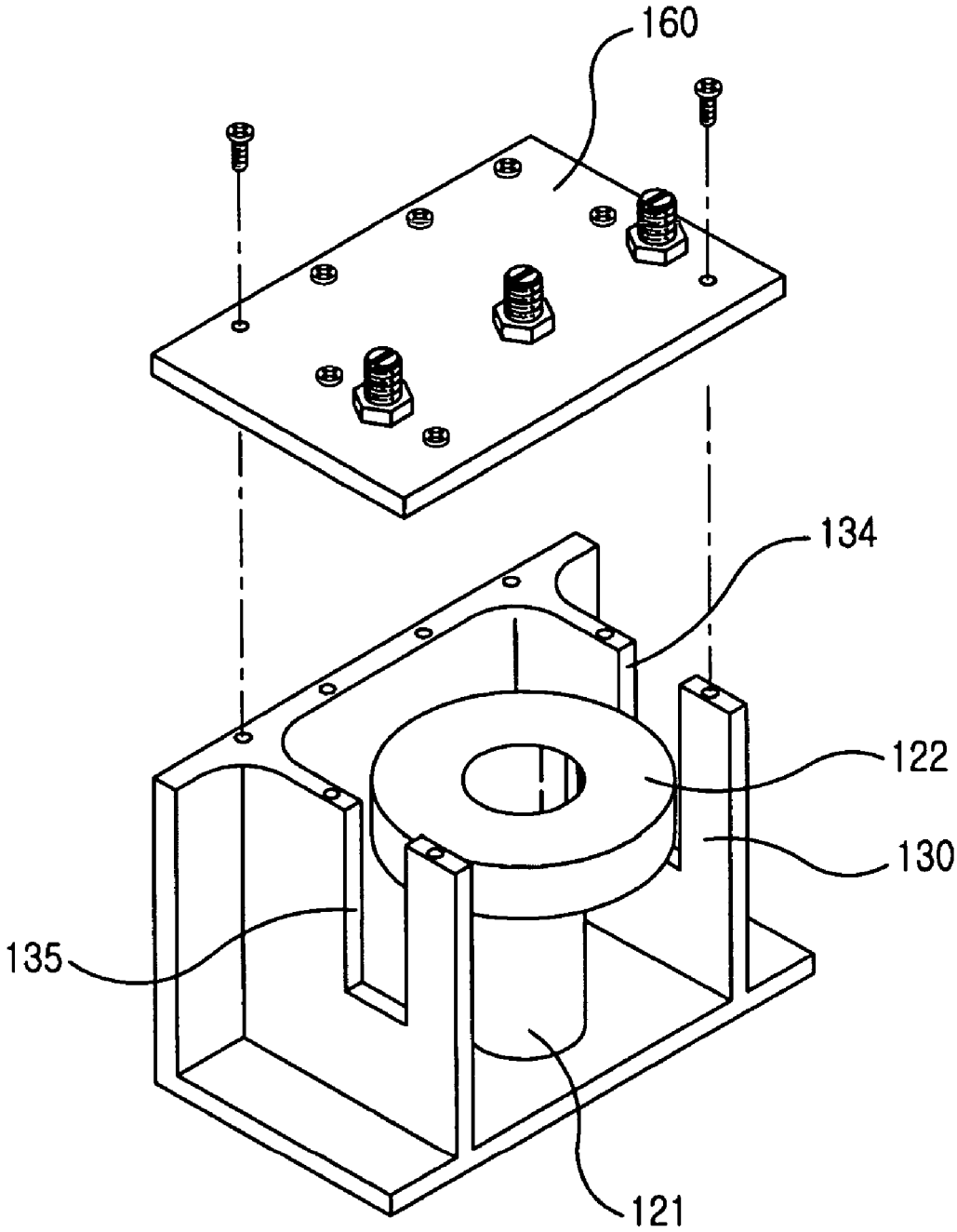
FIG. 2 is a partially exploded perspective view showing the construction of the radio frequency filter shown in FIG. 1.
Figure 3:
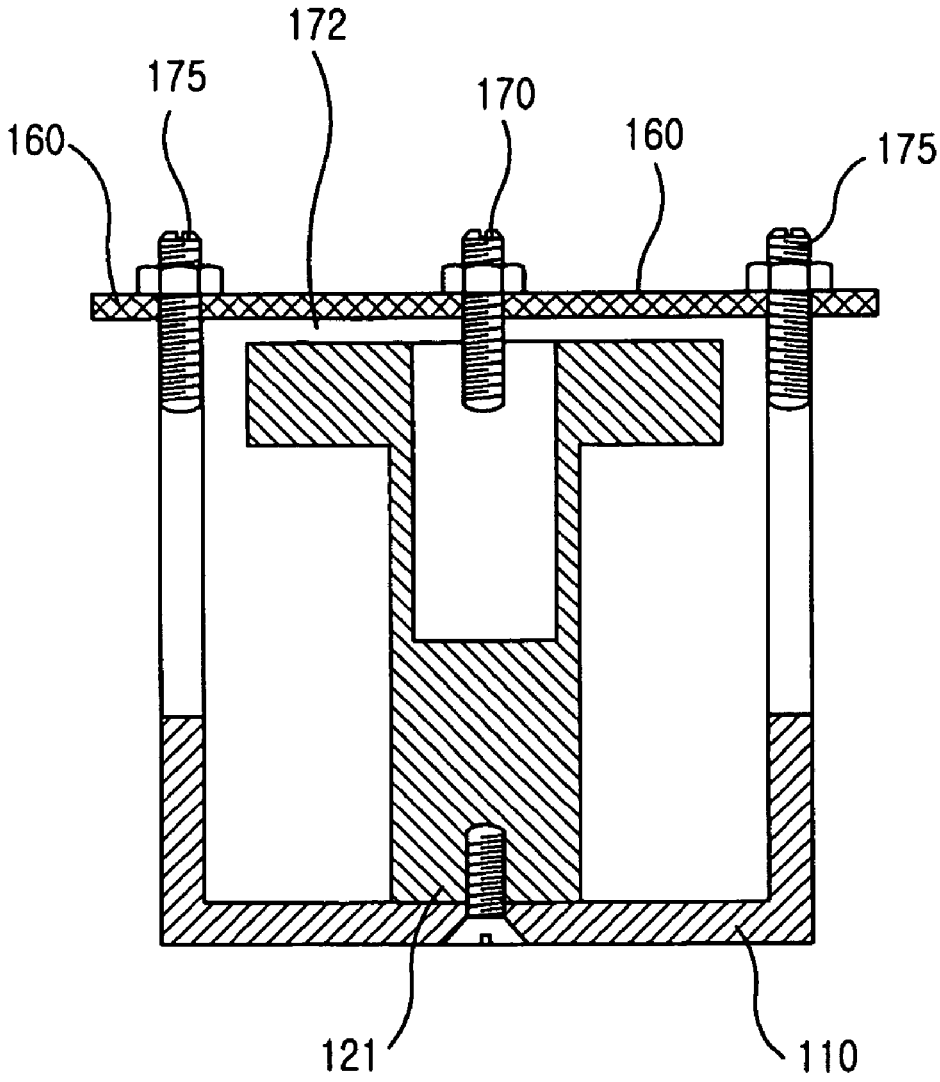
FIG. 3 is a lateral sectional view showing a part of the construction of the radio frequency filter shown in FIG. 2.
Figure 4:
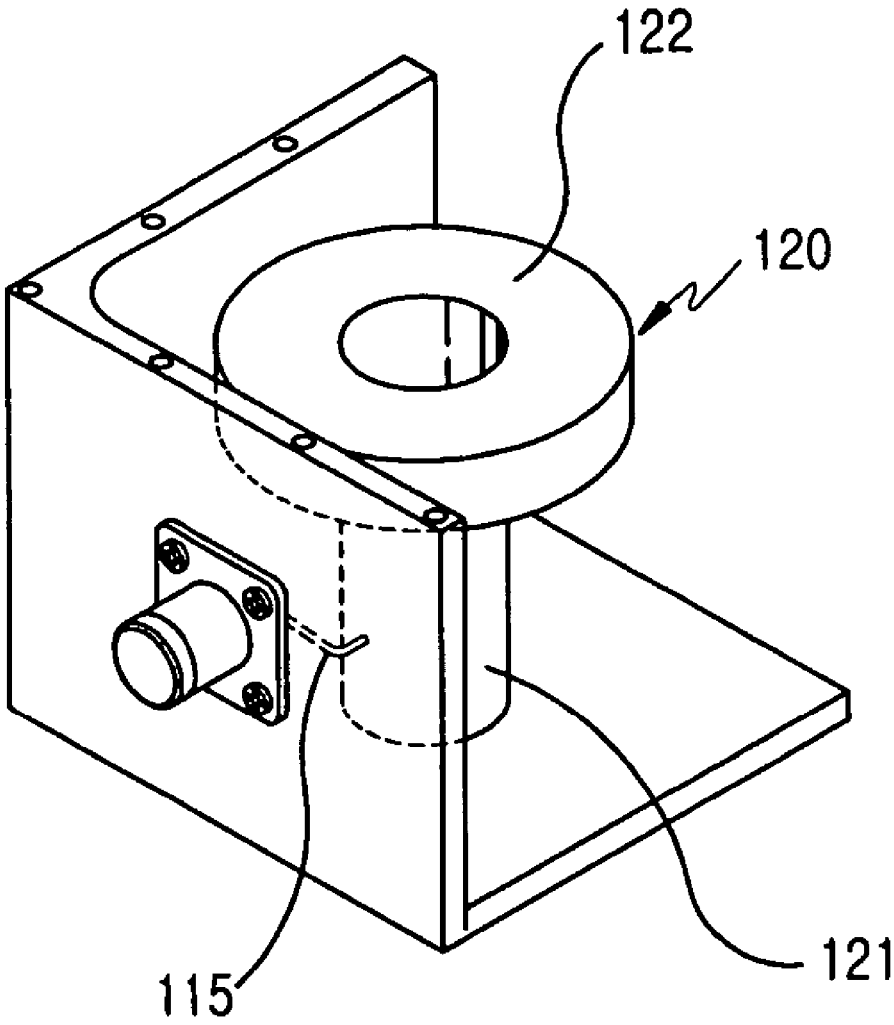
FIG. 4 is a perspective view showing the interior of an input terminal of the radio frequency filter of FIG. 1, taken along line B.
Figure 5:
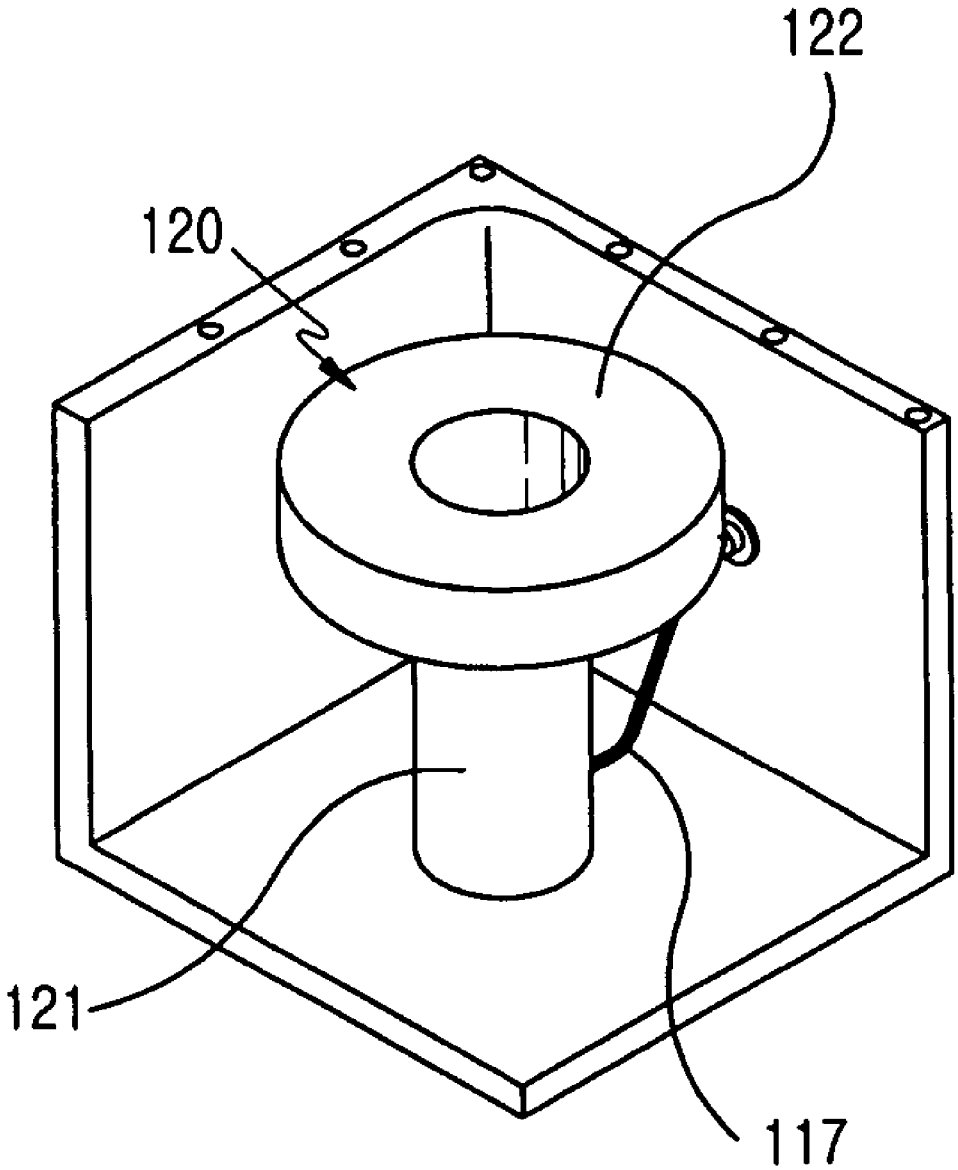
FIG. 5 is a perspective view showing the interior of an output terminal of the radio frequency filter of FIG. 1, taken along line C.

When the tuning support is positioned in the housing together with the resonator rods, as mentioned above, it is preferably made of alumina, polycarbonate, Teflon, metallic substance, or dielectric substance. In the case of a variable frequency band filter having a separate support housing, the tuning support can be made of material which is more inexpensive than the above materials. The housing may be manufactured by an extrusion process as in the present invention, or by machining and die casting as shown in FIG. 1.

As mentioned above, the variable frequency band filter according to the present invention can vary the resonance frequency band using the tuning support and tuning rods, so that a single product can be used for various frequency bands. As a result, it is possible to decrease the manufacturing cost, to perform mass production according to a plan with reduced cost for obtaining parts, to vary the frequency band in a simple manner without any addition operation, and to simultaneously vary the resonance frequency, which depends on respective resonator rods, with a single operation.

While the invention has been shown and described with reference to certain preferred embodiments thereof, it will be understood by those skilled in the art that various changes in form and details may be made therein without departing from the spirit and scope of the invention as defined by the appended claims. For example, the present invention is applicable to all types of radio frequency filters.

What is claimed is:

1. A variable frequency band filter comprising:

a housing having a number of containing spaces;

a number of resonator rods extending upward from the bottom surface of the containing spaces;

a number of tuning rods positioned proximate to the upper or lateral surface of the respective resonator rods; and a tuning support extending through the opposite lateral surfaces of the housing and supported by them, the tuning support being coupled to the respective tuning rods and being adapted to be moved by an external force to vary the position of the tuning rods.

2. A variable frequency band filter as claimed in claim 1 further comprising a frequency variation unit positioned on one of the lateral surfaces of the housing, the frequency variation unit being coupled to an end of the tuning support and being adapted to vary the position of the tuning rods in a stepwise manner, as the tuning support is slid, according to the frequency band.

3. A variable frequency band filter as claimed in claim 2, wherein the frequency variation unit includes an auxiliary housing positioned on one of the lateral surfaces of the housing, a movable ball adapted to move vertically within a working space defined in the auxiliary housing, and a coil spring positioned on top of the movable ball to provide an elastic force for enabling the vertical movement of the movable ball.

4. A variable frequency band filter as claimed in claim 3, wherein the tuning support has a number of coupling grooves formed on an end thereof, according to the respective frequency bands, to be coupled to the movable ball of the frequency variation unit as the tuning support is slid.

5. A variable frequency band filter as claimed in claim 2, wherein the tuning rods have a square shape.

6. A variable frequency band filter as claimed in claim 1 further comprising a movable plate positioned on an end of the tuning support and fastened to a driving motor positioned on an end of the housing to provide the movable plate with a driving force to slide the tuning support according to the rotation of the motor.

7. A variable frequency band filter as claimed in claim 6, wherein the movable plate has a first coupling hole formed at a predetermined location on a side thereof to be fixedly coupled to an end of the tuning support and a second coupling hole formed at a predetermined location on the other side thereof to be engaged with a gear unit of the driving motor.

8. A variable frequency band filter as claimed in claim 6, wherein the tuning rods have a square shape.

9. A variable frequency band filter as claimed in claim 1, wherein an end of the tuning support is fastened to one of the surfaces of the housing so that the tuning support can be moved linearly while being rotated.

10. A variable frequency band filter as claimed in claim 1 further comprising a driving motor for providing the tuning support with a rotational force, and wherein an end of the tuning support is fastened to a surface of the housing so that the tuning support can be moved linearly, while being rotated, by the rotational force from the driving motor.

11. A variable frequency band filter as claimed in claim 1, wherein the tuning support is adapted to be rotated without any translation.

12. A variable frequency band filter as claimed in claim 11, wherein the tuning rods have an elliptical shape.

13. A variable frequency band filter as claimed in claim 11 further comprising spacing regulator plates positioned between the resonator rods and the tuning rods, respectively, to regulate the spacing between them as the tuning rods are rotated.

14. A variable frequency band filter as claimed in claim 13, wherein the spacing regulator plates have a fastening portion formed on the upper portion thereof to be fastened to the internal wall surface of the housing and a plate spring formed on the lower portion thereof along the longitudinal direction of the resonator rods.

15. A variable frequency band filter as claimed in claim 13, wherein the spacing regulator plates have a curved portion.

16. A variable frequency band filter as claimed in claim 13, wherein the spacing regulator plates includes a pair of fastening portions formed on the upper portion thereof to be fastened to the internal wall surface of the housing, a containing space defined between the pair of fastening portions in a U-shaped configuration for containing the tuning rods therein, and a flexible plate member positioned in the lower portion of the containing space and adapted to make an elastic deformation in the vertical direction as the tuning rods are rotated.

17. A variable frequency band filter as claimed in claim 11 further comprising a motor for providing the tuning support with a rotational force.

18. A variable frequency band filter as claimed in claim 1, wherein the tuning rods comprise dielectric substance, metallic material, or a combination of dielectric substance having a high dielectric constant and dielectric substance having a low dielectric constant.

19. A variable frequency band filter as claimed in claim 1, wherein the tuning support comprises alumina, polycarbonate, Teflon, metallic substance, or dielectric substance.

20. A variable frequency band filter as claimed in claim 1 further comprising front and rear covers coupled to the opposite ends of the housing, respectively, and horizontal guide holes extending a predetermined distance along the horizontal direction on the front and rear covers, respectively, and wherein the opposite ends of the tuning support are supported by the horizontal guide holes in such a manner that they can be moved horizontally therein.

21. A variable frequency band filter as claimed in claim 20 further comprising at least one driving motor for providing a driving foree to move the tuning support in the horizontal direction.

22. A variable frequency band filter as claimed in claim 21, wherein both ends of the tuning support are provided with the driving motor.

23. A variable frequency band filter as claimed in claim 1 further comprising front and rear covers coupled to the opposite ends of the housing, respectively, and vertical guide holes extending a predetermined distance along the vertical direction on the front and rear covers, respectively, and wherein the opposite ends of the tuning support are supported by the vertical guide holes in such a manner that they can be moved vertically therein.

24. A variable frequency band fitter as claimed in claim 23 further comprising at least one driving motor for providing a driving force to move the tuning support in the vertical direction.

25. A variable frequency band filter as claimed in claim 24, wherein both ends of the tuning support are provided with a said driving motor.

26. A variable frequency band filter as claimed in claim 1 wherein a support housing is positioned on the upper end of the housing; the inner space of the support housing is connected to the interior of the housing through guide holes, which are formed on the upper surface of the housing while facing the respective resonator rods; the tuning support is supported by both ends of the support housing and the tuning rods have a support bar positioned on top of the resonator rods in the housing in such a manner that the support bar extends through the guide holes and connects the tuning rods to the tuning support.

27. A variable frequency band filter as claimed in claim 26, wherein the guide holes extend along the longitudinal direction of the tuning support, and the tuning support is adapted to slide along the longitudinal direction in the support housing.

28. A variable frequency band filter as claimed in claim 26, wherein the guide holes extend in a direction perpendicular to the longitudinal direction of the tuning support, the support housing has horizontal support holes formed on both ends thereof to support the opposite ends of the tuning support, respectively, and the tuning support is adapted to slide on a horizontal plane in a direction perpendicular to the longitudinal direction.

29. A variable frequency band filter as claimed in claim 26, wherein the support housing have vertical support holes formed on the opposite ends thereof to support the opposite ends of the tuning support, respectively and the tuning support is adapted to slide in the vertical direction.

30. A variable frequency bend filter as claimed in claim 1, wherein the tuning support supports the tuning rods proximate to the upper or lateral surfaces whlxut passing through an opening in any of the resonator rods.

31. A variable frequency band filter as claimed in claim 1, wherein the tuning support is adapted to vary the position of the tuning rods in a lateral direction with respect to the upper or lateral surface of the respective resonator rods.

32. A variable frequency bend filter as claimed in claim 30, wherein the tuning support is adapted to vary the position of the tuning rods in a lateral direction with respect to the upper or lateral surface of the respective resonator rods.

* * * * *